US006411273B1

(12) United States Patent
Nakamura et al.

(10) Patent No.: US 6,411,273 B1
(45) Date of Patent: Jun. 25, 2002

(54) DRIVE CIRCUIT FOR ACTIVE MATRIX LIQUID CRYSTAL DISPLAY

(75) Inventors: Mika Nakamura, Hirakata; Yutaka Nanno, Takarazuka; Naomi Kaneko, Kyoto; Masumi Izuchi, Hirakata; Hiroshi Tsutsu, Osaka; Katsumi Adachi, Kashiba, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/194,721

(22) PCT Filed: Apr. 21, 1998

(86) PCT No.: PCT/JP98/01818

§ 371 (c)(1),
(2), (4) Date: Dec. 21, 1998

(87) PCT Pub. No.: WO98/48318

PCT Pub. Date: Oct. 29, 1998

(30) Foreign Application Priority Data

Apr. 22, 1997 (JP) ..... 9-104345
Nov. 27, 1997 (JP) ..... 9-325728

(51) Int. Cl.[7] ..... G09G 3/36
(52) U.S. Cl. ..... 345/98; 345/205
(58) Field of Search ..... 345/87, 88, 89, 345/98, 100, 99, 94, 95, 96, 97, 211, 212, 213, 208, 209, 210, 204, 205, 206

(56) References Cited

U.S. PATENT DOCUMENTS 4,644,338 A 2/1987 Aoki et al.
5,389,872 A 2/1995 Erhart et al.
5,563,426 A 10/1996 Zhang et al.
5,572,211 A 11/1996 Erhart et al.

FOREIGN PATENT DOCUMENTS

| | | |
|---|---|---|
| GB | 2118386 | 10/1983 |
| JP | 55060333 A | 5/1980 |
| JP | 63-223788 | 9/1988 |
| JP | 04143791 A | 5/1992 |
| JP | 04195189 A | 7/1992 |
| JP | 05061432 A | 3/1993 |
| JP | 07325556 | 12/1995 |
| JP | 08046515 A | 2/1996 |
| JP | 08084078 A | 3/1996 |
| JP | 09127918 A | 5/1997 |

*Primary Examiner*—Xiao Wu
(74) *Attorney, Agent, or Firm*—Parkhurst & Wendel, L.L.P.

(57) ABSTRACT

An object of the present invention is, by eliminating a driver IC from the components of an liquid crystal display, to achieve a cost reduction, to eliminate a manufacturing step of mounting the driver IC onto an array substrate, and to reduce a thickness of the liquid crystal display. A driver circuit for an active matrix liquid crystal display comprises a resistive dividing type digital-to-analog converter circuit (DAC). An analog output voltage from the DAC is amplified by a signal amplifier element, and a liquid crystal element is driven by the amplified analog output voltage. The driver circuit is characterized in that a resistance element R is formed in an n+ layer of p-Si on an array substrate of the liquid crystal display, and a switching element Tr and a signal amplifier element are also formed on the array substrate.

96 Claims, 60 Drawing Sheets

DRIVE CIRCUIT FOR ACTIVE MATRIX LIQUID CRYSTAL DISPLAY

TECHNICAL FIELD

This invention relates to a driver circuit for an active matrix liquid crystal display comprising a resistive dividing type digital to analog converter circuit.

BACKGROUND ART

A driver circuit for an active matrix liquid crystal display capable of displaying multi-scale gray images or full-color images generally comprises a digital-to-analog converter circuit (DAC) so that analog video signals are outputted. A capacitor based DAC is well known in the art as one type of such a DAC. However, such a capacitor based DAC has a drawback in that a linear output voltage characteristic cannot be obtained easily when such a capacitor based DAC is employed in constructing a driver circuit for a liquid crystal display (LCD). In view of this drawback, a resistive dividing type DAC using resistance elements has also been employed for an LCD driver circuit.

Among such resistive dividing type DACs, some types are constructed utilizing resistance elements and switching elements, both having an individual component form, but many types are constructed within a single crystalline silicon integrated circuit (IC) and formed in a chip form. Such a driver IC has been used for conventional LCD driver circuits. Specifically, in those driver circuits having resistive dividing type DACs, driver ICs are attached onto an array substrate by a tape automated bonding or by directly mounting onto the array substrate.

However, such an LCD driver circuit has drawbacks as described in the following.

(1) A driver IC is essential as a component of an LCD, and therefore the component cost is high.

(2) A step of mounting the driver IC onto an array substrate is inevitably required.

(3) The thickness of an LCD is increased corresponding to the thickness of the driver IC, and in addition, the driver IC requires a large area in the array substrate. These have been the major obstacles in the attempts to reduce the physical sizes and thickness of LCDs.

(4) Furthermore, in conventional driver circuits utilizing a crystalline silicon, a silicon in which an n-type or p-type impurity of approximately $10^{16}/cm^3$ is doped is typically employed for resistance elements that constitute DACs in the driver circuits. A resistance value of these resistance elements must be controlled with extremely high precision by controlling a concentration of these impurities so as to suppress an output variation among these DAC chips. As a result, in order to produce a chip with an extremely precise resistance value, an ion implantation method should be employed in doping an n-type or p-type impurity in a crystalline silicon. However, by this method, it is extremely difficult to suppress a variation of the resistance value within a predetermined range when a large chip size or a large number of the chip is required, and moreover a throughput until completing the driver circuit is low.

In addition to the above drawbacks, conventional LCD driver circuits have such drawbacks as described below, in view of reducing their power consumption.

A resistive dividing type DAC is a well-known circuit, and while some of the DACs are constructed utilizing the resistance elements and switching elements having an individual component form, many of the DACs commercially available have a chip form incorporated within a single crystalline silicon (c-Si) IC. Recently, there have been developed techniques intended to incorporate an LCD driver circuit including such DACs on a glass substrate by forming thin-film transistors (herein after referred as 'TFTs') utilizing poly-silicon (p-Si). However, because p-Si TFTs are inferior to c-Si transistors' in their performance and thereby in the power efficiency in the circuits, the effective reduction in power consumption has been difficult for such an LCD driver circuit incorporated on the grass substrate, although such a circuit has certain advantages such as low cost and small sizes owing to the fact that they are capable of eliminating driver ICs. In conventional LCD driver circuits, a waste of power consumption is noted particularly during a writing period for source lines and pixel electrodes. The discussion will now focus on this account. Generally speaking, a large amount of capacitive load is connected to a source line because a certain capacitance is generated in each intersection of a source line and gate line, or in each gap between a source line and counter electrode. Therefore, when a driving voltage is outputted from a driver circuit to a source line, a potential of the source line does not reach a required voltage for driving liquid crystals immediately after the driving voltage is outputted, and a certain amount of time is required until a desired voltage is obtained. After this amount of time, i.e., a writing period to a source line elapses, a gate scanning pulse is outputted to a pixel transistor, and thereby a potential of a pixel electrode reaches a desired voltage. Or, a gate scanning pulse is outputted almost simultaneously with an output of a driving voltage, and a potential of a pixel electrode reaches a desired voltage corresponding to the change of a potential of a source line. A writing to a pixel electrode is thus completed according to either of the above described manners. Therefore, there is essentially no need to continue applying a predetermined driving voltage to a source line. Nevertheless, in conventional driving methods, such a writing period to a source line or a pixel electrode has been made equivalent to one horizontal synchronizing period. This is because the writing to a source line or a pixel electrode has been controlled by a horizontal synchronizing signal. As a result, in prior arts, the driver circuit continues a normal operation for applying a driving voltage even during the period in which there is no need to keep applying a predetermined driving voltage to a source line. This has been a major drawback from the viewpoint of reduction in power consumption.

In view of the above-described disadvantages in prior arts, it is therefore an object of the present invention to provide a driver circuit for an active matrix liquid crystal display in which, by eliminating a driver IC from a component of an LCD, the component cost is reduced, the manufacturing steps are simplified, and moreover the reduction of sizes and thickness is achieved.

It is another object of the present invention to provide a driver circuit for an active matrix liquid crystal display in which the reduction of power consumption is achieved by reducing a current consumption of the digital-analog converter circuits therein during a period excluding a normal operation period.

DISCLOSURE OF THE INVENTION

In accordance with the first aspect of the invention, there is provided a driver circuit for an active matrix liquid crystal display formed on an array substrate of the liquid crystal display comprising:

a resistive dividing type digital-to-analog converter circuit (DAC), comprising a plurality of resistance elements and a plurality of switches related to the resistance elements;

the driver circuit constructed so that an output signal from the DAC is outputted as a driving voltage for a liquid crystal display portion of the liquid crystal display via a current amplifier element having an impedance conversion function wherein a voltage amplification ratio of the current amplifier element is 1;

the driver circuit characterized in that the resistance elements are composed of an impurity-containing semiconductor layer formed on the array substrate.

According to the above-mentioned construction, it is made possible to reduce the component cost of an LCD since the driver circuit is formed on the array substrate without using driver ICs as a component for the LCD. Moreover, it is also made possible to reduce the manufacturing cost since the step of mounting the driver ICs onto the substrate is made unnecessary. In addition, the reduction in the thickness and sizes of an LCD can be achieved easily. In particular, the above-mentioned semiconductor layer is formed simultaneously with a step of forming pixel transistors without independently necessitating an step of forming the above-mentioned semiconductor layer, and therefore it is possible to substantially reduce the manufacturing cost.

Furthermore, according to the above construction, it is made possible to produce resistance elements for a driver circuit having a large circuit area without taking into account a joint areas between each chip since the resistance elements are integrally formed on the array substrate. Generally, a mass non-separated type ion shower method, which has a large throughput, is employed as a method for doping an n-type or p-type impurity over a large area. When this method is employed, a variation of resistance values in the entire glass substrate becomes relatively large, and an output variation in the entire glass substrate becomes approximately 20 mV or higher, but an output variation between the channels next to each other is at most within several mV. It is therefore possible to set a large process margin since there are no joint areas between each chip, as seen in prior arts. The output variation in the entire array is approximately 0.1 V, but this causes no problem since, if converted into a luminance variation in the liquid crystal panel, it falls within the range of 10%.

In addition, since the electric current is amplified by a current amplifier element, an output from the DAC circuit can be made substantially smaller in comparison with a output current necessary to charge a capacitive load of a source line. Therefore, the freedom in designing a circuit increases and the reduction in the display size and manufacturing cost is easily achieved.

For the current amplifier element, a voltage follower type op-amp, a source follower type thin film transistor (TFT), and the like may be employed.

In accordance with the second aspect of the invention, there is provided a driver circuit for an active matrix liquid crystal display formed on an array substrate of the liquid crystal display comprising:

a resistive dividing type DAC, comprising a plurality of resistance elements and a plurality of switches related to the resistance elements;

the driver circuit constructed so that an output signal from each of the DACs is directly outputted as a driving voltage for a liquid crystal display portion of the liquid crystal display;

the driver circuit characterized in that the resistance elements are composed of an impurity-containing semiconductor layer formed on the array substrate.

According to the above construction, the display size and manufacturing cost can be further reduced by making the circuit scale smaller, although the voltage required for driving the LCD portion has to be generated by the DAC circuit alone. In addition, an output voltage characteristic with high precision and small variation can be easily obtained since the voltage from the DAC is directly outputted as a driving voltage for the LCD portion.

Furthermore, according to the above construction in which the signal amplifier element is eliminated, when compared with, for example, the construction with the amplifier element formed on the array substrate among the ones employing the amplifier element, the entire circuit area can be made smaller corresponding to the circuit area allotted for the signal amplifier element, and the power consumption can be also reduced corresponding to the power to be consumed by the amplifier element. Likewise, when compared with the construction with an amplifier element mounted onto array substrate, for example, the cost reduction can be achieved since the amplifier element is eliminated from the components of an LCD, and the step of mounting the amplifier element is also eliminated.

In accordance with the third aspect of the invention, there is provided a driver circuit for an active matrix liquid crystal display comprising:

a resistive dividing type DAC, comprising a plurality of resistance elements and a plurality of switches related to the resistance elements;

the driver circuit constructed so that an output signal from the DAC is outputted as a driving voltage for a liquid crystal display portion of the liquid crystal display via a current amplifier element having an impedance conversion function wherein a voltage amplification ratio of the current amplifier element is 1, the current amplifier element being mounted on the array substrate and a remaining portion of the driver circuit excluding the current amplifier element being formed on the array substrate;

the driver circuit characterized in that the resistance elements are composed of an impurity-containing semiconductor layer formed on the array substrate.

According to the above construction, the manufacturing steps are slightly increased since a step of mounting an amplifier element becomes necessary. The effect of the size and thickness reduction of the LCD also becomes slightly small because of the amplifier element incorporated into an IC chip form. However, in the case of forming the amplifier element on the array substrate, unlike the case of forming switching transistors, it is necessary that the formed transistor be capable of achieving an accurate amplification ratio, and therefore, the manufacturing is rendered very difficult particularly when a non-single crystalline material is utilized. Hence, the construction where an IC chip-formed individual component is employed only for the current amplifier element has an advantage in that the manufacturing is made easier than the construction where the amplifier element is formed on the array substrate.

In accordance with the fourth aspect of the invention, there is provided a driver circuit as in one of the first to third aspects of the invention, wherein the semiconductor layer is composed of a non-single crystalline material including silicon and germanium, and contains an impurity which acts as a donor or an acceptor.

According to the above construction, the same effect as in the first aspect of the invention can be attained.

In accordance with the fifth aspect of the invention, there is provided a driver circuit as in one of the first to third aspects of the invention, wherein the semiconductor layer is a non-single crystalline silicon layer and is at least one layer of an n-type layer and a p-type layer.

According to the above construction, the same effect as in the first aspect of the invention can be attained.

In accordance with the sixth aspect of the invention, there is provided a driver circuit as in one of the first to third aspects of the invention, wherein the DAC is an R-b 2R ladder type DAC.

According to the above construction employing an R-2R ladder type DAC, it is made possible to obtain a linear output voltage characteristic. Moreover, an adverse effect on an output voltage characteristic by a variation of resistance values is rendered small since the DAC is constructed by two types of resistance elements each having a different resistance value. In addition, the total area occupied by the resistance elements in the DAC is made remarkably smaller in comparison with the case where the same output voltage characteristic is realized by utilizing a DAC other than an R-2R ladder type construction.

The reason is as follows. When an R-2R ladder type DAC for four-bit digital input signal is employed, assuming a reference resistance value is r1, the resistance value of all the resistance elements used (note that this means a resistance value converted into a circuit occupying area of resistance elements, not a composite resistance value) results in 13×r1. Now, assume that a linear output voltage characteristic as in the above construction is realized by utilizing a so-called weighted resistance type DAC. An example of the weighted resistance value type DAC can be realized by the construction as follows. The DAC has two types of power supplies (which correspond to VH and VL in FIG. 2) and a certain number of series circuit connected in parallel. Each of the series circuits has a switching element for alternatively selecting one of the power supplies, and a resistance element with one end connected to the switching element and the other end connected to the output terminal. The number of the series circuit corresponds with the bit number of digital input signal. Each switching state of the switching elements is controlled in response to the digital input signal so as to select one of the power supplies. In this example, a resistance ratio of each resistance element against the reference resistance value (the resistance value of the resistance element responsive to the least significant bit) is set at 1:2n−1 ('n' is the bit number of the digital input signal).

According to this example, in the case of 4-bit digital input signal, if a reference resistance value is r1, the resistance values of the rest of the three resistance elements are 2×r1, 4×r1, and 8×r1 respectively, and the resistance value of all the resistance elements used accordingly results in 15×r1. On the other hand, in the case of the construction according to the sixth aspect of the invention, the resistance value of all the resistance elements used results in 13×r1, as described above. Hence, when it is assumed that each of the resistance elements is formed by a non-single crystalline semiconductor layer having an identical sheet resistance, the total area occupied by the resistance elements in the weighted resistance type DAC requires 15/13 times in comparison with the construction according to the sixth aspect of the invention. As the bit number of the digital input signal increases further, the weighted resistance type DAC correspondingly requires a larger total area occupied by the resistance elements than that of the construction according to the sixth aspect of the invention. It is apparent from the above example that the construction according to the sixth aspect of the invention can achieve remarkable reduction of the total area occupied by the resistance element in the DAC.

In accordance with the seventh aspect of the invention, there is provided a driver circuit as in the fourth aspect of the invention, wherein the DAC is an R-2R ladder type DAC.

According to the above construction, the same effect as in the sixth aspect of the invention can be attained.

In accordance with the eighth aspect of the invention, there is provided a driver circuit as in the fifth aspect of the invention, wherein the DAC is an R-2R ladder type DAC.

According to the above construction, the same effect as in the sixth aspect of the invention can be attained.

In accordance with the ninth aspect of the invention, there is provided a driver circuit as in one of the first to third aspects of the invention, wherein the DAC is a voltage potentiometer type DAC.

According to the above construction employing a voltage potentiometer type DAC, the output voltage results in the voltage weighted corresponding to the ratio of the resistance values of the resistance elements connected in series. Therefore, the output voltage characteristic can be easily made into the one with a desired curve, not just into a linear characteristic, by appropriately setting the resistance values of the resistance elements. Moreover, if the electric current flowing via the switching elements is small, the current dividing or voltage drop caused by the switching elements is avoided and the output voltage is determined only by the voltage dividing by the resistance elements. Therefore, the circuit can be designed without worrying about ON resistance of the switching elements.

In accordance with the 10th aspect of the invention, there is provided a driver circuit as in the fourth aspect of the invention, wherein the DAC is a voltage potentiometer type DAC.

According to the above construction, the same effect as in the ninth aspect of the invention can be attained.

In accordance with the 11th aspect of the invention, there is provided a driver circuit as in the fifth aspect of the invention, wherein the DAC is a voltage potentiometer type DAC.

According to the above construction, the same effect as in the ninth aspect of the invention can be attained.

In accordance with the 12th aspect of the invention, there is provided a driver circuit as in one of the first to third aspects of the invention, wherein the DAC comprises:

a first DAC section which operates in response to one of more significant bit data and lesser significant bit data of digital video input data; and a second DAC section which uses an output voltage as a reference voltage and operates in response to the other one of more significant bit data and lesser significant bit data of digital video input data; and wherein one of the DAC sections is an R-2R ladder type DAC, and the other one of the DAC sections is a voltage potentiometer type DAC.

According to the above construction, both types of the DACs, an R-2R ladder type DAC and a voltage potentiometer type DAC, are employed for the DACs incorporated in the driver circuit, and thereby it is made possible to obtain a driver circuit having both of the advantages intrinsic to each type of the DACs.

In accordance with the 13th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC is composed of a voltage potentiometer type DAC comprising:

a series circuit wherein a plurality of the resistance elements are connected in series, one end of the series circuit is connected to a high voltage power supply terminal, and the other end is connected to a low voltage power supply terminal;

a first switch connected between the one end of the series circuit and the high voltage power supply terminal or between the other end of the series circuit and the low voltage supply terminal, the first switch to be turned to an ON state during the normal operation period and to be turned to an OFF state during the remaining period in response to the first switching signal; and a group of second switches wherein a switching state of each of the second switches is controlled in response to a digital video data, and each of the second switches is connected between a connecting point of each of the resistance elements and an output terminal of the DAC.

According to the above construction, the following effects are attained.

During the normal operation period, the first switch is turned to ON state in response to the first switching signal, and the switching states of the second switch group is controlled in response to the digital video data. The driving voltage corresponding to the digital video data is thereby outputted to the source line.

During the remaining period excluding the normal operation period in one horizontal synchronizing period, the first switch is turned to OFF state in response to the first switching signal. A power supply to the resistance elements is thereby shut off, and an electric current constantly flowing in the resistance element becomes "0". It is thereby made possible to reduce the electric power consumed in the resistance elements during the low power period. In addition, during this low power period, the electrical connection between the driver circuit and the capacitive load is cut off by the means for cutting off the electrical connection. The potential of the capacitive load is thereby retained, and it is made possible to prevent a deterioration of the display characteristics of the liquid crystal resulting from a potential variation of the pixel electrodes. As a result, it is made possible that an entire period excluding a period necessary to change the voltage of the capacitive load is made to be the low power period.

The term "normal operation period" herein is intended to mean, as defined in detail in "the Best Mode for Carrying Out the Invention" hereinafter, (1) a period during which a potential of a source line reaches a desired potential (i.e., a source line writing period) in the case where a gate pulse is provided to a pixel transistor after the potential of the source line completely reaches the desired voltage, or (2) a period during which a potential of a pixel electrode reaches a desired potential (i.e., a pixel electrode writing period) in the case where the time at which a gate pulse is provided to a pixel transistor and the time at which a potential of a source line begins to change by the change of an output voltage from a driver circuit are almost simultaneous. In other words, the term "normal operation period" means a period in which, with a various capacitances connected to a source line taken into consideration, a DAC must continue to output a driving voltage corresponding to a digital data so as to substantially completely change a potential of a pixel electrode. Therefore, in one horizontal synchronizing period, it is not necessary for a DAC to continue a normal operation during a remaining period in which the normal operation period is excluded. Hence, the present invention achieves an effect of reducing power consumption when compared with prior arts in which a DAC continues a normal operation during the remaining period as well as the normal operation period.

The "means for cutting off the electrical connection between the driver circuit and a capacitive load" may be (1) a construction in which an output switch is provided on the output side in a driver circuit, and the switch is turned to ON state during the normal operation period and OFF state during the remaining period, or may be (2) a construction in which a driving power supply for the current amplifier element is turned to ON state during the normal operation period and OFF state during the remaining period. However, this construction (2) is limited for an amplifier element having a construction where an output impedance results in high impedance when the driving power supply is turned OFF. For an amplifier element with a construction where the output impedance does not results in high, an output switch should be provided. Further, it may be (3) a construction in which a group of second switches in the DAC is forcibly turned OFF during the remaining period.

In accordance with the 14th aspect of the invention, there is provided a driver circuit as in the 13th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction, the electrical connection between the driver circuit and the capacitive load connected to the source line is cut off during the remaining period by the output switch provided on the output side in the driver circuit. By contrast, according to a construction of cutting off the power supply of the amplifier, there arises some cases in which the output impedance does not become high when the power supply is cut off, depending on the construction of the amplifier element. In these cases, it is not possible to cut off the electrical connection between the driver circuit and the capacitive load. In addition, in a construction of turning OFF a group of second switches forcibly, the circuit design becomes slightly more complex since it is necessary to previously store a fixed data for cutting off the group of second switches and to provide a switch for selecting a video data during the normal operation period and the fixed data during the low power period. On the other hand, according to the above construction with the output switch, it is easily made possible to cut off the electrical connection with the capacitive load because the above-described difficulties do not occur.

In accordance with the 15th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC is composed of a voltage potentiometer type DAC comprising:

a series circuit wherein the resistance elements are connected in series, one end of the series circuit is commonly connected to a first high voltage power supply terminal and a second high voltage power supply terminal having a lower voltage level than the first high voltage power supply, and the other end is connected to a low voltage power supply terminal;

a third switch connected between one end of the series circuit and the power supply terminals, the third switch for switching an electrical connection of the one end of the series circuit in response to the first switching signal so that the one end of the series circuit is connected to the first high voltage power supply terminal during the normal operation period and is connected to the second high voltage power supply terminal during the remaining period; and a group of second switches wherein a switching state of each of the second switches is controlled in response to a digital video data, and each of the second switches is connected between a connecting point of each of the resistance elements and an output terminal of the DAC.

According to the above construction, the following effects are attained.

During the normal operation period, the third switch is switched to the first high voltage power supply side in response to the first switching signal, and the switching states of the group of second switches are controlled in response to the digital video data. Thereby, a driving voltage corresponding to the digital video data is outputted to the source line.

During the remaining period, the third switch is switched to the second high voltage power supply side in response to the first switching signal. Thereby, the reduction in power consumption can be achieved by reducing the current flowing in the DAC. In addition, in the low power period, the electrical connection between the driver circuit and the capacitive load is cut off by the means for cutting off the electrical connection with the capacitive load. The potential of the capacitive load is thereby retained. Consequently, it is made possible that an entire period excluding a period necessary to change a voltage of the capacitive load is set to be the low power period.

According to this construction, it is possible to fix a potential in the circuit since a certain fixed current flows in the circuit, although the degree of the reduction in power consumption is slightly less than a construction with the means for cutting off the power supply. Therefore, it is made possible to reduce the occurrence of a signal noise resulting from a sudden current increase caused by a normal operation voltage at the transition to the normal operation period.

In accordance with the 16th aspect of the invention, there is provided a driver circuit as in the 15th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 17th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC is composed of an R-2R ladder type DAC comprising:

an R-2R ladder resistance element network composed of two types of the resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a second switching signal generator circuit for generating a second switching signal to control a switching state of each of the fourth switches and outputting the second switching signal to the group of fourth switches, wherein the second switching signal generator circuit receives the first switching signal and the digital video data, and outputs a data corresponding to the digital video input data as the second switching signal during the normal operation period, and outputs a fixed data as the second switching signal during the remaining period, the fixed data causing a current value in the resistance element network to be not more than an median current value between a minimum current value and a maximum current value in the resistance element network.

According to the above construction, the following effects are attained.

During the normal operation period, the second switching signal generator circuit outputs the second switching signal corresponding to the digital video input data. A driving voltage corresponding to the digital video input data is thereby outputted to the source line.

During the remaining period, the second switching signal generator circuit makes the input data into an fixed input data which results in a current value flowing in the resistance network being not more than the median current value between the minimum current value and the maximum current value, and outputs the fixed data as a second switching signal to the group of fourth switches. Thereby, the power consumption in the DAC is made less than the average power consumption in prior arts, in which a DAC continues the normal operation throughout one horizontal synchronizing period. As a result, this construction too achieves the reduction in power consumption of the DAC.

According to this construction, it is possible to fix a potential in the circuit since a certain fixed current flows in the circuit, although the degree of the reduction in power consumption is slightly less than a construction with the means for cutting off the power supply. Therefore, it is made possible to reduce the occurrence of a signal noise resulting from a sudden current increase caused by a normal operation voltage at the transition to the normal operation period.

In accordance with the 18th aspect of the invention, there is provided a driver circuit as in the 17th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 19th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC is composed of an R-2R ladder type DAC comprising:

an R-2R ladder resistance element network composed of two types of the resistance elements, each type having a different resistance value;

a group of fifth switches for determining an output voltage; and a third switching signal generator circuit for generating a third switching signal to control a switching state of each of the fifth switches and outputting the third switching signal to the group of fifth switches, the third switching signal generator circuit comprising a storage circuit for storing a fixed data causing the group of fifth switches to be OFF state, wherein the third switching signal generator circuit receives the first switching signal and digital video data, and outputs during the normal operation period a data corresponding to the digital video data as the third switching signal, and outputs during the remaining period the fixed data stored in the storage circuit as the third switching signal so as to cut off the power supply to the resistance element network.

According to the above construction, the following effects are attained.

During the normal operation period, the third switching signal generator circuit outputs the third switching signal corresponding to the digital video input data. A driving voltage corresponding to the digital video input data is thereby outputted to the source line.

During the remaining period, the third switching signal generator circuit outputs the fixed data stored in the storage circuit as a third switching signal. All of the fifth switches are thereby turned to OFF state. Consequently, the current flowing in the circuit results in "0", and the reduction in power consumption is thus attained.

In accordance with the 20th aspect of the invention, there is provided a driver circuit as in the 19th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 21st aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section, which comprises a first connecting terminal receiving a higher voltage output from the first DAC section and a second connecting terminal receiving a lower voltage output from the first DAC section, which employs as a reference voltage a voltage between the first connecting terminal and the second connecting terminal, and which operates in response to lesser significant bits of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is connected to a high voltage power supply terminal, and the other end is connected to a low voltage power supply terminal;

a sixth switch connected between one end of the series circuit and the high voltage power supply terminal or between the other end of the series circuit and the low voltage power supply circuit, the sixth switch to be turned to an ON state during the normal operation period and to be turned to an OFF state during the remaining period in response to the first switching signal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value; and a group of ninth switches for alternatively selecting between a connecting state with the first connecting terminal and a connecting state with the second connecting terminal in response to the lesser significant bits of the digital video input data;

the driver circuit, wherein:

during the normal operation period, the sixth switch is turned to the ON state, a switching state of each of the seventh switches and a switching state of each of the eighth switches are controlled corresponding to the more significant bits of the digital video input data, and a switching state of each of the ninth switches is controlled corresponding to the lesser significant bits of the digital video input data; and during the remaining period, the sixth switch is turned to the OFF state and the electrical connection with the capacitive load is cut off by the means for cutting off the electrical connection.

According to the above construction, the following effects are attained.

During the normal operation period, the sixth switch is turned to ON state, the switching states of the seventh switches and eighth switches are controlled in response to the more significant bits of the digital video data, and the switching state of the ninth switch is controlled in response to the lesser significant bits of the digital video data. A driving voltage corresponding to the digital video input data is thereby outputted to the source line.

During the remaining period, the sixth switch is turned to OFF state, and in addition, the electrical connection between the driver circuit and the capacitive load is cut off by the aforementioned means for cutting off the electrical connection. The current flowing in the circuit thereby becomes "0", and the reduction in power consumption is thus attained. In other words, the reduction in power consumption is achieved by cutting off the power supply of the first DAC section, the first DAC section being a voltage potentiometer type and allotted for the more significant bits.

In accordance with the 22nd aspect of the invention, there is provided a driver circuit as in the 21st aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 22nd aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section, which comprises a first connecting terminal receiving a higher voltage output from the first DAC section and a second connecting terminal receiving a lower voltage output from the first DAC section, which employs as a reference voltage a voltage between the first connecting terminal and the second connecting terminal, and which operates in response to lesser significant bits of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is commonly connected to a first high voltage power supply terminal and a second high voltage power supply terminal having a lower voltage level than the first high voltage power supply terminal via a tenth switch for selecting a power supply, the tenth switch controlled by the first switching signal, and the other end of the series circuit is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value; and a group of ninth switches for alternatively selecting between a connecting state with the first connecting terminal and a connecting state with the second connecting terminal in response to the lesser significant bits of the digital video input data;

the driver circuit wherein:

during the normal operation period, the tenth switch is switched to the first high voltage power supply terminal, a switching state of the seventh switches and a switching state of the eighth switches are controlled corresponding to the more significant bits of the digital video input data, and a switching state of the ninth switches is controlled corresponding to the lesser significant bits of the digital video input data; and during the remaining period, the tenth switch is switched to the second high voltage power supply terminal and the electrical connection with a capacitive load is cut off by the means for cutting off the electrical connection.

According to the above construction, the following effects are attained.

During the normal operation period, the tenth switch for selecting the power supply is switched to the first high voltage power supply terminal side, the switching states of the seventh switches and eighth switches are controlled in response to the more significant bits of the digital video data, and the switching state of the ninth switch is controlled in response to the lesser significant bits of the digital video data. A driving voltage corresponding to the digital video data is thereby outputted to the source line.

During the remaining period, the tenth switch for selecting the power supply is switched to the second high voltage power supply terminal side, and the electrical connection with the capacitive load is cut off by the aforementioned means for cutting off the electrical connection. The current flowing in the circuit is thereby reduced, and the reduction in power consumption is thus attained. In other words, the reduction in power consumption is achieved by selecting a power supply voltage of the first DAC section, the first DAC section being a voltage potentiometer type and allotted for the more significant bits.

In accordance with the 24th aspect of the invention, there is provided a driver circuit as in the 23rd aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 25th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section, which comprises a first connecting terminal receiving a higher voltage output from the first DAC section and a second connecting terminal receiving a lower voltage output from the first DAC section, which employs as a reference voltage a voltage between the first connecting terminal and the second connecting terminal, and which operates in response to lesser significant bits of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is connected to a high voltage power supply terminal, and the other end is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value;

a group of ninth switches provided for each of the lesser significant bits of the digital input data for alternatively selecting between a connecting state with the first connecting terminal and a connecting state with the second connecting terminal; and a fourth switching signal generator circuit for generating a fourth switching signal to control a switching state of each of the ninth switches and outputting the fourth switching signal to the group of ninth switches, wherein the fourth switching signal generator circuit receives the lesser significant bits of the digital video input data and the first switching signal, and outputs during the normal operation period the fourth switching signal corresponding to the lesser significant bits of the digital video data, and outputs during the remaining period a fixed data as the fourth switching signal, the fixed data causing a current value in the resistance element network to be not more than the median current value between a minimum current value and a maximum current value in the resistance element network.

According to the above construction, the following effects are attained.

During the normal operation period, the switching state of the seventh and eighth switches are controlled in response to the more significant bits, and the ninth switches are switched to either a high voltage power supply or a low voltage power supply so as to obtain a driving voltage corresponding to the video data. The driving voltage corresponding to the digital video input data is thereby outputted to the source line.

During the remaining period, the fourth switching signal generator circuit makes the input data into an fixed input data which results in a current value in the resistance network being not more than the median current value between the minimum current value and the maximum current value, and outputs the fixed data as the fourth switching signal to the group of ninth switches. The power consumption in the second DAC section is thereby reduced, and the reduction in power consumption is thus attained. In other words, the reduction in power consumption is achieved by selecting an input data to the second DAC section, the second DAC section being an R-2R ladder type and allotted for the lesser significant bits.

In accordance with the 26th aspect of the invention, there is provided a driver circuit as in the 25th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 27th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section comprising a first connecting terminal receiving a higher voltage output from the first DAC section, an eleventh switch connected between the first connecting terminal and a power supply input line connected to the first connecting terminal, a second connecting terminal receiving a lower voltage output from the first DAC section, and a twelfth switch connected between the second connecting terminal and a power supply input line connected to the second connecting terminal, the second DAC section employing as a reference voltage a voltage between the first connecting terminal and the second connecting terminal, and the second digital-to-analog converter operating in response to lesser significant bit of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is connected to a high voltage power supply terminal, and the other end is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section further comprising:

an R-2R ladder resistance element network composed of two types of the resistance elements, each type having a different resistance value; and a group of ninth switches provided for each of the lesser significant bits of the digital input data for alternatively selecting between a connecting state with the first connecting terminal and a connecting state with the second connecting terminal;

the driver circuit wherein:

during the normal operation period, the eleventh switch and the twelfth switch are turned to an ON state and a switching state of each of the seventh switches and a switching state of each of the eighth switches are controlled corresponding to the more significant bits of the digital video input data, and a switching state of each of the ninth switches is controlled corresponding to the lesser significant bits of the digital video input data; and during the remaining period, the eleventh switch and the twelfth switch are turned to the OFF state and the electrical connection with the capacitive load is cut off by the means for cutting off the electrical connection.

According to the above construction, the following effects are attained.

During the normal operation period, the eleventh switch and twelfth switch is turned to ON state, the switching state of the seventh and eighth switches are controlled in response to the more significant bits of the digital video data, and the switching states of the ninth switches are controlled in response to the lesser significant bits of the digital video data. A driving voltage corresponding to the digital video input data is thereby outputted to the source line.

During the remaining period, the eleventh switch and twelfth switch is turned to OFF state. The current flowing in the second DAC section becomes "0", and the reduction in power consumption is thus attained. In other words, the reduction in power consumption is achieved by cutting off the power supply of the second DAC section, the second DAC section being an R-2R ladder type and allotted for the lesser significant bits.

In accordance with the 28th aspect of the invention, there is provided a driver circuit as in the 27th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 29th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section, which comprises a first connecting terminal receiving a higher voltage output from the first DAC section and a second connecting terminal receiving a lower voltage output from the first DAC section, which employs as a reference voltage a voltage between the first connecting terminal and the second connecting terminal, and which operates in response to lesser significant bits of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is commonly connected to a first high voltage power supply terminal and a second high voltage power supply terminal having a lower voltage level than the first high voltage power supply terminal via a tenth switch for selecting a power supply, and the other end of the series circuit is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value;

a group of ninth switches provided for each of the lesser significant bits of the digital input data for alternatively selecting between a connecting state with the first connecting terminal and a connecting state with the second connecting terminal; and a fourth switching signal generator circuit for generating a fourth switching signal to control a switching state of each of the ninth switches and outputting the fourth switching signal to the group of ninth switches, wherein the fourth switching signal generator circuit receives the lesser significant bits of the digital video input data and the first switching signal, and outputs during the normal operation period the fourth switching signal corresponding to the lesser significant bits of the digital video data, and outputs during the remaining period a fixed data as the fourth switching signal, the fixed data causing a current value in the resistance element network to be not more than the median current value between a minimum current value and a maximum current value in the resistance element network;

the driver circuit wherein:

during the normal operation period, the tenth switch is switched to the first high voltage power supply terminal, a switching state of the seventh switches and a switching state of the eighth switches are controlled corresponding to the more significant bits of the digital video input data, and a switching state of the ninth switches is controlled corresponding to the lesser significant bits of the digital video input data; and during the remaining period, the tenth switch is switched to the second high voltage power supply terminal, the ninth switches are switched corresponding to the fixed input data, and the electrical connection with the capacitive load is cut off by the means for cutting off the electrical connection.

According to the above construction, the following effects are attained.

During the normal operation period, the tenth switch for selecting the power supply is switched to the first high voltage power supply terminal side, the switching states of the seventh switches and eighth switches are controlled in response to the more significant bits of the digital video data, and the ninth switches are switched to either a high voltage side or a low voltage side so as to obtain a driving voltage corresponding to the lesser significant bits of the video data. The driving voltage corresponding to the digital video data is thereby outputted to the source line.

During the remaining period, the tenth switch for selecting the power supply is switched to the second high voltage power supply terminal side, the ninth switches are switched in response to the aforementioned fixed input data, and the electrical connection with the capacitive load is cut off by the aforementioned means for cutting off the electrical connection. The second high voltage power supply is selected in the first DAC section, and the current flowing in the circuit is thereby reduced, and the supplied power for the second DAC section is accordingly reduced. In addition, in the second DAC section, the power consumption is further reduced with the use of the fixed data. In other words, the reduction in power consumption is achieved by selecting the power supply voltages of the first DAC section, the first DAC section being a voltage potentiometer type and allotted for the more significant bits, as well as by selecting the input data to the second DAC section, the second DAC section being an R-2R ladder type and allotted for the lesser significant bits.

In accordance with the 30th aspect of the invention, there is provided a driver circuit as in the 29th aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 30th aspect of the invention, there is provided a driver circuit as in one of the first to third aspects of the invention, further comprising:

a first switching signal generator circuit which receives a predetermined reference signal and generates a first switching signal for alternatively selecting between a normal operation period and a remaining period; and means for cutting off an electrical connection between the driver circuit and a capacitive load connected to a source line only during the remaining period in response to the first switching signal;

wherein the DAC comprises:

a first DAC section which operates in response to more significant bits of digital video input data; and a second DAC section comprising a first connecting terminal receiving a higher voltage output from the first DAC section, an eleventh switch connected between the first connecting terminal and a power supply input line connected to the first connecting terminal, a second connecting terminal receiving a lower voltage output from the first DAC section, and a twelfth switch connected between the second connecting terminal and a power supply input line connected to the second connecting terminal, the second DAC section employing as a reference voltage a voltage between the first connecting terminal and the second connecting terminal, and the second digital-to-analog converter operating in response to lesser significant bit of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is commonly connected to a first high voltage power supply terminal and a second high voltage power supply terminal having a lower voltage level than the first high voltage power supply terminal via a tenth switch for selecting a power supply, and the other end of the series circuit is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value; and a group of ninth switches provided for each of the lesser significant bits of the digital input data for alternatively selecting between a connecting state with the first connecting terminal and a connecting state with the second connecting terminal;

the driver circuit wherein:

during the normal operation period, the tenth switch is switched to the first high voltage power supply terminal, a switching state of the seventh switches and a switching state of the eighth switches are controlled corresponding to the more significant bits of the digital video input data and a switching state of the ninth switches is controlled corresponding to the lesser significant bits of the digital video input data; and during the remaining period, the tenth switch is switched to the second high voltage power supply terminal, the eleventh switch and the twelfth switch are turned to the OFF state and the electrical connection with the capacitive load is cut off by the means for cutting off the electrical connection.

According to the above construction, the following effects are attained.

During the normal operation period, the tenth switch for selecting the power supply is switched to the first high voltage power supply terminal side, the switching states of the seventh switches and eighth switches are controlled in response to the more significant bits of the digital video data, the ninth switches are switched to either a high voltage side or a low voltage side so as to obtain a driving voltage corresponding to the lesser significant bits of the video data, and the eleventh switch and twelfth switch are turned to ON state. A driving voltage corresponding to the digital video data is thereby outputted to the source line.

During the remaining period, the tenth switch for selecting the power supply is switched to the second high voltage power supply terminal side, the eleventh switch and twelfth switch are turned to OFF state, and the electrical connection with the capacitive load connected to the source line is cut off by the aforementioned means for cutting off the electrical connection. The second high voltage power supply is selected for the first DAC section, and the current flowing in the circuit is thereby reduced. In the second DAC section, the current flowing in the circuit becomes "0" by the cutting off the power supply. In other words, the reduction in power consumption is achieved by selecting the power supply voltages of the first DAC section, the first DAC section being a voltage potentiometer type and allotted for the more significant bits, as well as by cutting off the power supply to the second DAC section, the second DAC section being an R-2R ladder type and allotted for the lesser significant bits.

In accordance with the 32nd aspect of the invention, there is provided a driver circuit as in the 31st aspect of the invention, wherein the means for cutting off the electrical connection between the driver circuit and the capacitive load connected to the source line is such an output switch provided on an output side of the driver circuit that, in response to the first switching signal, the output switch is turned to an ON state during the normal operation period, and is turned to an OFF state during the remaining period so as to cut off the electrical connection.

According to the above construction employing the output switch, it is made possible to completely cut off the electrical connection with the capacitive load by a simple circuit construction.

In accordance with the 33rd aspect of the invention, there is provided a driver circuit as in one of the first to third aspects of the invention, further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding the precharge period mode;

wherein the DAC is composed of an R-2R ladder type DAC comprising:

an R-2R ladder resistance element network composed of two types of the resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a sixth switching signal generator circuit for generating a sixth switching signal to control a switching state of each of the fourth switches and outputting the sixth switching signal to the group of fourth switches, wherein the sixth switching signal generator circuit receives the fifth switching signal and digital video data, and outputs a data corresponding to the digital video data as the sixth switching signal during the remaining period, and outputs a fixed data as the sixth switching signal during the precharge period, the fixed data causing a current value in the resistance element network to be not more than an median current value between a minimum current value and a maximum current value in the resistance element network.

According to the above construction, during the precharge period, a combination of the switching states of the fourth switches is made, by the sixth switching signal generator circuit, to be such a combination as results in a current value in the resistance network being not more than the median current value between the minimum current value and the maximum current value in the resistance network. Therefore, it is made possible to reduce the power consumption in the precharge period.

In accordance with the 34th aspect of the invention, there is provided a driver circuit as in one of the first to third aspects of the invention, further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding the precharge period mode;

wherein the DAC comprises:

a first DAC section which operates in response to more significant bits of digital video input data; and a second DAC section, which comprises a first connecting terminal receiving a higher voltage output from the first DAC section and a second connecting terminal receiving a lower voltage output from the first DAC section, which employs as a reference voltage a voltage between the first connecting terminal and the second connecting terminal, and which operates in response to lesser significant bits of the digital video input data;

the first DAC section being composed of a voltage potentiometer type DAC and the second DAC section being composed of an R-2R ladder type DAC;

the first DAC section comprising:

a series circuit wherein a plurality of the resistance elements are connected in series, one end of the series circuit is commonly connected to a first high voltage power supply terminal and a second high voltage power supply terminal having a lower voltage level than the first high voltage power supply terminal via a tenth switch for selecting a power supply, and the other end of the series circuit is connected to a low voltage power supply terminal;

a group of seventh switches each connected between a connecting point of each of the resistance elements in the series circuit and the first connecting terminal, the seventh switches controlled by the more significant bits of the digital video input data; and a group of eighth switches each connected between a connecting point of each of the resistance elements in the series circuit and the second connecting terminal, the eighth switches controlled by the more significant bits of the digital video input data;

the second DAC section comprising:

an R-2R ladder resistance element network composed of two types of the resistance elements, each type having a different resistance value;

a group of ninth switches provided for each of the lesser significant bits of the digital input data for alternatively selecting between a connecting state with the first connecting terminal and a connecting state with the second connecting terminal; and a fourth switching signal generator circuit for generating a seventh switching signal to control a switching state of each of the ninth switches and outputting the seventh switching signal to the group of ninth switches, wherein the seventh switching signal generator circuit receives the fifth switching signal and the lesser significant bits of the digital video data, and outputs a data corresponding to the lesser significant bits of the digital video input data as the seventh switching signal during the remaining period, and outputs a fixed data as the seventh switching signal during the precharge period, the fixed data causing a current value in the resistance element network to be not more than an median current value between a minimum current value and a maximum current value in the resistance element network;

the driver circuit wherein:

during the remaining period, the tenth switch is switched to the first high voltage power supply terminal, a switching state of the seventh switches and a switching state of the eighth switches are controlled corresponding to the more significant bits of the digital video input data, and a switching state of the ninth switches is controlled corresponding to the lesser significant bits of the digital video input data; and during the precharge period, the tenth switch is switched to the second high voltage power supply terminal, the ninth switches are switched corresponding to the fixed input data, and the electrical connection with the capacitive load is cut off by the means for cutting off the electrical connection.

According to the above construction, during the remaining period excluding the precharge period, the tenth switch for selecting the power supply is switched to the first high voltage power supply terminal side, the switching states of the seventh switches and eighth switches are controlled corresponding to the more significant bits of the digital video data, and the ninth switches are switched to either a high power supply or low power supply so as to obtain a driving voltage corresponding to the lesser significant bits of the video data.

During the precharge period, the tenth switch for selecting the power supply is switched to the second high voltage power supply terminal side, and the ninth switches are switched in response to the aforementioned fixed data. It is thereby made possible to reduce the power consumption in the precharge period.

In accordance with the 35th aspect of the invention, there is provided a driver circuit as in the 13th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the first switching signal is generated by which an output signal from the delay circuit for delaying the horizontal synchronizing signal for a predetermined time determined by a resistance value of the resistance element which composes the integrator circuit and a horizontal synchronizing signal are ANDed together, and therefore it is made possible to determine the length of a high level period of the first switching signal by the resistance value. Consequently, it is made possible to absorb the difference in the steady-state currents flowing in the resistance elements in the DAC, which is caused by a variation of the resistance values of the resistance elements in each substrate.

The description below further details the above effect. In the case of a resistance element on an array substrate having a high resistance value, it is preferable that the low power period be short, since the current flowing in the DAC is relatively small and therefore it takes relatively a long time to charge a capacitive load connected to a source line SL. In this case, even if the low power period is made short (i.e., the normal operation period is made long), no adverse effect occurs in view of the reduction in power consumption because the power consumption during the normal operation period is decreased by the resistance elements having a high resistance value. On the other hand, in the case of a resistance element having a low resistance value, it is preferable that the low power period be long, since the current flowing in the DAC is relatively large and therefore the time required for charging the source line becomes relatively short. When there arises a need to change the lengths of the normal operation period and the low power period according to the resistance values of the resistance elements on each of the array substrates in order to meet the two requirements, one being the charging of the source line and the other being the reduction in power consumption, this construction enables the length of the high level period of the first switching signal to be automatically adjusted to the most suitable length by the first switching signal generator circuit so that it can meet the two requirements. It is therefore made possible to automatically carry out an adjustment for optimizing the power consumption regardless of the precision of the resistance elements, by constructing the integrator circuit with the resistance element formed on the same array substrate as the one on which the resistance elements of the DAC are formed. As a result, it is made possible to automatically carry out the adjustment for optimizing the power consumption for all the substrates regardless of the variation of the resistance elements.

In accordance with the 36th aspect of the invention, there is provided a driver circuit as in the 15th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 37th aspect of the invention, there is provided a driver circuit as in the 17th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 38th aspect of the invention, there is provided a driver circuit as in the 19th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 39th aspect of the invention, there is provided a driver circuit as in the 21st aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 40th aspect of the invention, there is provided a driver circuit as in the 23rd aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 41st aspect of the invention, there is provided a driver circuit as in the 25th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 42nd aspect of the invention, there is provided a driver circuit as in the 27th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 43rd aspect of the invention, there is provided a driver circuit as in the 29th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 44th aspect of the invention, there is provided a driver circuit as in the 31st aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitor element, the delay circuit for delaying the horizontal synchronizing signal for a predetermined delay time determined by a resistance value of the resistance element in the integrator circuit; and a logic circuit wherein an output from the delay circuit and the horizontal synchronizing signal are ANDed together to output a resultant signal as the first switching signal.

According to the above construction, the same effect as in the 35th aspect of the invention can be attained.

In accordance with the 45th aspect of the invention, there is provided a driver circuit as in the 13th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the optimization of the normal operation period can be realized with taking into consideration not only a variation of the resistance element but also a variation of the capacitive load by employing the capacitive load connected to the source line as the capacitance element in the integrator circuit.

In accordance with the 46th aspect of the invention, there is provided a driver circuit as in the 15th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 47th aspect of the invention, there is provided a driver circuit as in the 17th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 48th aspect of the invention, there is provided a driver circuit as in the 19th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 49th aspect of the invention, there is provided a driver circuit as in the 21st aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 50th aspect of the invention, there is provided a driver circuit as in the 23rd aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 51st aspect of the invention, there is provided a driver circuit as in the 25th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 52nd aspect of the invention, there is provided a driver circuit as in the 27th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 53rd aspect of the invention, there is provided a driver circuit as in the 29th aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

In accordance with the 54th aspect of the invention, there is provided a driver circuit as in the 31st aspect of the invention, wherein the first switching signal generator circuit receives a horizontal synchronizing signal, generates a first switching signal from the horizontal synchronizing signal, and outputs the first switching signal to the DAC:

the first switching signal generator circuit comprising:

a delay circuit comprising an integrator circuit composed of a resistance element and a capacitance element composed of a capacitive load connected to a source line, the delay circuit for delaying the horizontal synchronizing signal for a predetermined delay time determined by a resistance value of the resistance element in the integrator circuit and a capacitance value of the capacitance element in the integrator circuit; and a logic circuit wherein an output from the delay circuit and the horizontal synchronizing signal are ANDed together to output a resultant signal as the first switching signal.

According to the above construction, the same effect as in the 45th aspect of the invention can be attained.

THE BEST MODE FOR CARRYING OUT THE INVENTION

Embodiment 1

(Embodiment 1-1)

Figure 1:
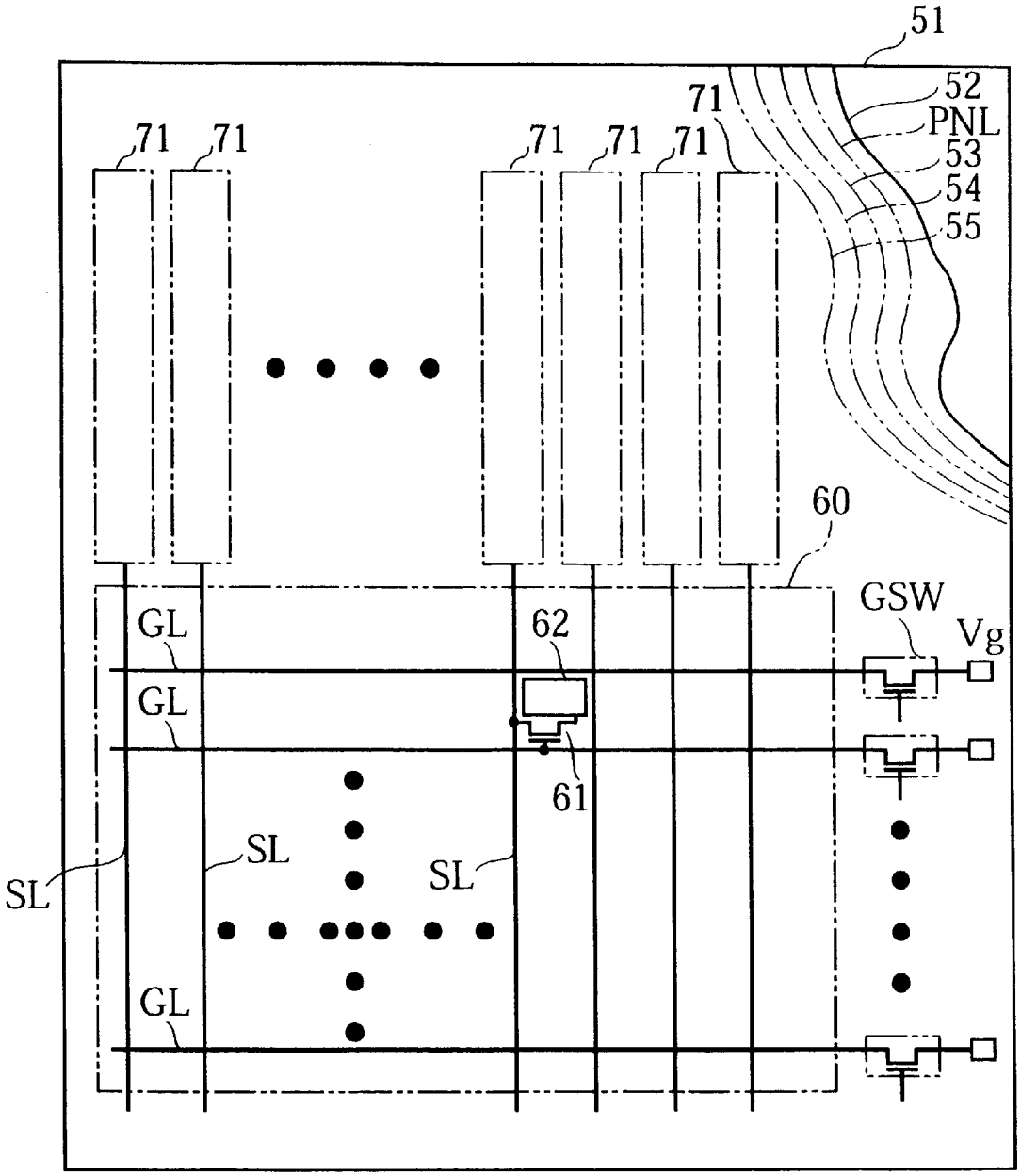
FIG. 1 is a schematic diagram showing the construction of a liquid crystal display in accordance with Embodiment 1-1 of the present invention.
Figure 2:
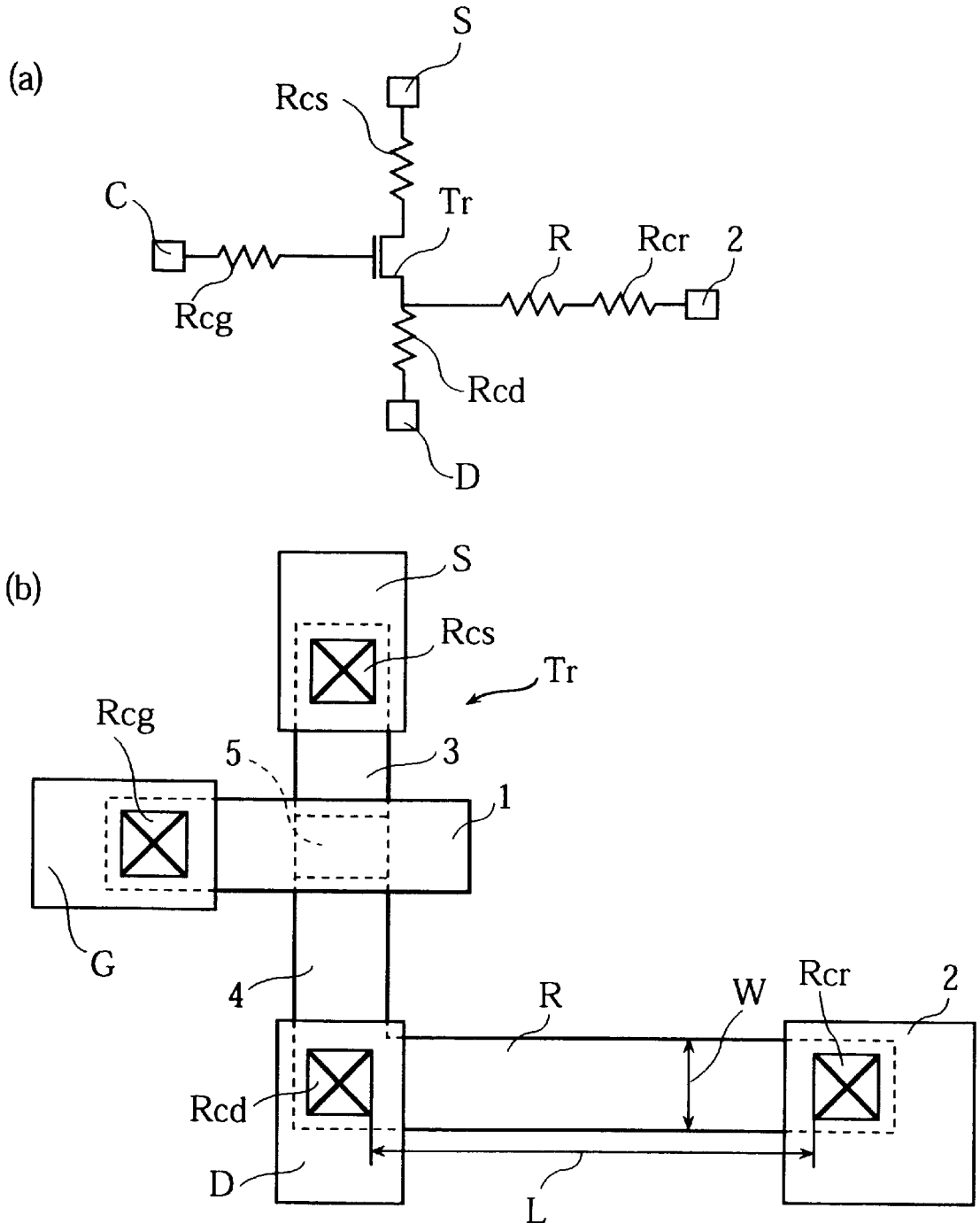
FIGS. 2(*a*)–(*b*) are diagrams showing a partial construction of the LCD driver circuit in accordance with Embodiment 1-1 of the present invention.
Figure 3:
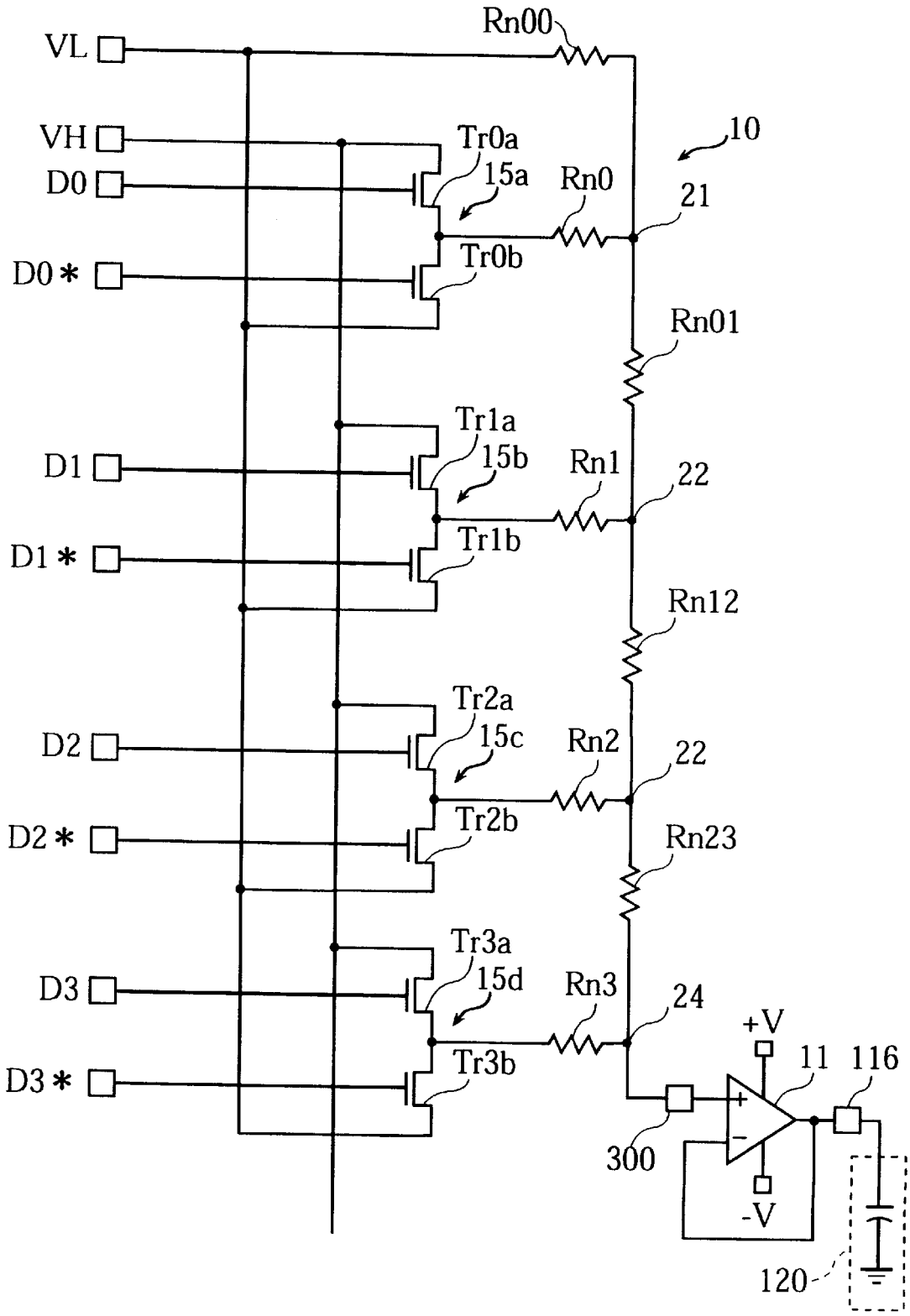
FIG. 3 is a diagram showing the construction of the LCD driver circuit in accordance with Embodiment 1-1 of the present invention.

With reference to FIGS. 1 to 3, there is described a driver circuit for an active matrix liquid crystal display (AMLCD) of Embodiment 1-1 hereinafter.

The AMLCD is constructed as shown in FIG. 1, by stacking up a polarizing filter layer 51, a glass substrate 52, a liquid crystal panel PNL, a counter glass substrate 54 where a counter transparent electrode 53 is formed thereon, a polarizing filter layer 55, and so forth.

In a display region 60 on the glass substrate 52, there are formed source lines SL disposed parallel to each other whose number corresponds with the number of the pixels on a horizontal line, and gate lines GL disposed in the direction perpendicular to the source lines SL, whose number corresponds with the number of the pixels on a vertical line, with an insulation layer (not shown) disposed between the source lines SL and gate lines GL. In each intersectional position of source lines SL and gate lines GL, there are formed a pixel switching transistor 61 and a pixel electrode 62.

On the glass substrate 52, there are also formed driver circuits 71 for applying driving voltages to the source lines SL, including digital-to-analog converter circuits (DACs) therein, and vertical scanning switches GSW for selectively applying voltages Vg to the gate lines GL. It is noted that the driver circuits 71 may be provided corresponding to each set of a certain predetermined number of source lines selectively connected by switches, but for clarity of illustration, the description hereinafter assumes that a driver circuit 71 is provided corresponding to each source line SL, and the following description will be concerned with one driver circuit 71 corresponding to one source line SL.

Resistance elements comprised in the DACs in the aforementioned driver circuit 71, as well as the pixel switching transistors 61, are formed by polycrystalline silicon (p-Si) formed on the glass substrate 52, as shown in FIG. 2.

FIG. 2(*a*) shows a circuit diagram of the switching elements and resistance elements composing the DAC in the driver circuit 71, and FIG. 2(*b*) shows a wiring pattern of the switching elements and resistance elements shown in FIG. 2(*a*). It is to be noted that only one of the resistance elements composing the DAC and one switching element connected to this resistance element are shown in FIG. 2(*a*) so that the characteristics of an LCD driver circuit of the present invention will be more clearly understood.

A resistance element R shown in FIG. 2(*b*) is formed in an n+ layer of p-Si on an array substrate of the LCD. A switching element Tr connected to the resistance element R is an n-channel transistor. In FIG. 2(*b*), there are also shown a source terminal S of the switching element Tr, a drain terminal D of the switching element Tr, a gate terminal G of the switching element Tr, a gate electrode 1 composed of aluminum and the like, and an output terminal 2. There are also shown a source region 3 and a drain region 4 both formed in n+ layer of p-Si, and a channel region 5 disposed between the source region 3 and the drain region 4.

The source terminal S is connected to the source region 3 via a contact region Rcs disposed therebetween. The gate terminal G is connected to the gate electrode 1 via a contact region Rcg disposed therebetween. The drain terminal D is commonly connected to the drain region 4 and the resistance element R via a contact region Rcd disposed therebetween. The output terminal 2 is connected to the resistance element R via a contact region Rcr disposed therebetween. Each of these contact regions Rcs, Rcg, Rcd, and Rcr functions as a resistance element inversely proportional to each of the areas thereof. Consequently, an equivalent circuit to the wiring pattern shown in FIG. 2(*b*) will be the circuit diagram as shown in FIG. 2(*a*).

The shape of n+ layer of p-Si that functions as a resistance element R is determined according to the following grounds. The resistance value r of the resistance element R is proportional to the length L of the n+ layer of p-Si, and inversely proportional to the width W. Accordingly, the resistance value r is: $r=\rho\times L/W$ where p is a sheet resistance of n+ layer of p-Si. For example, assuming that a resistance element R with r=10 kΩ is to be formed, the required element is realized by setting L/W=5 when a sheet resistance ρ=2 kΩ/□, for example by setting L=100 μm and W=20 μm. Thus, a desired resistance value is obtained by arbitrarily selecting combinations of the length L and width W of an n+ layer. Hence, it is made possible to form on an array substrate a circuit wherein a resistance element R formed on an n+ layer of p-Si is connected to a switching element Tr.

A digital-to-analog converter circuit (DAC) in the present invention is constructed by using a plurality of the aforementioned resistors R and switching elements Tr and connecting them in a predetermined wiring pattern. By incorporating DACs in an array substrate as described above, it is made possible to eliminate drier ICs from the components of an LCD, and thereby to reduce the manufacturing cost. It is also thereby made possible to eliminate the step of mounting the driver ICs on the array substrate and to reduce the thickness of an LCD.

FIG. 3 shows a specific circuit construction of a driver circuit for an LCD. A DAC 10 comprised in this driver circuit is composed of an R-2R ladder type DAC. The DAC 10 comprises resistance elements Rn0, Rn1, Rn2, Rn3, Rn00, Rn01, Rn12, and Rn23, and switching circuits 15*a* to 15*d* provided corresponding to each bit of digital input data so as to selectively switch a high voltage power supply VH and a low voltage power supply VL. Each of the resistance elements Rn0, Rn1, Rn2, Rn3, Rn00, Rn01, Rn12, and Rn23 is formed in the n+ layer of p-Si. All the resistance elements Rn0, Rn1, Rn2, and Rn3 have the same resistance value, and likewise, Rn00, Rn01, Rn12, and Rn23 have the same resistance value; on the other hand, the resistance value of the resistance elements Rn00, Rn0, Rn1, Rn2, and Rn3 are twice as large as the resistance value of the resistance elements Rn01, Rn12, and Rn23. That is, when the resistance value of the resistance elements Rn01, Rn12, Rn23 is represented by r1, the resistance value of the resistance elements Rn00, Rn0, Rn1, Rn2, Rn3 is represented by 2×r1.

The switching circuit 15*a* connected to the resistance element Rn0 is composed of a switching element Tr0*a* and Tr0*b*, the switching circuit 15*b* connected to the resistance element Rn1 is composed of a switching element Tr1*a* and Tr1*b*, the switching circuit 15*c* connected to the resistance element Rn2 is composed of a switching element Tr2*a* and Tr2*b*, and the switching circuit 15*d* connected to the resistance element Rn3 is composed of a switching element Tr3*a* and Tr3*b*. These eight switching elements Tr0*a* through Tr3*b* are an n-channel transistor formed on the array substrate.

Each of the digital input data bits D0, D0*; D1, D1*; D2, D2*; and D3, D3* is fed to each gate of the aforementioned switching elements Tr0*a*, Tr0*b*; Tr1*a*, Tr1*b*; Tr2*a*, Tr2*b*; and Tr3*a*, Tr3*b* respectively. The bits D0 to D3 represent each bit of 4 bit digital input data signals, and the bits D0* to D3* respectively represent the inverted ones of each bit D0 to D3. The bits D0 and D0* function as a switching signal for the switching elements Tr0*a* and Tr0*b* respectively, the bits D1 and D1* function as a switching signal for the switching elements Tr1*a* and Tr1*b* respectively, the bits D2 and D2* function as a switching signal for the switching elements Tr2*a* and Tr2*b* respectively, and the bits D3 and D3* function as a switching signal for the switching elements Tr3*a* and Tr3*b* respectively. For example, the switching element Tr0*a* is turned ON when the bit D0 is a logic "1", and turned OFF when the bit D0 is a logic "0".

Although this embodiment shows an example in the case of the 4-bit digital input signals, the present invention can be practiced for other multiple-bit digital input signals by employing a plurality of the above structures.

A signal amplifier element 11 is composed of an n-channel transistor formed on the array substrate. The signal amplifier element 11 may be composed of a p-channel transistor, or a combination of an n-channel transistor and a p-channel transistor. The signal amplifier element 11 is, specifically, achieved by an operational amplifier (op-amp) which functions as a voltage follower. The signal amplifier element 11 may be composed of a source follower type n-channel transistor or a source follower type p-channel transistor in place of the op-amp which functions as a voltage follower. An analog output voltage from the DAC 10 drives a source line SL for liquid crystal elements with its output current being amplified by the signal amplifier element 11, while the output voltage amplification ratio is held at 1. In addition, this signal amplifier element 11 has an impedance conversion function, so that it is capable of driving a source line SL having a large capacitive load quickly with the output capability of the DAC being kept small. Moreover, by forming the signal amplifier element 11 on the array substrate, it is made possible to eliminate the signal amplifier elements from the component items of an LCD, and thereby to reduce the manufacturing cost when compared with the case where the signal amplifier elements as individual components are mounted onto the array substrate. It is also thereby made possible to eliminate the step of mounting the signal amplifier elements on the array substrate.

The total area of the resistance elements used in the DAC 10 is as follows. Assuming that the resistance value r1 of the reference resistance element Rn01 is 10 kΩ, that the sheet resistance ρ of n+ layer of p-Si is 2 kΩ/□, and that the width of n+ layer of p-Si is 20 μm, a length L1 of each n+ layer of p-Si which functions as the resistance elements Rn01, Rn12, and Rn23 results in L1=100 μm, and a length L2 of each n+layer of p-Si which functions as the resistance elements Rn00, Rn0, Rn1, Rn2, and Rn3 results in L2=200 μm. Accordingly, the total area of the resistance elements used in the DAC 10 results in 0.026 $mm^2$, excluding the pattern clearance areas (the gap areas between each n+ layer a resistance element).

As described above, by employing an R-2R ladder type DAC for the DAC in the present invention, it is made possible to construct a DAC with two types of resistance elements, one with the resistance value r1 and the other with the resistance value 2×r1. Thereby, when compared with the case where a DAC having a construction other than the R-2R ladder type is employed to obtain similar output voltage characteristics, the total area required for resistance elements in a DAC can be substantially reduced, and moreover, the scale of a circuit required for decoding digital data can be reduced.

Now, there is described a summary of the operation of the DAC having the above-described construction. Assuming that the digital input data bits D0, D1, and D2 are a logic "1", and that the digital input data bit D3 is logic "0", the bits D0*, D1*, and D2* are logic "0", and the bit D3 is a logic "1". Therefore, the switching element Tr0*a* is turned to ON state and the Tr0*b* is turned to OFF state, and thereby, of the power supply voltages VL and VH, the voltage VH is applied to the resistance element Rn0 via the switching element Tr0*a*. Likewise, the power supply voltage VH is applied to the resistance element Rn2 via the switching element Tr1*a* and to the resistance element Rn2 via the switching element Tr2*a*. On the other hand, the switching element Tr3*a* is turned to OFF state and the switching element Tr3*b* is ON state, of the power supply voltages VL and VH, the voltage VL is applied to the resistance element Rn3 via the switching element Tr3*a*. Thus, corresponding to the each digital input data bits D0 to D3 and each inverted digital input data bits D0* to D3*, one voltage of the power supply voltages VL or VH is selected and applied to the resistance elements Rn0, R1, Rn2, and Rn3 via the switching elements Tr0*a* to Tr3*a* or the switching elements Tr0*b* to Tr3*b*. The former resistance elements R00, Rn0, Rn1, Rn2 and Rn3 have twice as large resistance value as the latter resistance elements R01, R12, and R23, and therefore the voltage at a connecting terminal 24 is represented by VL+(VH−VL)(D0+2×D1+4×D2+8×D3)/8. Thus, 16 types of linear output voltages corresponding to the digital input data D0 to D3 and D0* to D3* are obtained.

(Embodiment 1-2)

Figure 4:
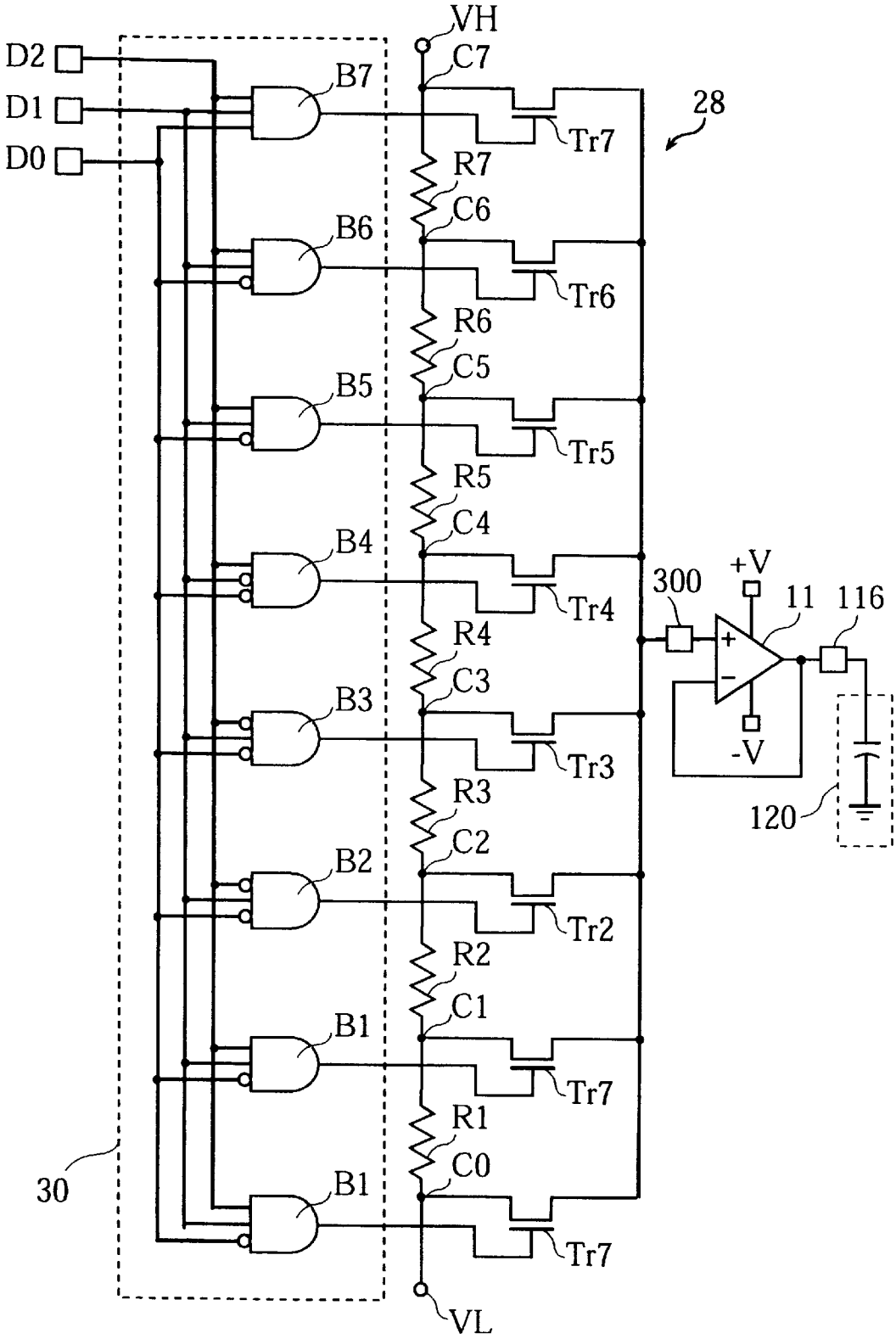
FIG. 4 is a diagram showing the construction of the LCD driver circuit in accordance with Embodiment 1-2.

FIG. 4 shows the construction of a driver circuit according to Embodiment 1-2. In this driver circuit according to Embodiment 1-2, a voltage potentiometer type DAC is used in place of the R-2R ladder type employed in Embodiment 1-1. As for the digital input signal, it consists of three bits, D0, D1, and D2. In a DAC 28 of this embodiment, there are formed resistance elements R1 to R7 connected in series between a high voltage power supply VH and a low voltage power supply VL, switching elements Tr0 to Tr7 connected between connecting terminals C0 to C7 of the resistance elements R1 to R7 and an output terminal, and a selective circuit 30 relating to the switching elements Tr0 to Tr7. The selective circuit 30 alternatively selects one of the connecting terminals C0 to C7 of the resistance elements R1 to R7 in response to the digital input signals D0 to D2. This selective circuit 30 is composed of three-input gate circuits B0 to B7 for selecting the switching states of the switching elements Tr0 to Tr7. The gate circuits B0 to B7 are composed of n-channel transistors. The gate circuits B0 to B7 may be composed of p-channel transistors or combinations of n-channel transistors and p-channel transistors.

In a DAC having the above-described construction, when the digital input signals D1 and D2 are logic "0" and the digital input signal D0 is a logic "1", the outputs of the gate circuits B2 to B7 and B0 are made to be low level, and the output of the gate circuit B1 is made to be high level.

As a result, the switching elements Tr2 to Tr7 and Tr0 is turned to ON state and the switching element Tr1 is turned to OFF state. Thereby, the voltage of the connecting terminal C1, which is supplied from a high voltage power supply VH and dropped by the resistance elements R7 to R2, is applied to a signal amplifier element 11 as an output voltage. Thus, one of the connecting terminals C0 to C7 is selected corresponding to the switching states of the switching elements Tr0 to Tr7, and one of the voltages divided by the resistance elements R1 to R7 and is picked out as the output voltage corresponding to the selected connecting terminal. Consequently, the output voltage is weighted by a resistance value of each of the resistance elements R0 to R7. Therefore, a linear output voltage characteristic can be obtained by setting the resistance values of the resistance elements R1 to R7 at the same value, and conversely, a desired curve in the output voltage characteristic can be obtained by arbitrarily setting the resistance value ratio of the resistance elements R1 to R7 at a certain ratio.

In addition, since this embodiment has a construction in which only the resistance elements are connected in series between the power supplies, it is made possible to obtain such output voltage characteristics as designed using only resistance elements in the actual circuit. The reason is as follows. In the actual designing of circuits, if the DAC has a construction as described in FIG. 3 or other constructions, an ON resistance of switching elements should be taken into consideration in determining the output voltage. Conversely, in this embodiment, as apparent in FIG. 4, if the current flowing through switching elements are small, i.e., the input impedance to the switching element 11 is large, a voltage drop and current diversion by the switching element can be prevented, and therefore the output voltage is determined by only dividing voltages by the resistance elements.

It is therefore made unnecessary to take into consideration ON resistances of the switching elements, and possible to determine the output voltage by only the resistance elements.

(Embodiment 1-3)

Figure 5:
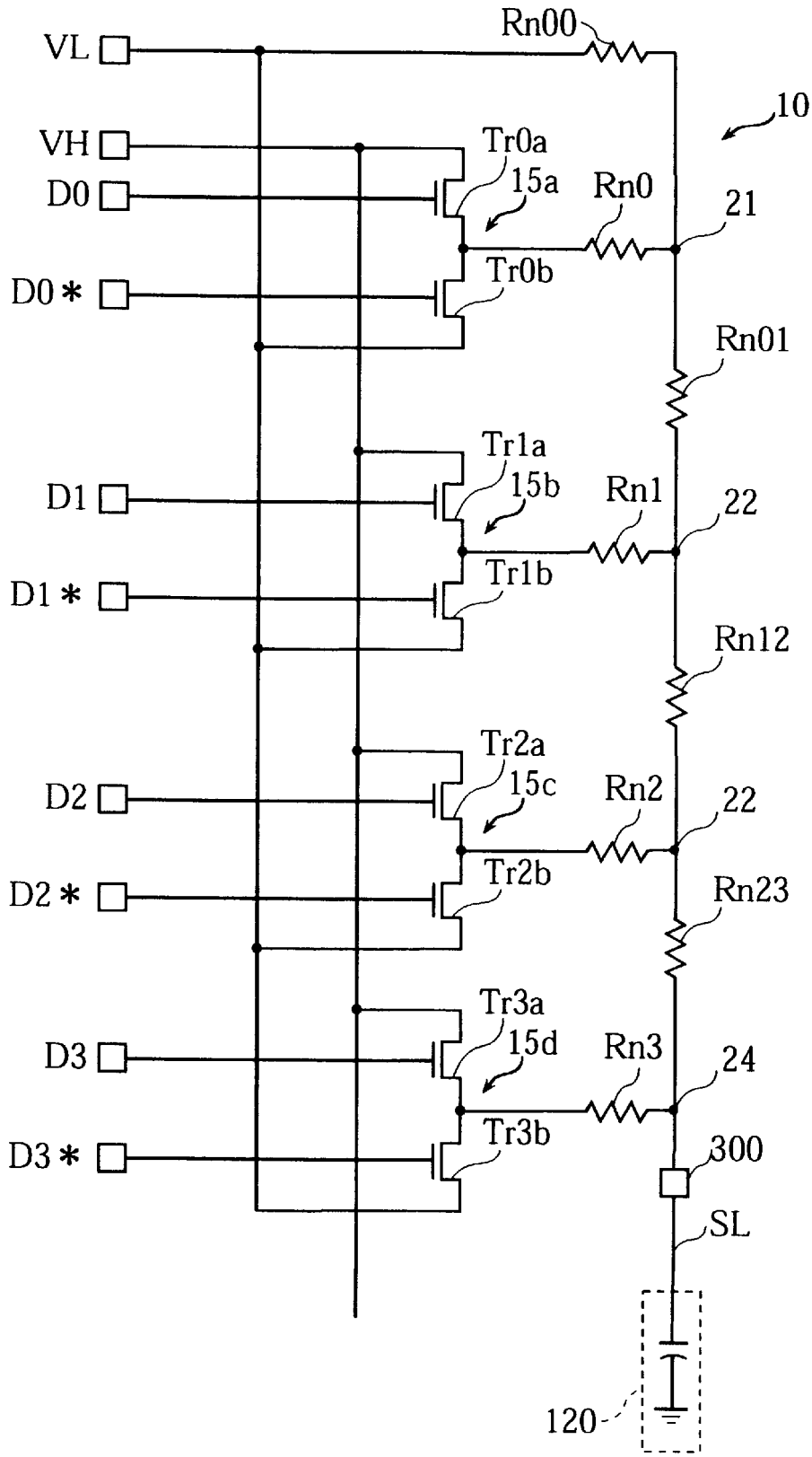
FIG. 5 is a diagram showing the construction of the LCD driver circuit in accordance with Embodiment 1-3.

Now with reference to FIG. 5, the construction of a driver circuit of Embodiment 1-3 is detailed below. This driver circuit of Embodiment 1-3 has a similar construction to the driver circuit described in Embodiment 1-1, and the same reference characters are used for the corresponding parts. Embodiment 1-3 differs from Embodiment 1-1 in that the signal amplifier element 11 is not employed in the circuit construction. In this embodiment, the analog output voltage from the DAC 10 is directly outputted to the source line SL without amplified, and thus it directly drives liquid crystal elements. In order to make this possible, each resistance value of the resistance elements Rn0 to Rn3, Rn00, Rn01, Rn12, and Rn23 as well as each voltage of the power supplies VG and VD are determined so that a driving voltage required for driving liquid crystal elements can be obtained by the output voltage from the DAC 10.

According to this construction, wherein the signal amplifier element 11 is eliminated, the whole circuit area can be made smaller corresponding to the circuit area to be occupied by the signal amplifier element 11 when compared with the case where the signal amplifier element 11 is formed on the array substrate, and moreover the power consumption of the signal amplifier element 11 is eliminated.

It is noted, just for reference, that in the case where the signal amplifier element 11 is employed, the signal amplifier element 11 is required to have a high performance since the output voltage characteristics is very much dependent on the performance of the signal amplifier element 11. However, in the present state of art, p-Si transistors are inferior to crystalline silicon transistors in their transistor performance. Hence, in the aforementioned construction of FIG. 3, in which the signal amplifier element 11 is formed on the array substrate, a large scale circuit is inevitably required so as to obtain an output voltage characteristics and output current characteristic with high precision, and therefore a desired precision may not be able to be obtained within a limited area on the array substrate. In this respect, according to the construction of FIG. 5, in which the signal amplifier element 11 is eliminated, the reliability of an LCD driver circuit is further improved, and the driver circuit can be suitably used for the case where a highly-precise output voltage characteristic is required. It is to be noted that in this embodiment, there has been described a driver circuit having a construction in which the signal amplifier element 11 is eliminated from the driver circuit of FIG. 3, but this embodiment may also be achieved by employing a construction in which the signal amplifier element 11 is eliminated from the aforementioned driver circuit of FIG. 4.

(Embodiment 1-4)

Figure 6:
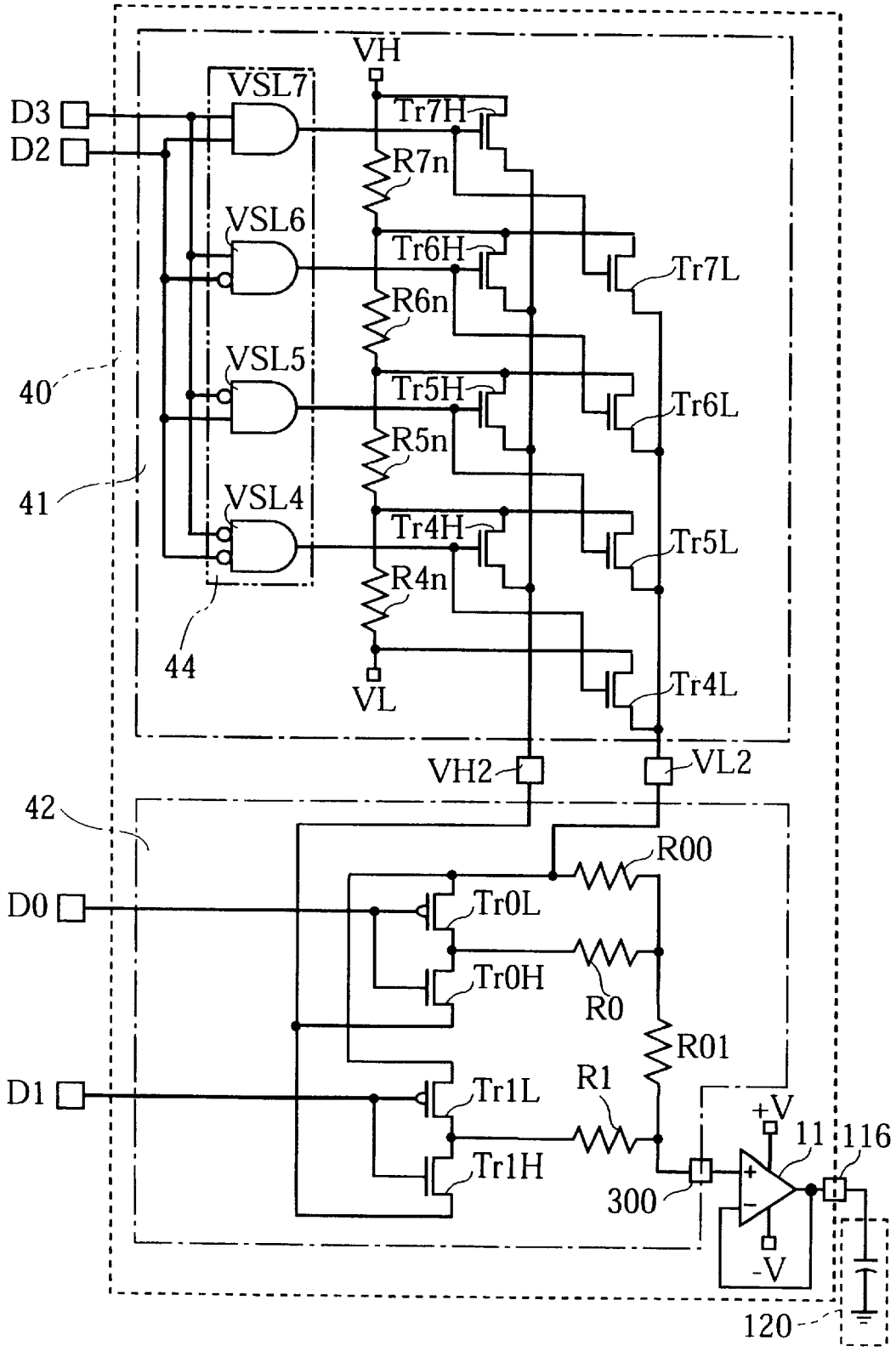
FIG. 6 is a diagram showing the construction of the LCD driver circuit in accordance with Embodiment 1-4.

FIG. 6 depicts the construction of a driver circuit of Embodiment 1-4. A DAC 40 of this embodiment comprises a first DAC section 41 operated in response to two more significant bits D3 and D2 of digital inputs D0 to D3 and a second DAC section 42 operated in response to two lesser significant bits D1 and D0. In the first DAC section 41, resistance elements R4 to R7 are connected in series between a high voltage power supply VH and a low voltage power supply VL, which are the references for an output voltage, switching elements Tr4H to Tr7H are connected between a terminal VH2 and each high voltage terminal of the connecting terminals of the resistance elements R4 to R7, and switching elements Tr4L to Tr7L are connected between a terminal VL and each low voltage terminal of the connecting terminals of the resistance elements R4 to R7. A selective circuit 44 is provided in relation to the switching elements Tr4H to Tr7H. The selective circuit 44 alternatively selects the connecting terminals of the resistance elements R4*n* to R7*n* in response to the digital input D2 and D3. This selective circuit 44 is composed of two-input gate circuits VSL4 to VSL7 for selecting the switching states of the switching elements Tr4H to Tr7H and Tr4L to Tr7L.

The second DAC section 42, which is an R-2R ladder type DAC, comprises resistance elements R00, R01, R0, and R1, and switching elements Tr0L, Tr0H, Tr1L, and Tr1H. It also has as its reference power supplies the terminals VH2 and VL2 which are the output voltages from the first DAC section 41. It outputs digital-to-analog converted signals to an output terminal 300 in response to digital input signals D0 and D1. The resistance value of the resistance element R01 is r1, and those of the resistance elements R00, R0, and R1 are twice as large as r1.

There is now described an outline of the operation of the DAC having the above construction. The first DAC section 41 basically operates according to the same manner as in the embodiment shown in FIG. 4. The digital inputs D3 and D2 are decoded by the selective circuit 44, then the potentials at both connecting terminals of one of the resistance elements R4*n* to R7*n* are alternatively selected, then the selected connecting terminal with higher potential is connected to the terminal VH2 by switching one of the switching elements Tr4H to Tr7H, and the selected connecting terminal with lower potential is connected to the terminal VL2 by switching one of the switching elements Tr4L to Tr7L corresponding to the switching element switched on the higher potential side. A desired intermediate potential between the high voltage power supply VH and the low voltage power supply VL is thus generated between the terminal VH2 and the terminal VL2.

The second DAC section 42 basically operates according to the same manner as in the embodiment shown in FIG. 3. Using as a reference voltage the terminal VH2 and the terminal VL2 connected to the first DAC section, the switching elements Tr0L, Tr0H, Tr1L, and Tr1H are switched in response to the digital input signals D0 and D1, and one of the four potentials equally divided between the terminal VH2 and VL2 is alternatively selected and outputted to the terminal 300.

The driver circuit according to the above construction can avoid a relatively large output voltage error caused by the errors of ON resistance of the switching element corresponding to the more significant bits in the embodiment shown in FIG. 3, and moreover, it can obtain the output characteristic with a desired step-like line within the range of the more significant bits. Furthermore, in the driver circuit according to the above construction, by employing the above construction of the lesser significant bit section, the scale of the selective circuit therein can be reduced, and in the case of the lesser significant bits being three or more bits, the number of the resistance elements can be also reduced when compared with the construction shown in FIG. 4.

It is understood that although the potentials of both connecting terminals of one resistance element are selected for the terminals VH2 and VL2 in this embodiment, there is no problem at all if one connecting terminal is selected from one of the resistance elements and the other connecting terminal from another resistance element.

In the embodiments described thus far, although the resistance elements are formed in the n+ layer of p-Si, the present invention is not limited thereto, and the resistance elements may be formed from an n− layer of p-Si, p+ layer, or p− layer of p-Si, or any of an n+ layer, n− layer, p+ layer, or p− layer of amorphous silicon (a-Si). The resistance elements may also be formed from a combination of an n+ layer, an n− layer, a p+ layer, and a p− layer of p-Si or a-Si. In other words, the resistance elements in the present invention should be formed by a non-monocrystalline semiconductor layer containing an impurity. Among them, an n− layer and a p− layer are particularly advantageous in that they are capable of making the circuit area smaller since an impurity layer with low concentration (n− layer and p− layer) has higher resistance than an impurity layer with high concentration (n+ layer and p+ layer). In addition, in view of designing a circuit as a whole, at the same time with taking into account the view of reducing the circuit, a variety of wiring patterns suitable for various specifications can be formed by arbitrarily selecting any of the n+, n−, p+, and p− layer of p-Si or a-Si, and thus freedom in circuit designing can be increased.

It is also to be understood that although the switching elements composing the DAC are n-channel transistors in the above-described embodiments, the switching elements may be p-channel transistors or combinations of n-channel transistors and p-channel transistors.

Further, although the signal amplifier element 11 is formed on the array substrate in the above-described embodiments, a signal amplifier element as an individual component may be mounted on the array substrate.

Embodiment 2

Embodiment 2 herein has achieved reduced power consumption in an LCD driver circuit by creating a low power period, which is a period except a normal operation period of a DAC, and reducing an electric current consumed in the DAC during the low power period. The normal operation period herein is defined as the following (1) or (2). (1) In the case where the time at which a gate pulse is provided and the time of the change of the output voltage from a driver circuit are almost simultaneous, a normal operation period is a period during which the potential of a pixel electrode reaches a desired potential (i.e., a pixel electrode writing period). (2) In the case where a source line reaches a desired potential by the change of the output voltage from a driver circuit and thereafter a gate pulse is provided, a normal operation period is a period during which the potential of a source line reaches a desired potential (i.e., a source line writing period).

The source line writing period means a period required for completely changing the potentials of all the capacitive loads connected to a source line into a desired potential by the output voltage from a DAC. The pixel electrode writing period means a period required for, first, switching a pixel transistor ON by a scan pulse from a gate line, then establishing a continuity between the pixel electrode and a source line, and thereafter completely changing the potential of the pixel electrode into a desired potential.

Figure 7:
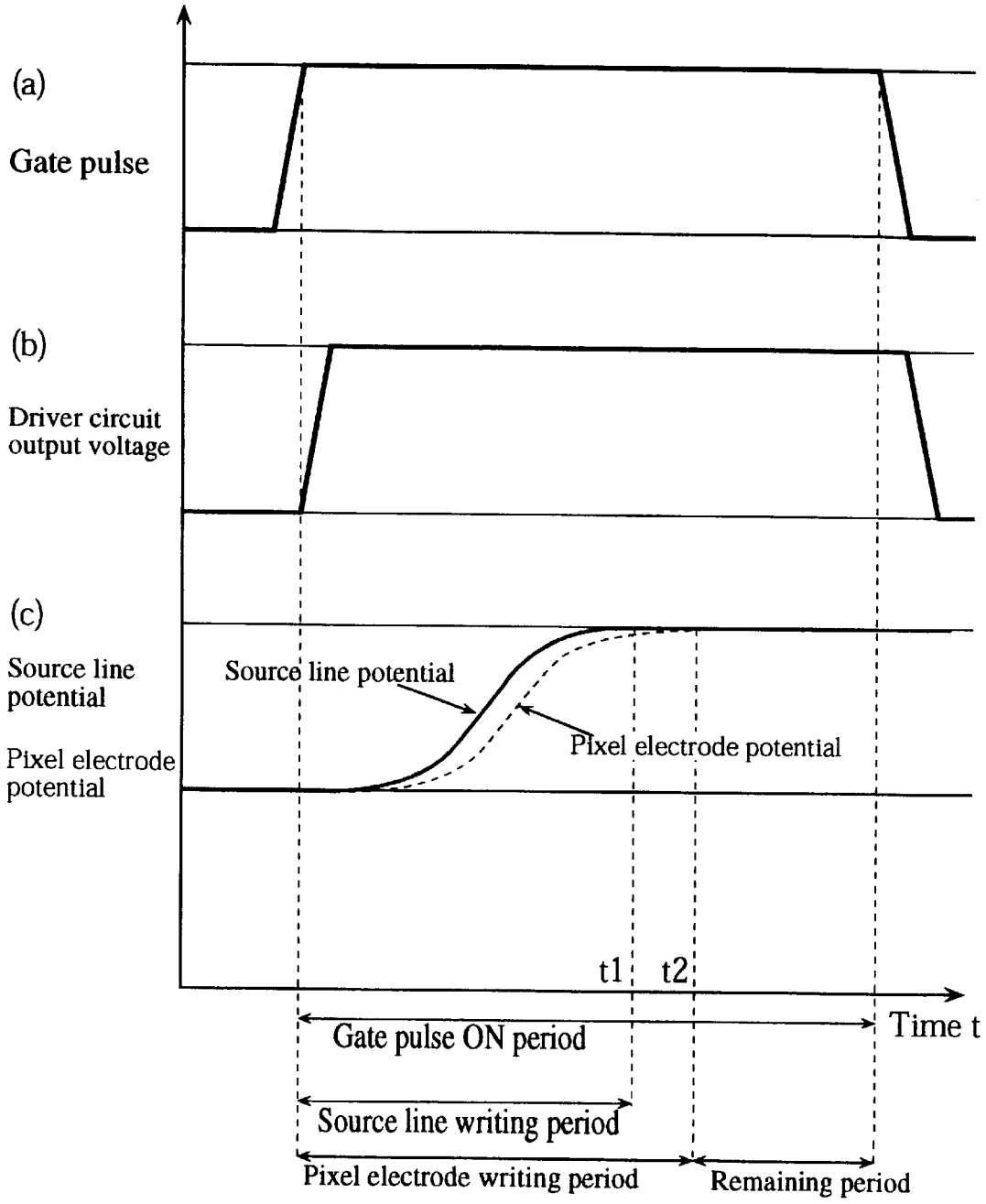
FIGS. 7(*a*)–(*c*) are diagrams to illustrate the normal operation period in Embodiment 2 of the present invention.

With reference to FIG. 7, in the case of the aforementioned (1), when a gate pulse has the waveform shown in FIG. 7(*a*) and an output voltage from a driver circuit has the waveform shown in FIG. 7(*b*), a source line potential and a pixel electrode potential are both charged by applying the output voltage from the driver circuit as shown in FIG. 7(*c*). The source line potential reaches a desired potential at a time t1 and the pixel electrode potential reaches a desired potential at a time t2. In such a charging operation, a source line writing period is from the time at which the output voltage from the driver circuit is applied, to the time t1, and a pixel electrode writing period is from the time at which the output voltage from the driver circuit is applied, to the time t2. In this case, a normal operation period T1 is a period during which a pixel electrode reaches a desired potential (a pixel electrode writing period).

Figure 8:
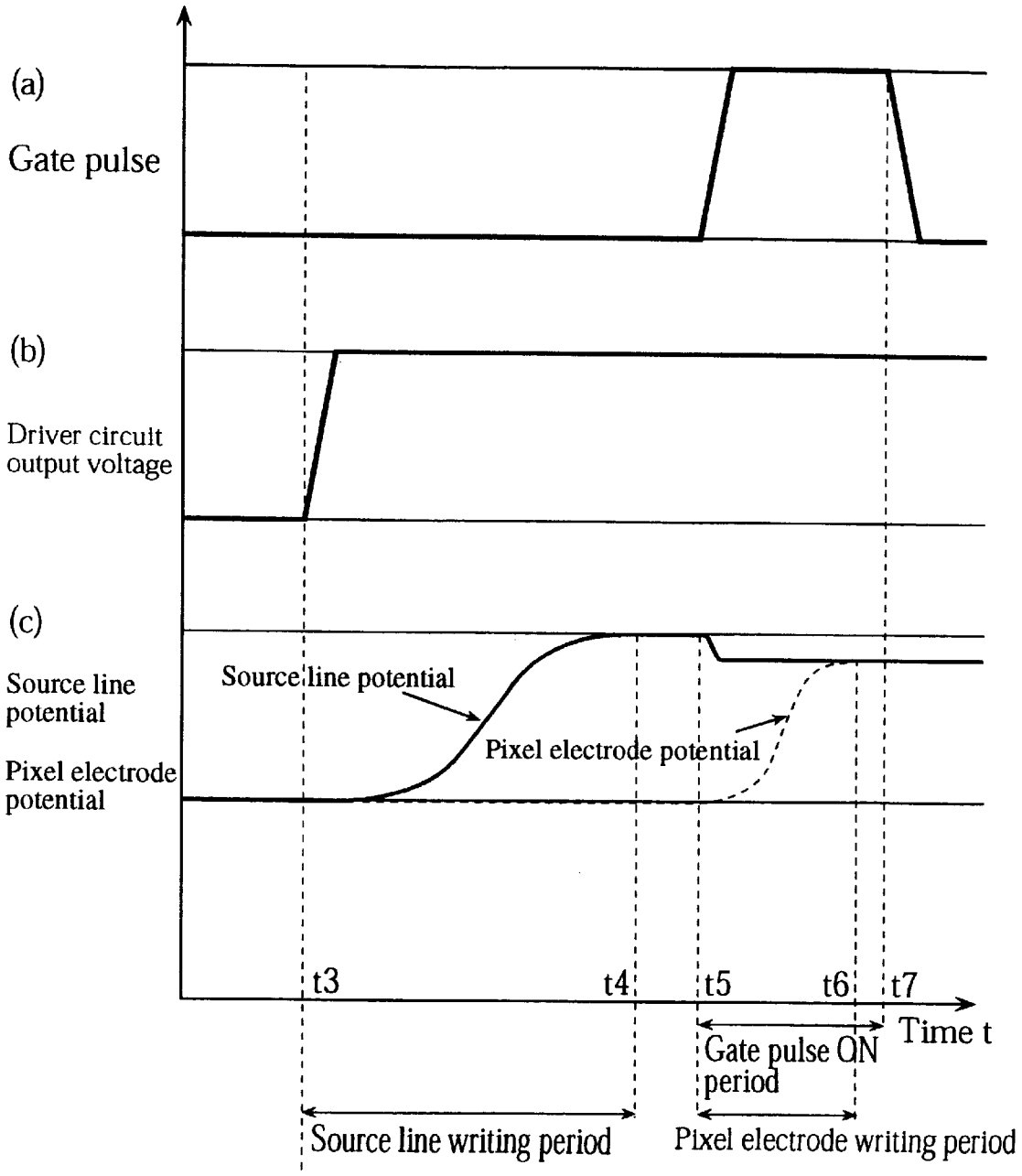
FIGS. 8(*a*)–(*c*) are other diagrams to illustrate the normal operation period in Embodiment 2 of the present invention.

In the case of the aforementioned (2), when a gate pulse has the waveform shown in FIG. 8(*a*) and an output voltage from a driver circuit has the waveform shown in FIG. 8(*b*), a source line potential is charged and it reaches a desired potential at a time t4, as shown in FIG. 8(*c*). In this case, a pixel electrode potential rises by being charged from a time t5 and reaches a desired potential at a time t6. In this case, of FIG. 8, a normal operation period T1 is a period from a time t3 to the time t4, during which a source line potential reaches a desired potential (a source line writing period).

It is to be noted that the driver circuits of the embodiments which will be described hereinafter are, as well as the driver circuits of Embodiment 1 described hereinbefore, so-called integrated type driver circuits integrally formed on an array substrate of an LCD, and therefore the resistance elements composing the DACs therein are also formed by the semiconductor layers formed on the array substrate. Now, with reference to the figures, there is detailed EMBODIMENT 2 below.

(Embodiment 2-1)

Figure 9:
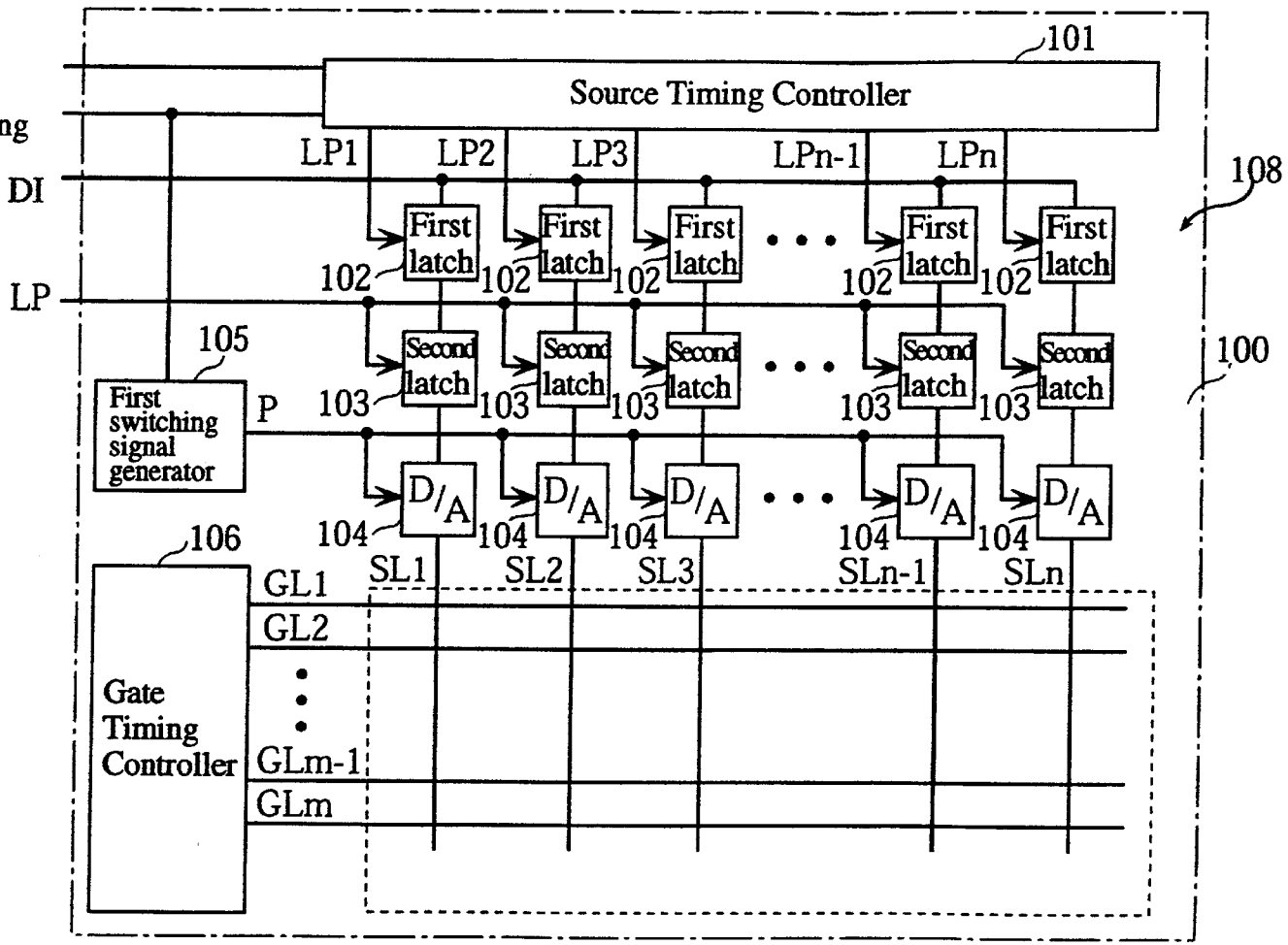
FIG. 9 is a schematic diagram showing the construction of the LCD driver circuit in accordance with Embodiment 2-1 of the present invention.

FIG. 9 shows the entire construction of an LCD driver circuit of Embodiment 2-1. A liquid crystal panel shown as an example of Embodiment 2-1 has (n) number of source lines and (m) number of gate lines, and three-bit data is inputted therein. A driver circuit 108 is an integrated type driver circuit integrally formed on an array substrate 100. The driver circuit 108 basically comprises a source line timing controller 101, (n) pieces of first latch circuits 102 for latching video signals, (n) pieces of second latch circuits 103 for latching the outputs from the first latch circuits 102, (n) pieces of DACs 104, a first switching signal generator circuit 105 for generating a first switching signal P (see FIG. 12) for selectively switching two modes, one of the modes being a normal operation period T1 and the other mode being a remaining period T2 (hereinafter referred to as a 'low power period T2'), which is the remaining period of one horizontal synchronizing period after the normal operation period T1 is excluded, and a gate line timing controller 106 for controlling outputs of scanning pulses for GL1 to GL(m).

Figure 10:
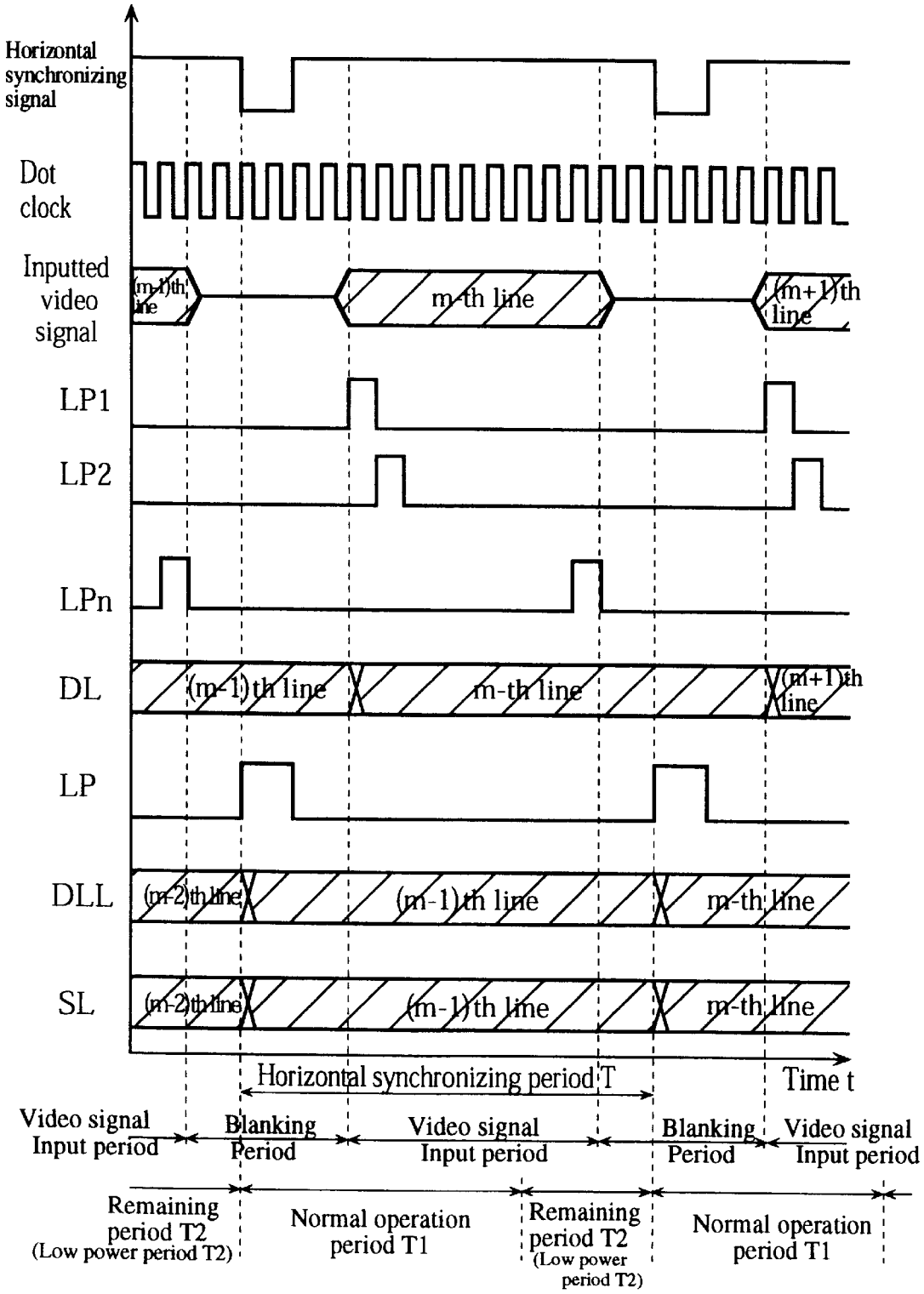
FIG. 10 is a timing chart of the LCD driver circuit in accordance with Embodiment 2-1 of the present invention.

FIG. 10 is a timing chart showing the operation of the driver circuit. The source line timing controller 101 successively outputs latch pulses LP1 to LP(n) to the first latch circuits 102 according to dot clock signals. A three-bit serial digital video signal DI is thereby latched by each first latch circuit 102 successively. When the digital data for one horizontal line is thus latched by each of the first latch circuits 102, a latch pulse LP is outputted from the source line timing controller 101 to each second latch circuit 103, and thereby the digital data for one horizontal line is latched to each of the second latch circuits 103. The digital data latched by each second latch circuit is fed to the DAC 104 and a driving voltage corresponding to the input digital data is outputted to each source line SL1 to SL(n). Meanwhile, synchronized with such driving voltages outputted to the source lines SL1 to SL(n), a scanning pulse is outputted from the gate line timing controller 106 to a gate line GL1 and thereby the pixel transistors are turned ON, and thus the driving voltages are written into the liquid crystal layer. Thereafter, the same operation is repeated until it reaches the (m)-st line, and a scanning for one field is thereby completed. Hence, an image of the video signals for one field is displayed.

It is to be noted that the data DL latched by each of the first latch circuits 102 is updated when each latch pulse LP1 to LP(n) is inputted. This updating of the latched data DL is carried out once in each horizontal synchronizing period for each first latch circuit 102. In a blanking period, the latest data of input video signals for one line is stored in the first latch circuits 102. During this blanking period, a common latch pulse LP is inputted to the second latch circuits 103, and the data DLL is updated so that the data DLL becomes the latest data for one line. The input data to the DACs 104 for driving the source lines are the data DLL latched in the latch circuits 103. The data are updated coinciding with the time at which the latch pulse LP is inputted to each second latch circuit 103, and the same data are fed into the DACs 104 throughout one horizontal synchronizing period.

In this embodiment, a normal operation period T1 is a portion of one horizontal synchronizing period T, and a low power period T2 is defined as a remaining period excluding the normal operation period T1 from one horizontal synchronizing period T. This embodiment is characterized by reducing the power consumption of the DACs 104 in this low power period T2. More specifically, in prior arts, one entire horizontal synchronizing period has been the normal operation period. In this embodiment, however, the normal operation period T1 is limited to the period during which it is essential to keep applying a driving voltage to source lines, and it is characterized in that the power consumption in the resistance elements in the DACs 104 is reduced in the low power period T2. This embodiment thus achieves the reduction in power consumption when compared with prior arts wherein DACs continue the normal operation throughout one entire horizontal synchronizing period T.

Figure 11:
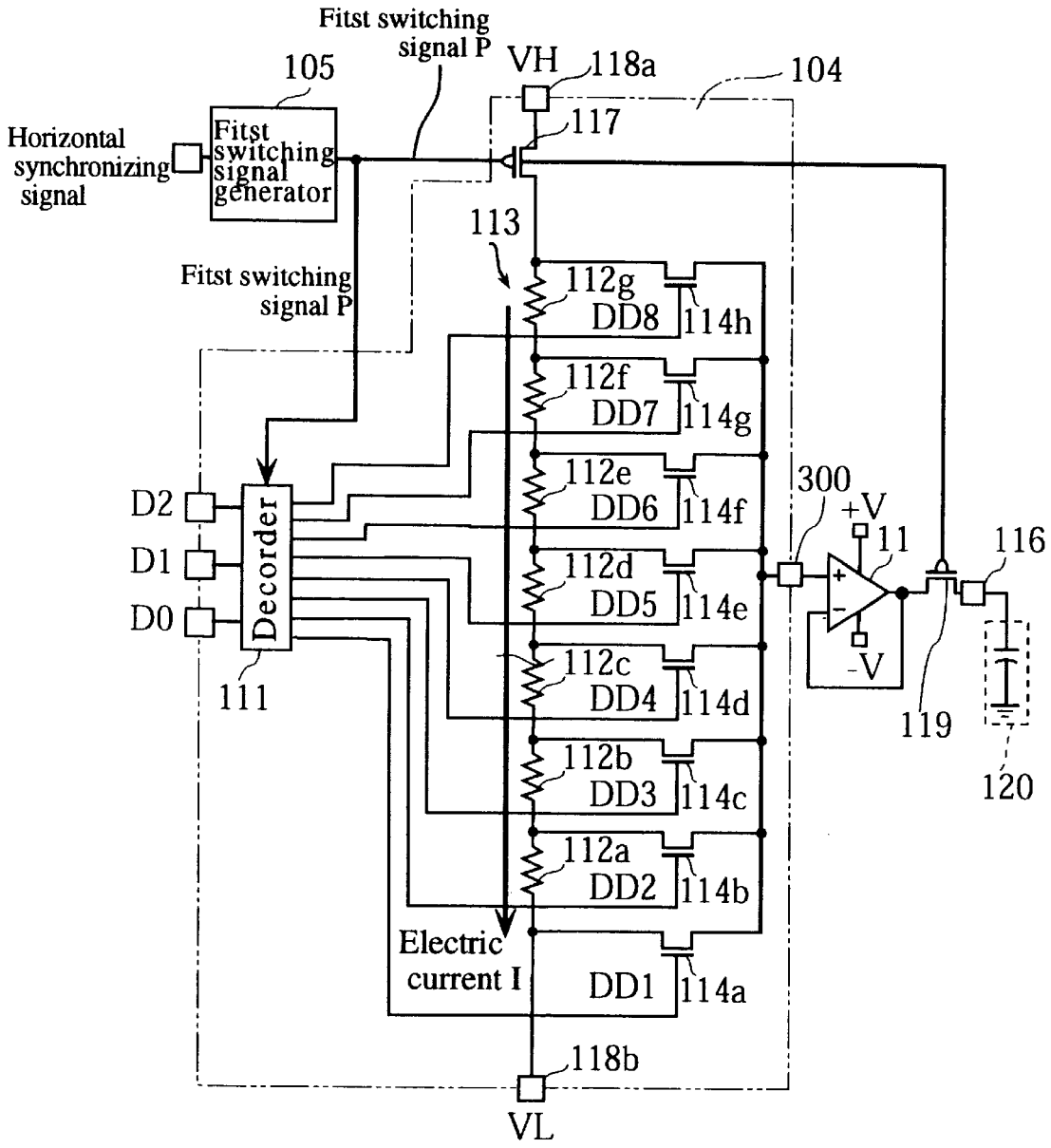
FIG. 11 is a circuit diagram of a DAC incorporated in the LCD driver circuit in accordance with Embodiment 2-1 of the present invention.
Figure 12:
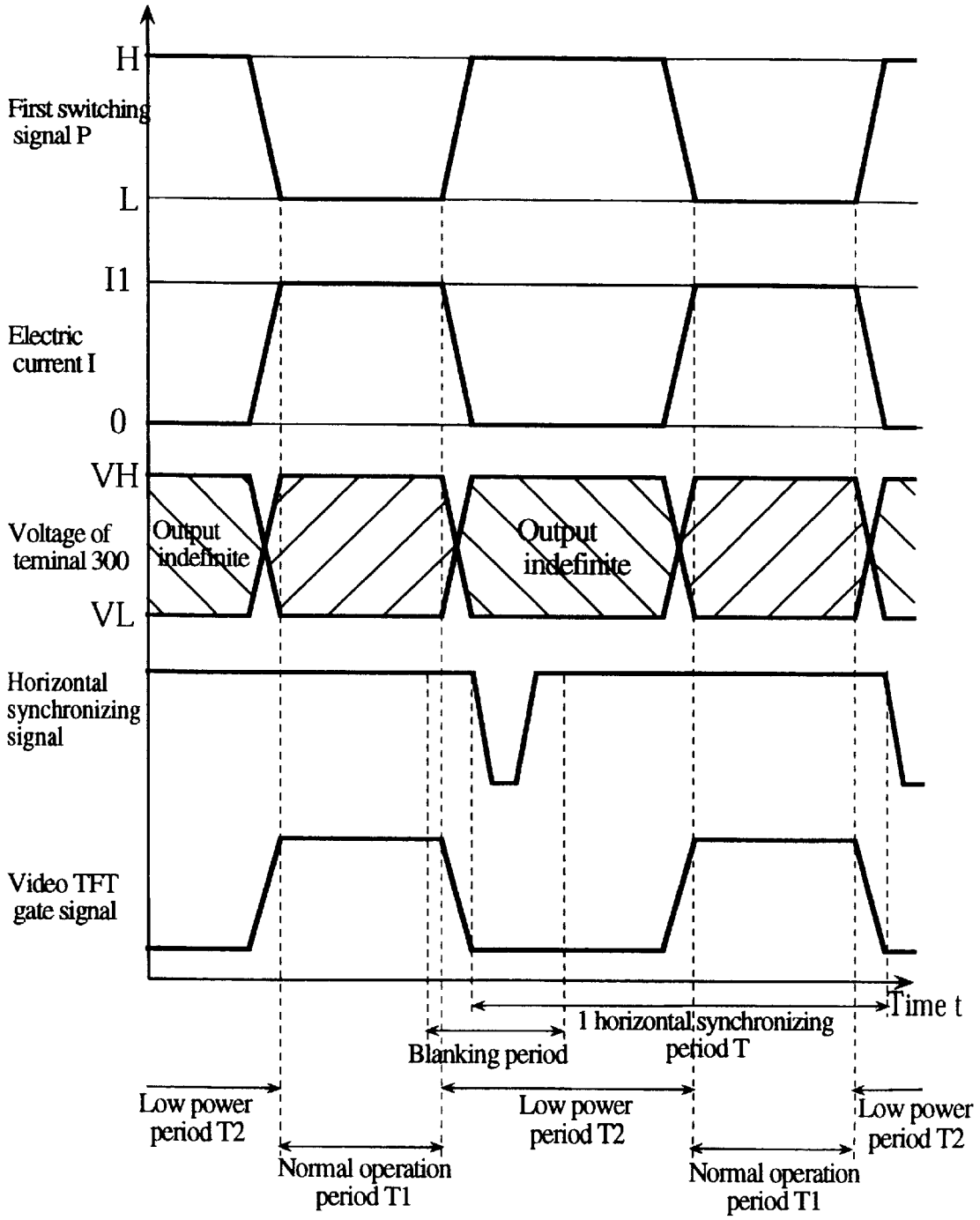
FIG. 12 is a timing chart of a DAC incorporated in the LCD driver circuit in accordance with Embodiment 2-1 of the present invention.

FIG. 11 is a diagram showing the specific circuit construction of such a DAC, and FIG. 12 is a timing chart showing the operation of the DAC. The DAC 104 is a voltage potentiometer DAC. This DAC 104 comprises a series circuit 13 in which a plurality of resistance elements 112*a* to 112*g* are connected in series, second switches 114*a* to 114*h* for selectively outputting the voltages divided by the resistance elements 112*a* to 112*g* to an output terminal 300 of the DAC, a signal amplifier element 11 connected between the second switches 114*a* to 114*h* and an output terminal 116 of the driver circuit, an output switch 119 connected between the signal amplifier element 11 and the output terminal 116, and a decoder 111 for decoding three-bit digital input signals D0, D1, and D2 into eight-bit digital signals DD1 to DD8.

One end of the aforementioned series circuit 113 is connected to a power supply terminal 118*a* of a high voltage power supply VH with a first switch 117 interposed therebetween, and the other end is connected to a power supply terminal 118*b* of a low voltage power supply VL. The second switches 114*a* to 114*h* are composed of an n-channel TFT, and the first switch 117 and the output switch 119 are composed of a p-channel TFT.

The first switching signal generator circuit 105 generates a first switching signal P as shown in FIG. 11 from a horizontal synchronizing signal inputted therein. The first switching signal P comprises a high-level period and low-level period, and is so constituted that the low-level period becomes identical to the normal operation period T1 and the high-level period becomes identical to the low power period T2.

The first switching signal generator circuit 105 outputs the first switching signal P to the first switch 117 and the output switch 119. The first switch 117 is turned to OFF state in the case of the first switching signal P being high-level, and turned to ON state in the case of the first switching signal P being low-level. As a result, during the normal operation period T1, a power supply voltage (VH−VL) is applied to the resistance elements in the DAC 104, while during the low power period T2, the power supply voltage applied to the DAC 104 is "0".

The output terminal 116 is connected to a capacitive load 120. Among the capacitive loads of a source line are 1) a capacitance generated in a liquid crystal layer and an insulation layer whose electrodes are an entire source line and a counter substrate, 2) a capacitance generated in an insulation layer whose electrodes are a source line and a gate line at the intersection of the lines, 3) a capacitance generated in an insulation layer whose electrodes are a source line and a pixel electrode terminal parallel to the source line, and 4) a capacitance retained by a pixel transistor at the intersection of a source line and a gate line. The total sum of these capacitive loads 1) to 4), is equivalent to the capacitive load 120.

Referring now to the timing chart of FIG. 12, there is explained the power reduction system of a DAC 104 having the above-described construction. During the normal operation period Ti, the first switching signal P is low-level and thereby the first switch 117 is turned to ON state. As a result, the resistance elements of the DAC 104 are connected to the power supply terminal 118*a* and the power supply terminal 118*b*, and the electric current I flowing in the resistance elements 112*a* to 112*g* becomes I1 in the following Equation (1), and at this point, the electric power W consumed in the resistance elements 112*a* to 112*g* becomes W1 in the following Equation (2). During this normal operation period T1, the output switch is kept ON state, and thereby the output from the signal amplifier element 11 is fed to the output terminal 116. The voltage at the output terminal 116 is determined by one of the second switches 114*a* to 114*h* controlled by the digital inputs DD1 to DD8, and one voltage between the voltage VH and the voltage VL, which is the area shown by slanted lines in FIG. 10, is outputted as a driving voltage.

$$I1=(VH-VL)/\Sigma Rn \quad \text{Equation (1)}$$

$$W1=(VH-VL)^2/\Sigma Rn \quad \text{Equation (2)}$$

During the low power period T2, the first switch 117 is turned to OFF state. The electric current I flowing in the resistance elements 112*a* to 112*g* thereby becomes "0", and the electric power W consumed in the resistance elements 112*a* to 112*g* also becomes "0". Hence, the power consumption can be reduced during the low power period T2. The voltage at the output terminal 300 is indefinite. In addition, during the low power period T2, since the output switch 119 is turned to OFF state, the potential at the output terminal 116 is retained by the capacitive load 120. Therefore, the low power period is not limited to the blanking period in one horizontal synchronizing period T, but can include a period in which the period necessary to change the voltage of the capacitive load 120 is excluded from one horizontal synchronizing period.

In the low power period T2, in the case where the pixel transistor is made OFF, the electric charge stored in the liquid crystal layer is, primarily, retained. Therefore, there is theoretically no need to hold the voltage of the capacitive load 120 by making the output switch 119 OFF. However, in practice, it is unable to completely cut off the liquid crystal layer and the source lines, and for that reason, there arises a need to retain the voltage of the capacitive load 120 by switching off the output switch 119. If the signal amplifier 11 has such a construction that the output impedance becomes high when the driving power of the signal amplifier element 11 is cut off, the output switch 119 can be omitted and the voltage retention of the capacitive load 120 can be carried out by cutting off the driving power of the signal amplifier element 11. However, if the signal amplifier 11 does not have such a construction that the output impedance becomes high when the driving power of the signal amplifier element 11 is cut off, it is necessary that a voltage variation of the capacitive load 120 be prevented by the output switch 119.

In this embodiment, the electric current I can also be made "0", by short-circuiting the power supply terminal 118*a* and the power supply terminal 118*b*. In this case, a rush current is generated immediately after the short circuit and some electric power is generated. However, if the effect of power reduction by creating a low power period outweighs even with taking into account the power loss by the rush current, it is possible to attain the reduction of power consumption by short-circuiting the power supplies.

It is noted that although the first switch 117 is connected between the resistance element 112*g* and the power supply terminal 118*a* in the above example, but it may be connected between the resistance element 112*a* and the power supply terminal 118*b*.

(Embodiment 2-2)

Figure 13:
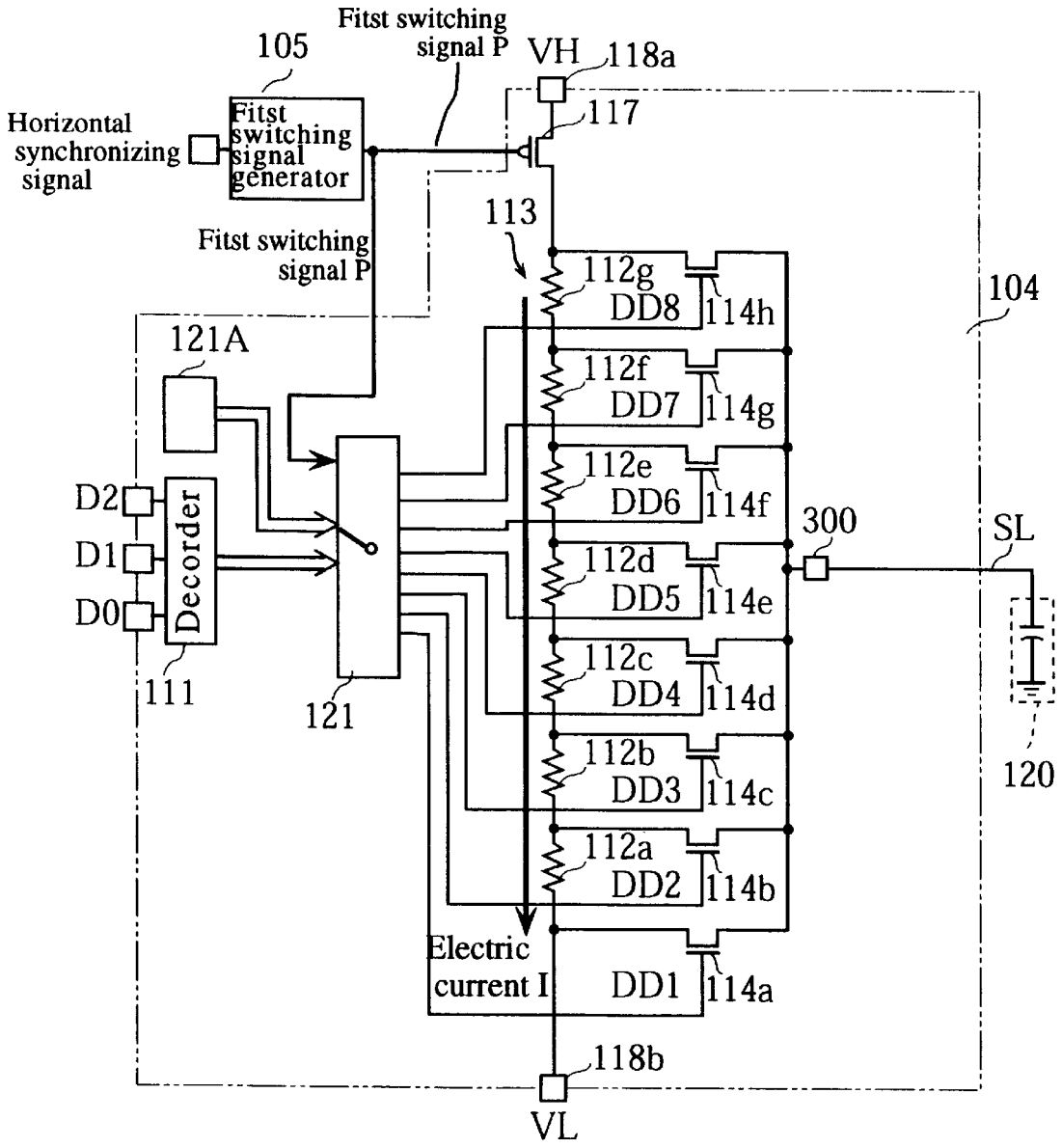
FIG. 13 is a circuit diagram of a DAC incorporated in the LCD driver circuit in accordance with Embodiment 2-2 of the present invention.

FIG. 13 shows the construction of the DAC integrated in a driver circuit of the embodiment. This Embodiment 2-2 has a similar construction to the driver circuit of Embodiment 2-1, and the same reference characters are used for the corresponding parts. For this Embodiment 2-2, the signal amplifier 11 and the output 119, both used in Embodiment 2-1, are eliminated, and instead, a storage circuit 121A and a switch 121 are provided. In the storage circuit 121A, a data in which digital signals DD1 to DD8 are all fixed to be logic "0" is stored. The switch 121 is responsive to the first switching signal P, and during the normal operation period T1, it feeds the digital data DD1 to DD8 to the second switches 114*a* to 114*h*, and during the low power period T2, it feeds the fixed data from the storage circuit 121A to the second switches 114*a* to 114*h* in response to the first switching signal P. As a result, during the normal operation period T1, the second switches 114*a* to 114*h* are controlled by the digital data DD1 to DD8 from the decoder 111, and a desired driving voltage is thereby obtained. During the low power period T2, all the second switches 114*a* to 114*h* are turned to OFF by the fixed data, resulting in an output impedance of the DAC being a high impedance, and therefore the potential of the capacitive load 120 is retained. The above-described construction, wherein the second switches

114*a* to 114*h* are provided in place of the output switch 119 and have the function of the output switch 119, is also capable of preventing a potential variation of the capacitive load 120 during the low power period T2.

(Embodiment 2-3)

Figure 14:
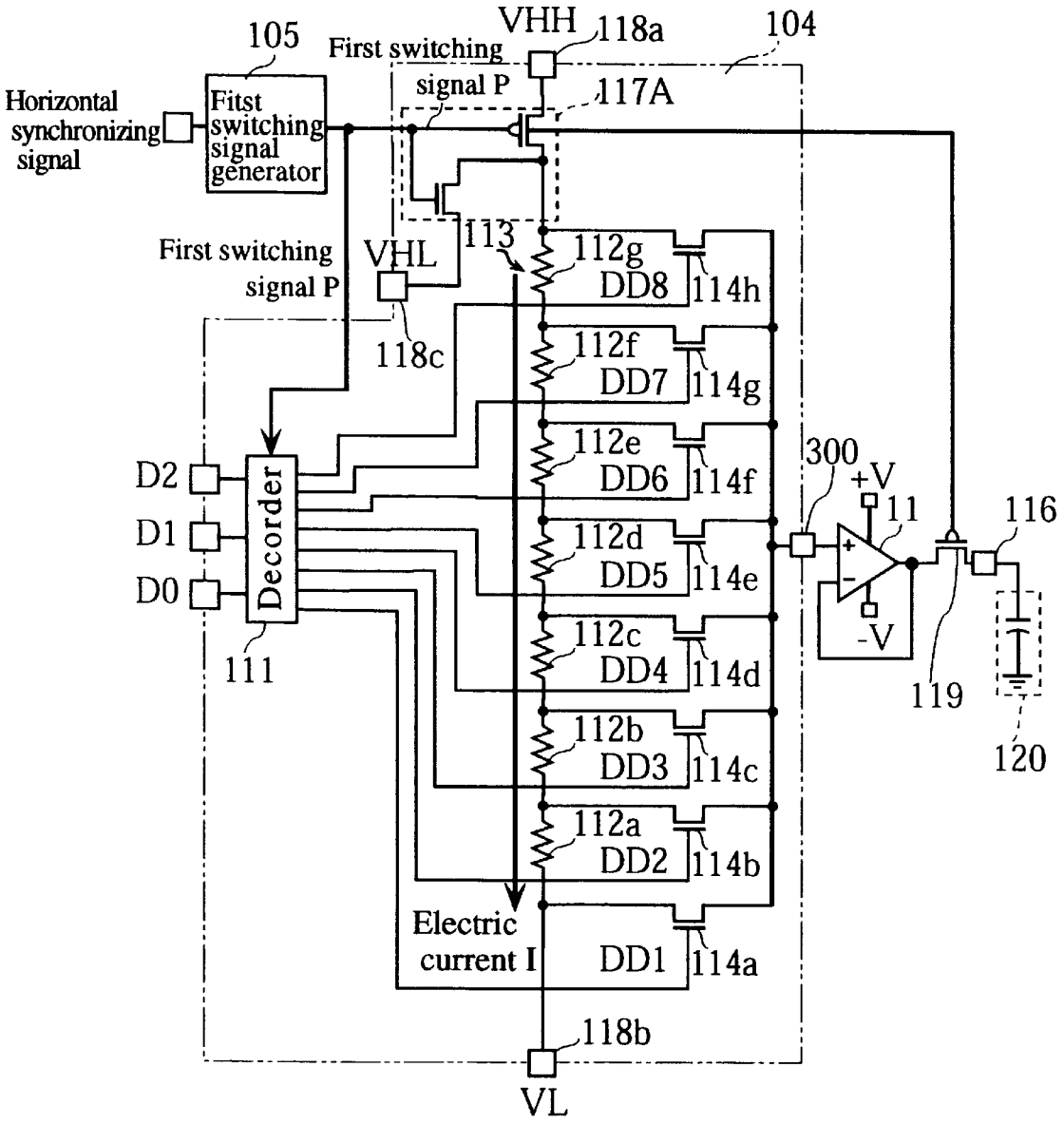
FIG. 14 is a circuit diagram of a DAC incorporated in the LCD driver circuit in accordance with Embodiment 2-3 of the present invention.
Figure 15:
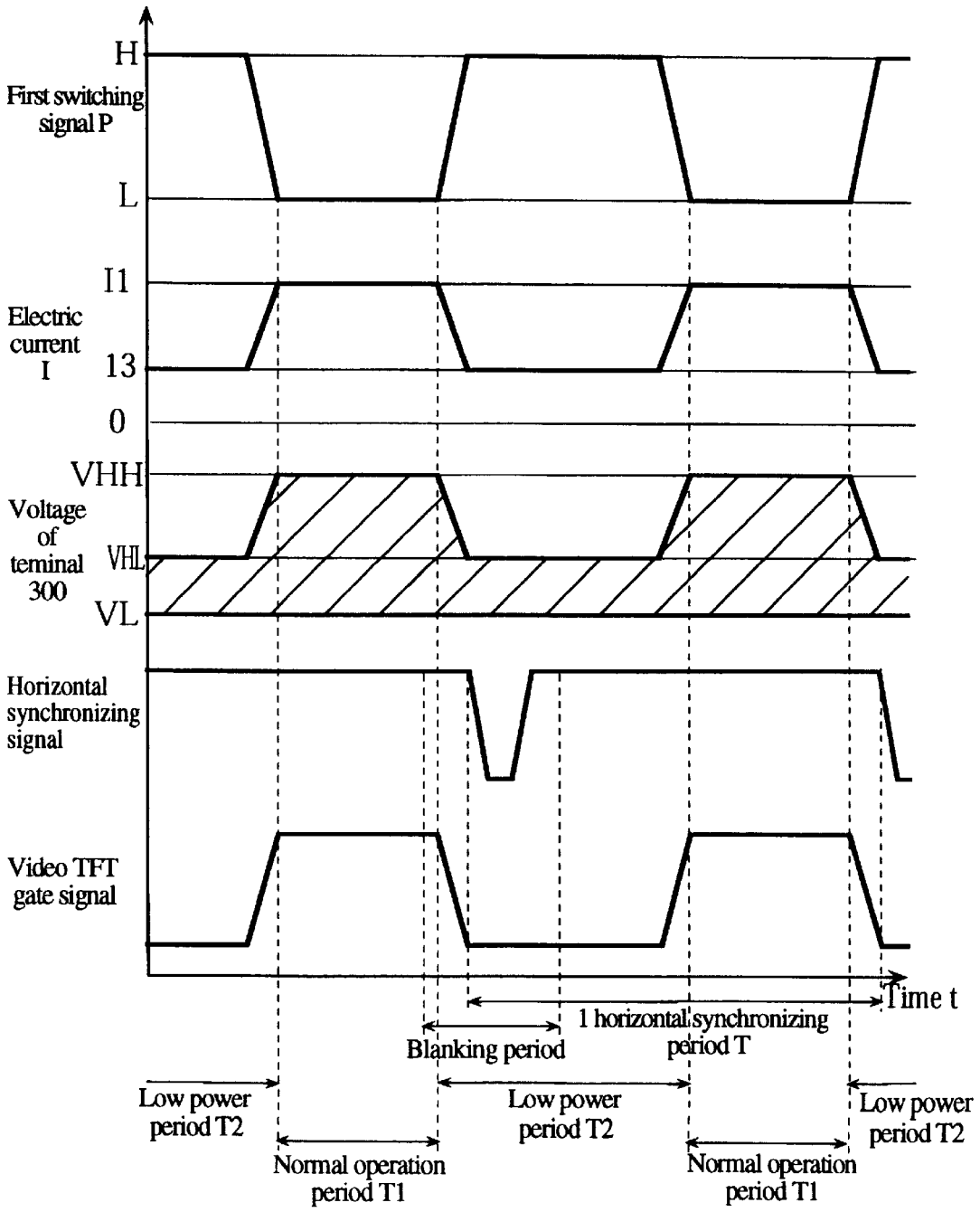
FIG. 15 is a timing chart of a DAC incorporated in the LCD driver circuit in accordance with Embodiment 2-3 of the present invention.

FIG. 14 is a diagram showing the construction of the DAC integrated in a driver circuit of Embodiment 2-3, and FIG. 15 is a timing chart thereof. This Embodiment 2-3 has a similar construction to Embodiment 2-1, and the same reference characters are used for the corresponding parts. For this Embodiment 2-3, a third switch 117A is employed in place of the first switch 117 used in Embodiment 2-1. This third switch 117A is composed of an n-channel TFT and a p-channel TFT, and it is a switch for selecting one power supply from a power supply terminal 118*a* of a first high voltage power supply VHH and a power supply terminal 118*c* of a second high voltage power supply VHL having a lower voltage level than the first high voltage power supply VHH. The first switching signal P is fed to this third switch 117A, and the third switch 117A is so constructed that it is switched to the power supply terminal 118*c* when the first switching signal P is high-level and switched to the power supply terminal 118*a* when the first switching signal P is low-level.

Now referring to the timing chart of FIG. 15, there is explained the power saving system of the DAC having the aforementioned construction. During the normal operation period T1 of the DAC, the first switching signal P is low-level, and thereby the resistance elements in the DAC are connected to the power supply terminal 118*a* and the power supply terminal 118*b*. In this case, the electric current I flowing in the resistance elements 112*a* to 112*g* becomes I1 shown in the above Equation (1), and the electric power W consumed in these resistance elements becomes WI shown in the above Equation (2).

During the normal operation period T1, the voltage of the output terminal 116 is connected to one of the second switches 114*a* to 114*h* controlled by the digital input data DD1 to DD8, and one of the voltages between the voltage VL and the voltage VHH is thereby outputted.

During the low power period T2, the first switching signal P is made to be high-level, and thereby the third switch 117A is switched to the power supply terminal 118*c*. As a result, the power supply terminal connected to the resistance element 112*g* is switched from the terminal 118*a* to the terminal 118*c*. Therefore, the electric current I flowing in the resistance elements 112*a* to 112*g* becomes I2 shown in the following Equation (3), and the electric power W consumed in the resistance elements 112*a* to 112*g* accordingly becomes W2 shown in the following Equation (4). Hence, the reduction in power consumption during the low power period T2 can be achieved.

$$I2=(VHL-VL)/\Sigma Rn \quad \text{Equation (3)}$$

$$W2=(VHL-VL)^2/\Sigma Rn \quad \text{Equation (4)}$$

Furthermore, during the low power period T2, since the output switch 119 is turned OFF, the potential of the output terminal 116 is retained by the capacitive load 120. Therefore, the low power period is not limited to the blanking period in one horizontal synchronizing period T, but can include a period in which the period necessary to change the voltage of the capacitive load 120 is excluded from one horizontal synchronizing period.

Additionally, during the low power period T2, the voltage of the output terminal 300 results in one of the voltages between VL and VHL. Further, the potentials at each point in the DAC become definite. Therefore, Embodiment 2-3 exhibits such excellent effects that it can reduce a sudden increase of a power supply current in re-throwing the power supply voltage and signal noises resulting from the sudden current increase because it is capable of making definite the potentials at each point in the DAC, although the amount of reduced electric power may not be as much as that of Embodiment 2-1.

(Embodiment 2-4)

Figure 16:
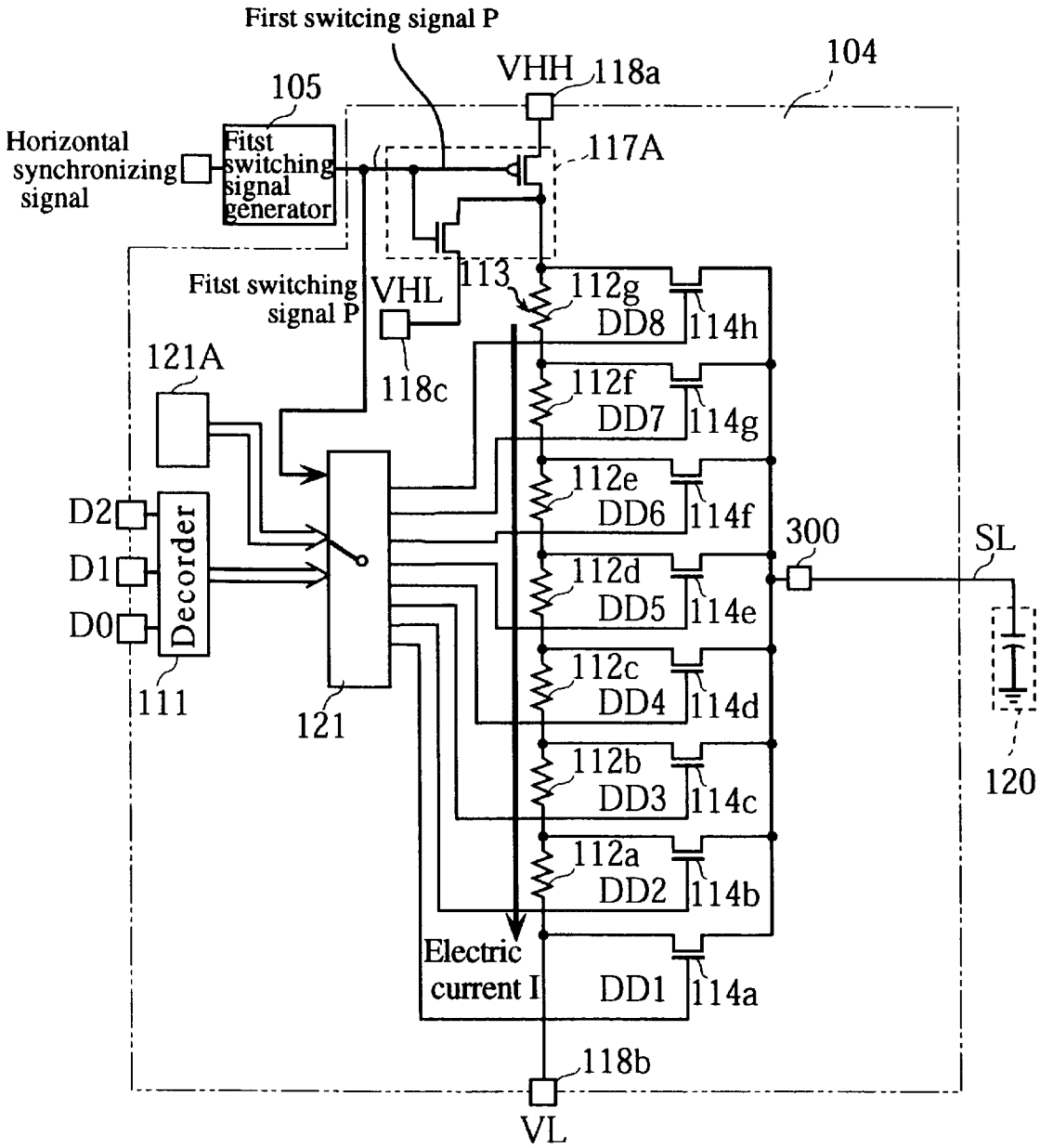
FIG. 16 is a circuit diagram of a DAC incorporated in the LCD driver circuit in accordance with Embodiment 2-4 of the present invention.

FIG. 16 shows the construction of the DAC in Embodiment 2-4. This Embodiment 2-4 has a similar construction to Embodiment 2-3, and the same reference characters are used for the corresponding parts. In this Embodiment 2-4, the signal amplifier element 11 and the output 119, both used in Embodiment 2-3, are eliminated, and instead, a storage circuit 121A and a switch 121 are provided. In the storage circuit 121A, a data where the digital signals DD1 to DD8 are all fixed to be logic "0" is stored. In response to the first switching signal P, during the normal operation period, the switch 121 feeds the digital data DD1 to DD8 to the second switches 114*a* to 114*h*, and during the low power period T2, the switch 121 feeds the fixed data from the storage circuit 121A to the second switches 114*a* to 114*h*. As a result, during the normal operation period T1, the second switches 114*a* to 114*h* are controlled by the digital data DD1 to DD8 from the decoder 111, and a desired driving voltage is thereby obtained. During the low power period T2, all the second switches 114*a* to 114*h* are turned OFF by the fixed data, making the output impedance of the DAC high, and therefore the potential of the capacitive load 120 is retained. The above-described construction, wherein the second switches 114*a* to 114*h* are provided in place of the output switch 119 and have the function of the output switch 119, is also capable of preventing a potential variation of the capacitive load 120 during the low power period T2.

(Embodiment 2-5)

Figure 17:
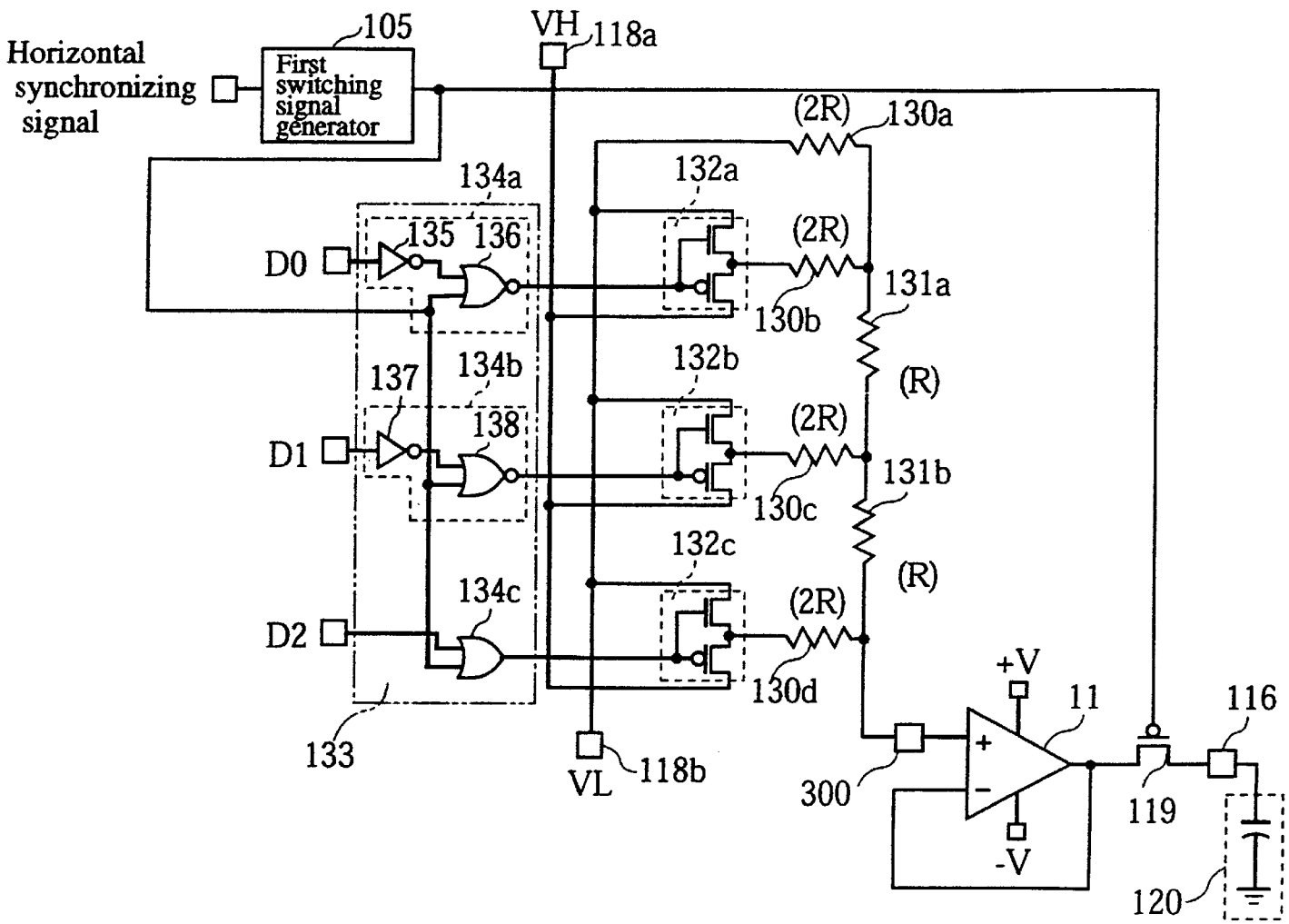
FIG. 17 is a circuit diagram of a DAC incorporated in the LCD driver circuit in accordance with Embodiment 2-5 of the present invention.
Figure 18:
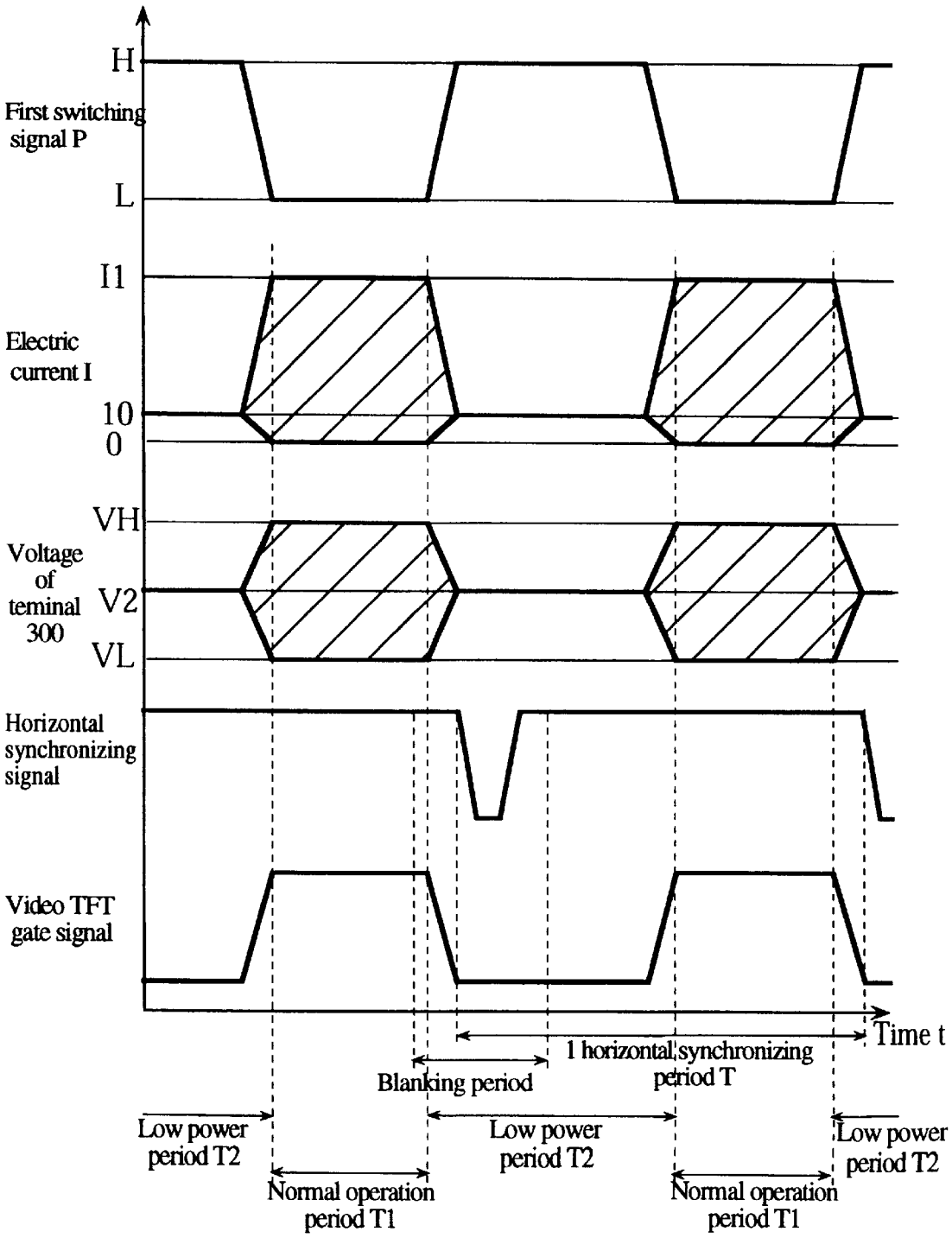
FIG. 18 is a timing chart of a DAC incorporated in the LCD driver circuit in accordance with Embodiment 2-5 of the present invention.

FIG. 17 illustrates the construction of a DAC in Embodiment 2-5, and FIG. 18 is a timing chart thereof. This DAC is an R-2R ladder type digital-to-analog converter circuit employing two types of resistance elements, one with a resistance value R, the other with a resistance value 2R. The DAC comprises resistance elements 130*a*, 130*b*, 130*c*, 130*d*, 131*a*, and 131*b*, fourth switches 132*a*, 132*b*, and 132*c*, and a second switching signal generator circuit 133. The fourth switches 132*a*, 132*b*, and 132*c* are provided for each bit of digital input data and alternatively select one connecting state between a connecting state to a high voltage power supply terminal 118*a* and a connecting state to a low voltage power supply terminal 118*c*. The second switching signal generator circuit 133 outputs a second switching signal for switching each fourth switch 132*a*, 132*b*, and 132*c*.

Each resistance value of the resistance elements 130*a* 130*b*, 130*c*, and 130*d* is 2R, while the resistance value of the resistance elements 131*a* and 131*b* is R. Each of the fourth switches 132*a*, 132*b*, and 132*c* is composed of an n-channel transistor and a p-channel transistor, and serves to determine the output voltage from the DAC.

The second switching signal generator circuit 133 comprises gates 134*a* to 134*c*. The gate 134*a* comprises an inverter 135 and a NOR gate 136. The inverter 135 inverts a digital input D0 and outputs the inverted data. An output signal from the inverter 135 and the first switching signal P are inputted to the NOR gate 136, and the NOR gate 136 outputs the second switching signal to the fourth switch 132*a*. The gate 134*b* has a similar construction to the gate 134*a*, and it comprises an inverter 137 and a NOR gate 138. The inverter 137 inverts a digital input D1 and outputs the inverted data. An output signal from the inverter 137 and the first switching signal P are inputted to the NOR gate 138, and the NOR gate 138 outputs the second switching signal to the fourth switch 132*b*. The gate 134*c* comprises an OR gate. A digital input D2 and the first switching signal P are inputted to the gate 134*c* and the gate 134*c* outputs the second switching signal to the fourth switch 132*c*.

Having the construction as described above, an output from the gate 134*a* is, regardless of whether the digital input D0 is logic "1" or logic "0", fixed at a low level during the low power period T2, in which the first switching signal is high-level. Likewise, an output from the gate 134*b* is, regardless of whether the digital input D1 is logic "1" or logic "0", fixed at low level during the low power period T2, in which the first switching signal is high-level. Further, an output from the gate 134*c* is, regardless of whether the digital input D2 is logic "1" or logic "0", fixed at high level throughout the low power period T2, in which the first switching signal is high-level.

By contrast, during the normal operation period T1, in which the first switching signal P is low-level, the output from each gate 134*a* to 134*c* changes according to the logic level of the digital inputs D0 to D2. Therefore, the fourth switches 132*a* to 132*c* are made to have a switching state corresponding to the digital input D0 to D2 by the second switching signals from the gates 134*a* to 134*c*. As a result, a desired output voltage is applied to an output terminal 116.

It is to be noted that during the low power period T2, only the output from the 134*c* is high-level, and the outputs from the gate 134*a* and the gate 134*b* are low-level. That is, the outputs from the gates 134*a* to 134*c* are the identical to an input Data 5 (D2: "1", D1: "0", D0: "0"), which is described later, in the normal operation period T1, in which the first switching signal P is low-level.

In Table i below, there is shown a comparison between input data and electric currents I flowing in the resistance element network.

TABLE 1

| Data No. | D2 | D1 | D0 | Current value |
|---|---|---|---|---|
| Data 1 | 0 | 0 | 0 | 0 |
| Data 2 | 0 | 0 | 1 | 0.328 (VH - VL)/R |
| Data 3 | 0 | 1 | 0 | 0.3125 (VH - VL)/R |
| Data 4 | 0 | 1 | 1 | 0.4531 (VH - VL)/R |
| Data 5 | 1 | 0 | 0 | 0.25 (VH - VL)/R |
| Data 6 | 1 | 0 | 1 | 0.4531 (VH - VL)/R |
| Data 7 | 1 | 1 | 0 | 0.3125 (VH - VL)/R |
| Data 8 | 1 | 1 | 1 | 0.328 (VH - VL)/R |

As seen in Table 1, it is in the case of Data 6 (D2: "1", D1: "0", D0: "0") that the electric current I becomes the least value except in the case of the input data being "0".

Figure 19:
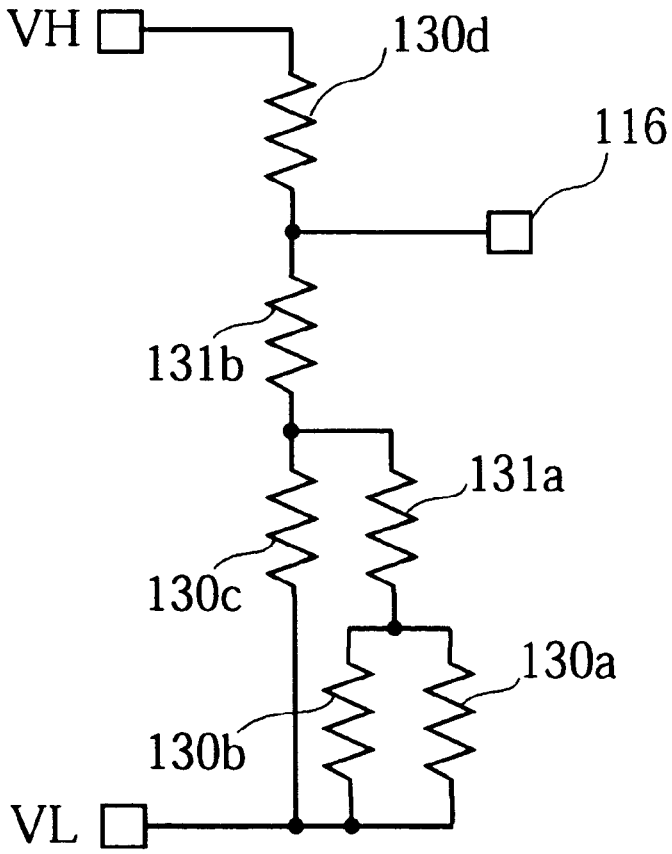
FIG. 19 is a diagram showing the equivalent circuit of a DAC in the case of the input data being a sixth input data.

Now referring to the timing chart of FIG. 18, there is explained the power saving system of the DAC having the aforementioned construction. During the normal operation period T1, the first switching signal P is low-level, the fourth switches 132*a* to 132*c* are controlled in accordance with the input data D0 to D2, and the electric current I flowing between the power supply terminal 118*a* and 118*b* becomes an electric current value between "0" and I1 corresponding to the input data. The voltage at the output terminal 300 becomes a value between VL and VH corresponding to the input data. During the low power period, the first switching signal P becomes high-level and masks the gates 134*a* to 134*c*, and thereby the fourth switches 132*a* to 132*c* are set so as to result in Data 6. As a result, the electric current I becomes I0, and the voltage at the output terminal 300 becomes a voltage V2, which is the voltage in the case of Data 5 (D2: "1", D1: "0", D0: "0"). Since the equivalent circuit of the DAC in the case of Data 5 is the one shown as the circuit diagram of FIG. 19, it is understood that the voltage V2 is an median potential between VL and VH.

According to Table 1, in the case where the input data is Data 1, the electric current becomes "0", and a consumed electric current thereby becomes the least value. However, the voltage at the output terminal 300 becomes VL, and therefore, in a transition from the low power period T2 to the normal operation period T1, an average time necessary to change the voltage to a desired voltage becomes rather long. On the other hand, as in this embodiment, in the case of employing Data 5 as a fixed data, the electric current can be made the least value except in the case of the input data being Data 1, and the potential at the output terminal 300 results in an approximately median value between VL and VH. Consequently, it is made possible to shorten the average time required for changing the voltage in the transition to the normal operation period T1, and additionally, to reduce a consumed power by a voltage variation.

It is noted that, in an R-2R ladder type DAC as used in this embodiment, the electric current at the median level results in the least value, and that the same effect can be obtained if the number of the input data bits is different from this example.

In this embodiment too, the low power period can be extended to a period in which the period required for making definite the voltage of the capacitive load 120 is excluded from one horizontal synchronizing period.

It is to be noted that, although in the example described above, the input data is fixed to be Data 5 by which the electric current results in the smallest value except in the case of Data 1, the present invention is not limited thereto. The input data may be set to be any input data by which the value of the electric current flowing in the resistance element network results in a smaller value than the median electric current value between the largest and the smallest. As described thus far, the reduction of power consumption can be achieved by employing such input data that can result in a electric current value smaller than the median electric current value, because, when the DAC is driven for a long period of time, the power consumption is made smaller than the average value.

(Embodiment 2-6)

Figure 20:
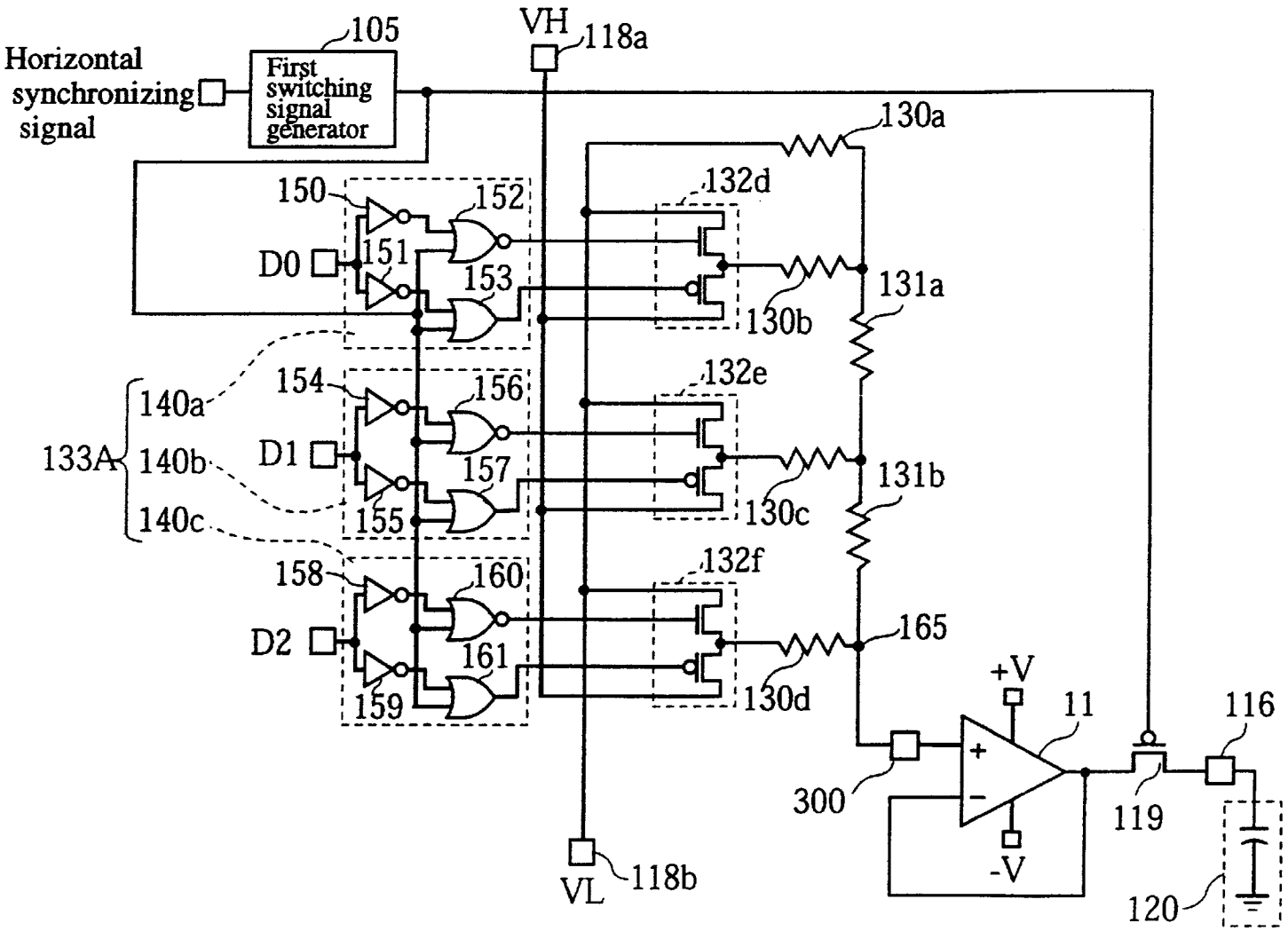
FIG. 20 is a circuit diagram of a DAC incorporated in the LCD driver circuit in accordance with Embodiment 2-6 of the present invention.

FIG. 20 shows the construction of a DAC integrated in a driver circuit of Embodiment 2-6, and FIG. 20 is the timing chart thereof. This Embodiment 2-6 has a similar construction to Embodiment 2-5, and the same reference characters are used for the corresponding parts. In this Embodiment 2-6, a third switching signal generator circuit 133A for generating a third switching signal is employed in place of the second switching generator circuit 133 used in Embodiment 2-5. This third switching signal generator circuit 133A comprises gates 140*a* to 140*c*. The gate 140*a* comprises inverters 150 and 151, a NOR gate 152, and an OR gate 153. The inverters 150 and 151 invert a digital input D0 and output the inverted data. An output signal from the inverter 150 and the first switching signal P are inputted to the NOR gate 152, and the NOR gate 152 outputs the third switching signal to the n-channel TFT of a switch 132*d*. An output signal from the inverter 151 and the first switching signal P are inputted to the OR gate 153, and the OR gate 153 outputs the third switching signal to the p-channel transistor of a switch 132*d*. The gate 140*b* comprises inverters 154 and 155, a NOR gate 156, and an OR gate 157. The inverters 154 and 155 invert the digital input D1 and output the inverted data. An output signal from the inverter 154 and the first switching signal P are inputted to the NOR gate 156, and the NOR gate 156 outputs the third switching signal to the n-channel TFT of a switch 132*e*. An output signal from the inverter 155 and the first switching signal P are inputted to the OR gate 157, and the OR gate 157 outputs the third switching signal to the p-channel transistor of a third switch 132*e*. The gate 140*c* comprises inverters 158 and 159, a NOR gate 160, and an OR gate 161. The inverters 158 and 159 invert the digital input D2 and output the inverted data. An output signal from the inverter 158 and the first switching signal P are inputted to the NOR gate 160, and the NOR gate 160 outputs the third switching signal to the n-channel TFT or a switch 132*f*. An output signal from the inverter 159 and the first switching signal P are inputted to the OR gate 161, and the OR gate 161 outputs the third switching signal to the p-channel transistor of a switch 132*f*.

In this embodiment, as will be described later, controlled by the third switching signal generator circuit 133A, fifth switches 132*d* to 132*f* are connected to either a high voltage power supply VH or a low voltage power supply VL corresponding to the digital input D0 to D2 during the normal operation period T1, and a desired driving voltage can be thus obtained.

During the low power period T2, since the first switching signal P is high-level, the output from the NOR gate 152 (which corresponds with the third switching signal) becomes low-level regardless of the logic level of the digital input D0. Likewise, the output from the OR gate 153 (which corresponds with the third switching signal) becomes high-level regardless of the logic level of the digital input D1. As a result, the fifth switch 132*d* is cut off from both the power supplies VH and VL. In a similar manner, the output from the NOR gate 156 (which corresponds with the third switching signal) is fixed at low level, and the output from the OR gate 157 (which corresponds with the third switching signal) is fixed at high level. As a result, the fifth switch 132*e* is cut off from both the power supplies VH and VL. Further, the output from the NOR gate 160 (which corresponds with the third switching signal) is fixed at low level, and the output from the OR gate 161 (which corresponds with the third switching signal) is fixed at high level. As a result, the fifth switch 132*f* is cut off from both the power supply VH and VL. Thus, the electric current flowing in the resistance elements in the DAC results in "0", and the reduction in power consumption can be achieved.

Figure 21:
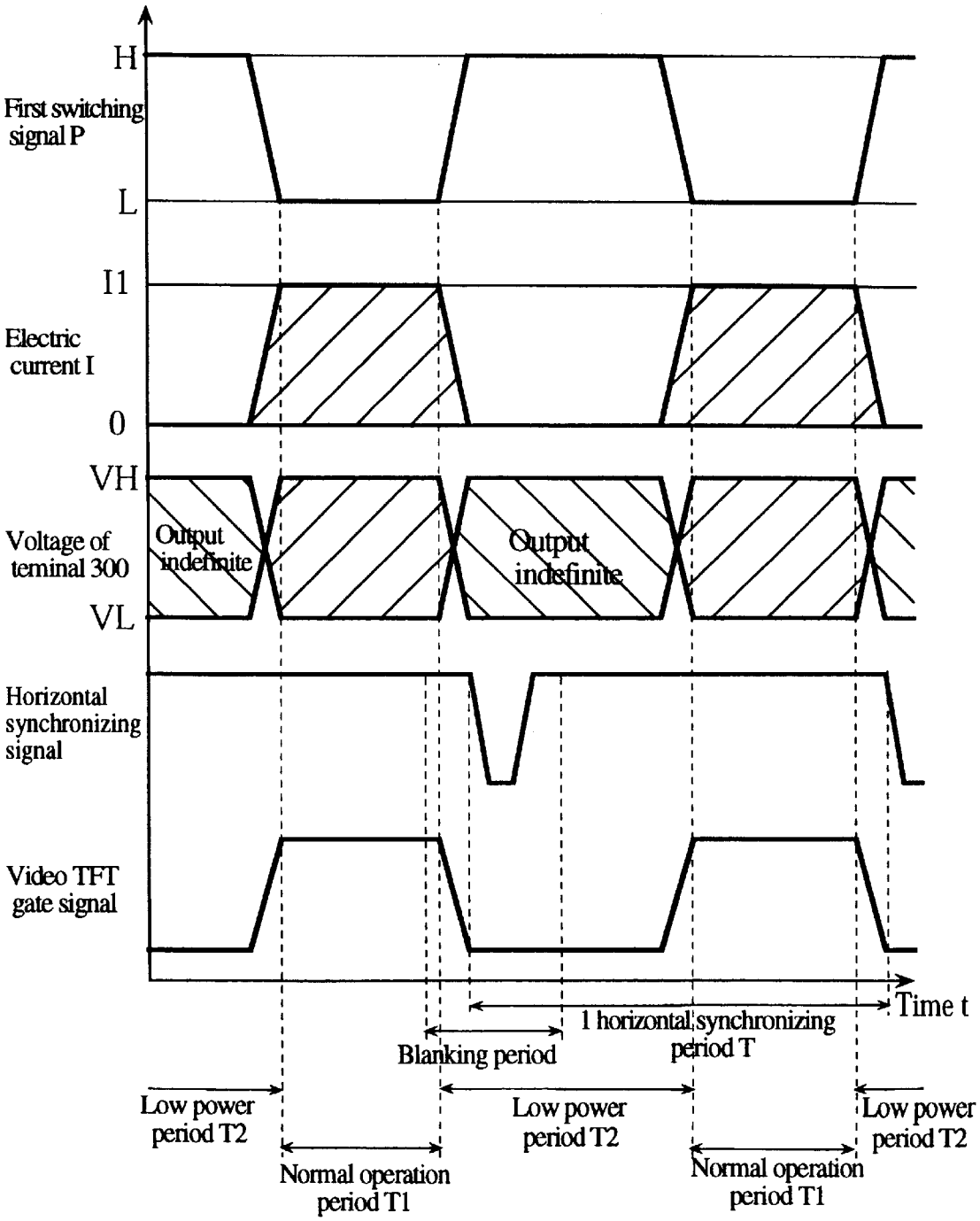
FIG. 21 is a timing chart of a DAC incorporated in the LCD driver circuit in accordance with Embodiment 2-6 of the present invention.

Referring now to the timing chart of FIG. 21, there is explained the power saving system of the DAC having the above-described construction. During the normal operation period T1, the first switching signal P is low-level, the fifth switches 132*d* to 132*f* are controlled in response to the input data D0 to D2, and thereby the electric current I flowing in the resistance element network becomes an electric current value between "0" and I1 corresponding to the input data. The voltage at the output terminal 300 becomes a voltage value between VH and VL corresponding to the input data.

During the low power period T2, the first switching signal P is made to be high-level, and the fifth switches 132*d* to 132*f* are cut off from both the power supplies VL and VH. Therefore no power is supplied to the DAC, and a consumed power and a consumed current become "0". The voltage at the output terminal 300 becomes indefinite.

An output terminal 116 is cut off by an output switch 119, and thereby the potential at the output terminal 116 is retained by the capacitive load 120.

In this embodiment too, the low power period can be extended to a period in which the period required for making definite the voltage of the capacitive load 120 is excluded from one horizontal synchronizing period.

(Embodiment 2-7)

Figure 22:
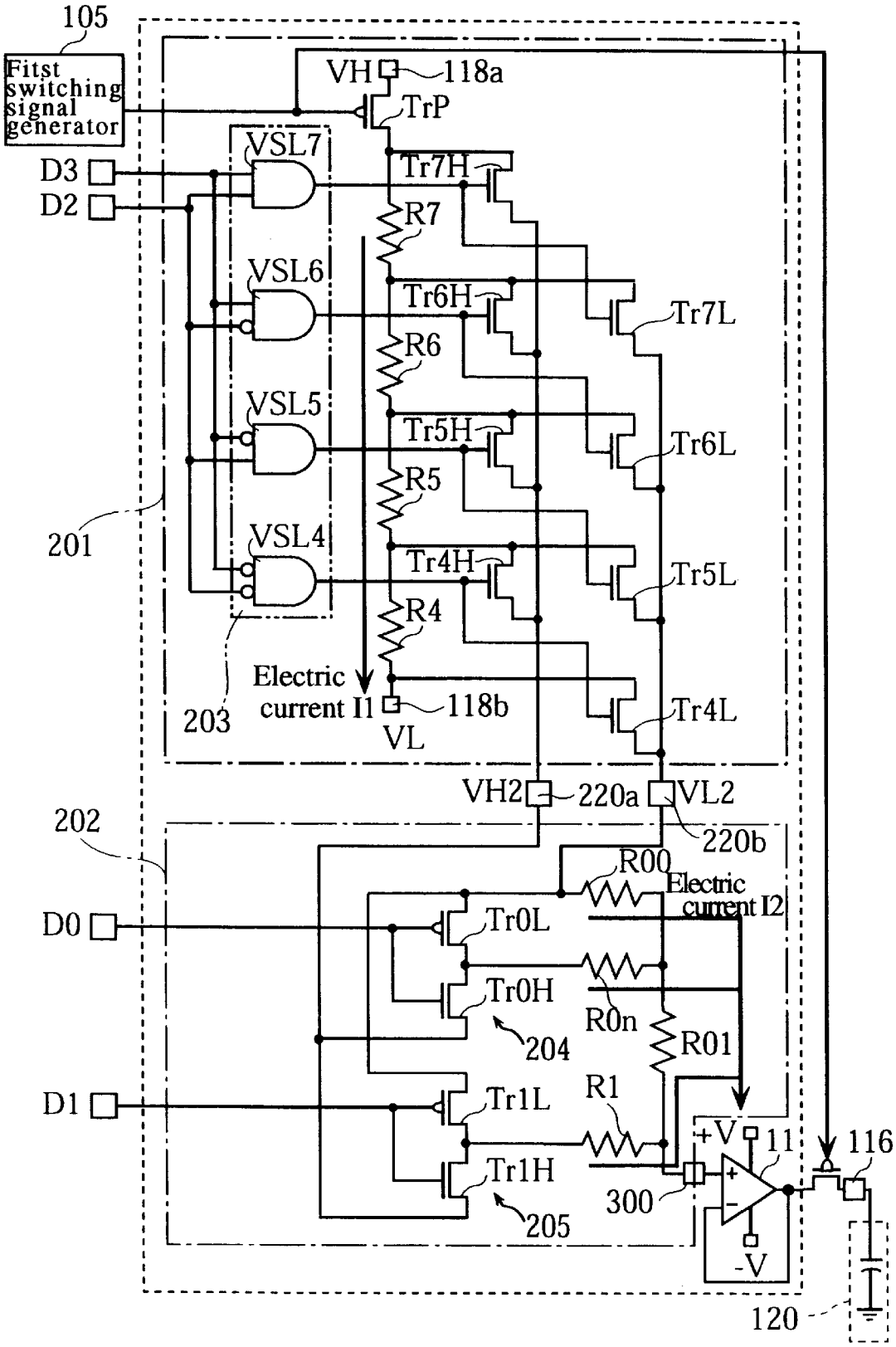
FIG. 22 is a circuit diagram of a DAC incorporated in the LCD driver circuit in accordance with Embodiment 2-7 of the present invention.
Figure 23:
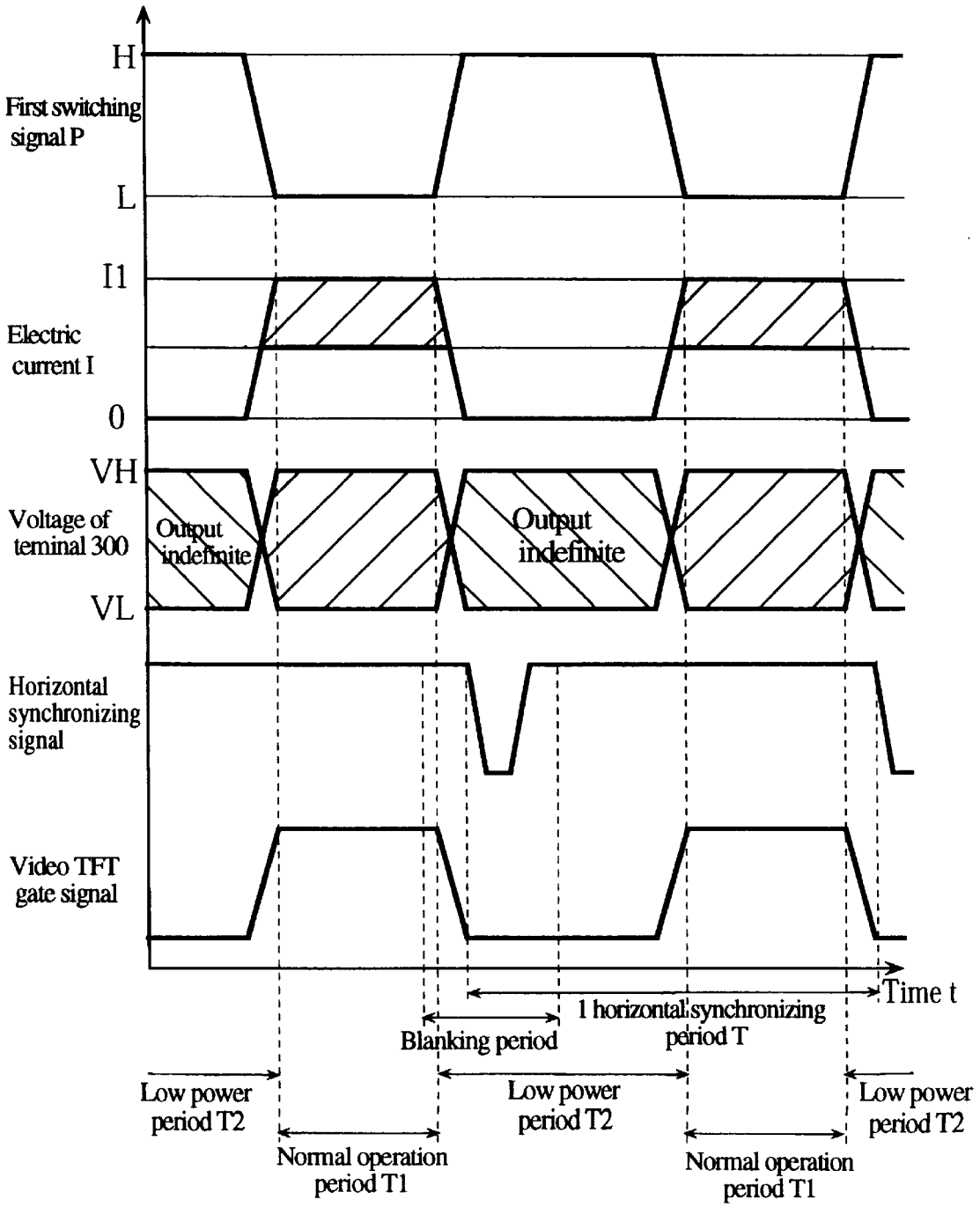
FIG. 23 is a timing chart of a DAC incorporated in the LCD driver circuit in accordance with Embodiment 2-7 of the present invention.

FIG. 22 is a circuit diagram showing the construction of the DAC of Embodiment 2-7, and FIG. 23 is the timing chart thereof. This Embodiment 2-7 has a similar construction to Embodiment 2-1, and the same reference characters are used for the corresponding parts. This Embodiment 2-7 differs from Embodiment 2-1 in that the DAC is composed of two digital-to-analog converter circuit sections. Now Embodiment 2-7 is detailed hereinafter. The DAC comprises a first DAC section 201 composed of a potentiometer type DAC and a second DAC section 202 composed of an R-2R ladder type DAC. The first DAC section 201 operates in response to more significant bits D2 and D3 of digital video input data. The second DAC section 202 comprises a first connecting terminal 220*a* which receives a higher voltage output from the first DAC section 201 and a second connecting terminal 220*b* which receives a lower voltage output from the first DAC section 201. The second DAC section 202 uses a voltage between the first connecting terminal 220*a* and the second connecting terminal 220*b*, and operates in response to lesser significant bits D0 and D1 of the digital video input data. Hereinafter, the voltage of the first connecting terminal 220*a* is referred to as VH2 and the voltage of the second connecting terminal 220*b* is referred to as VL2.

The first DAC section 201 comprises resistance elements R4 to R7, a sixth switch TrP, seventh switches Tr4H to Tr7H, eighth switches Tr4L to Tr7L, and a selective circuit 203. The selective circuit 203 decodes the more significant bits D2 and D3, and controls the seventh switches Tr4H to Tr7H and the eighth switches Tr4L to Tr7L by the decoded digital signals. The aforementioned sixth switch TrP is connected between the resistance element R7 and a power supply terminal 118*a*. In response to the first switching signal P, the sixth switch TrP is turned to ON state during the normal operation period T1 and OFF state during the low power period. Each seventh switch Tr4H to Tr7H is respectively connected between each connecting point of the resistance elements R4 to R7 and the first connecting terminal 220*a*, and each eighth switch Tr4L to Tr7L is respectively connected between each connecting point of the resistance elements R4 to R7 and the second connecting terminal 220*b*. The aforementioned resistance element R01 has a resistance value of r1, and the resistance elements R00, R0, and R1 have a resistance value of r2. The second DAC section 202 comprises resistance elements R0, R1, R00, and R01, and ninth switches 204 and 205 for alternatively selecting one connecting state between a connecting state to the first connecting terminal 220*a* and a connecting state to the second connecting terminal 220*b* in response to the lesser significant bits D0 and D1. The ninth switch 204 comprises a p-channel TFT Tr0L and a p-channel TFT Tr0H, and the ninth switch 205 comprises a p-channel TFT Tr1L and a p-channel TFT Tr1H.

An electric current I which is consumed in all the resistance elements in a DAC having such a construction is represented by the sum of an electric current I1 which flows in the resistance element R4 to R7 in the first DAC section 201 and an electric current I2 which flows in the resistance elements R0, R1, R00, and R01 in the second DAC section 202. That is, I=I1+I2.

In this case, regardless of the input data D2 and D3, the electric current I1 is I1=(VH−VL)/(R7+R6+R5+R4). It is noted that, for the sake of convenience in illustration, each of the resistance values of the resistance elements R4 to R7 is represented by R4, R5, R6, and R7, respectively. Now, on the other hand, the electric current I2 varies according to the input data, as shown in Table 2 below, the minimum value being "0" and the maximum value being I2max=0.3125·(VH2−VL2)max/r1.

TABLE 2

| Data No. | D1 | D0 | Electric current value |
|---|---|---|---|
| Data 1 | 0 | 0 | 0 |
| Data 2 | 0 | 1 | 0.3125 (VH - VL)/R |
| Data 3 | 1 | 0 | 0.25 (VH - VL)/R |
| Data 4 | 1 | 1 | 0.3125 (VH - VL)/R |

The operation of the above-mentioned circuit is now detailed now. During the normal operation period T1, the first switching signal P is low-level and the sixth switch TrP is turned to ON state. As a consequence, the electric current I is set at an electric current value between I1 and I0 (I0=I1+I2max) corresponding to a logic level of each of the input data D0 to D3. The potential of the output terminal 300 becomes a value corresponding to the input data D0 to D3 within the range between VL and VH.

During the low power period T2, the first switching signal P is switched to high level, and the sixth switch TrP is thereby turned to OFF state. As a result, the power supply VH is cut off, and the electric current I becomes "0", achieving the reduction of power consumption during the low power period T2. The potential at the output terminal 300 is indefinite, and the potential of the capacitive load 120 does not vary because the output switch 119 is turned OFF.

The reduction in power consumption is thus achieved by cutting off the power supply of the first DAC section 201, which is a voltage potentiometer type DAC allotted for more significant bits.

(Embodiment 2-8)

Figure 24:
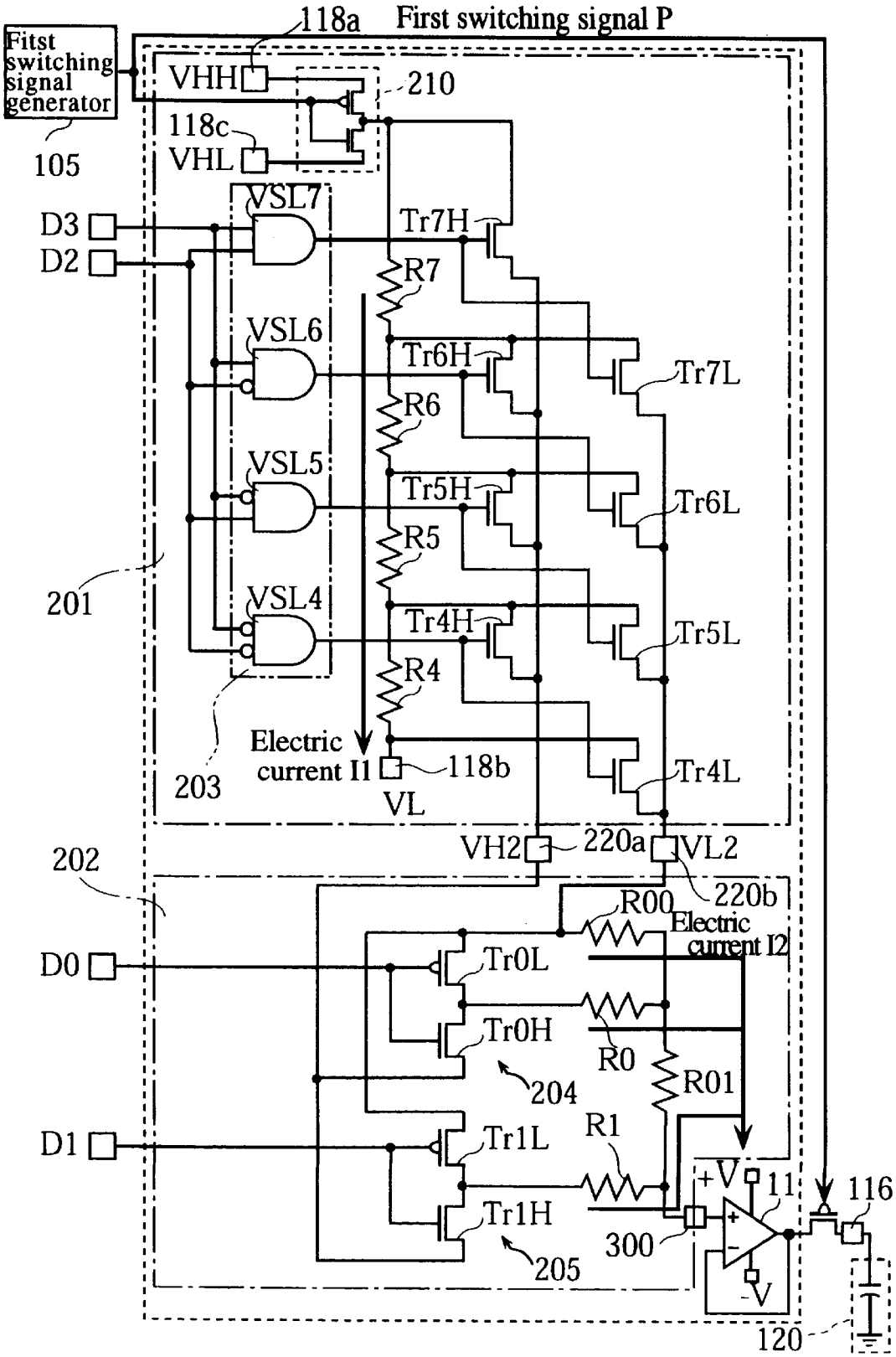
FIG. 24 is a circuit diagram of a DAC incorporated in the LCD driver circuit in accordance with Embodiment 2-8 of the present invention.
Figure 25:
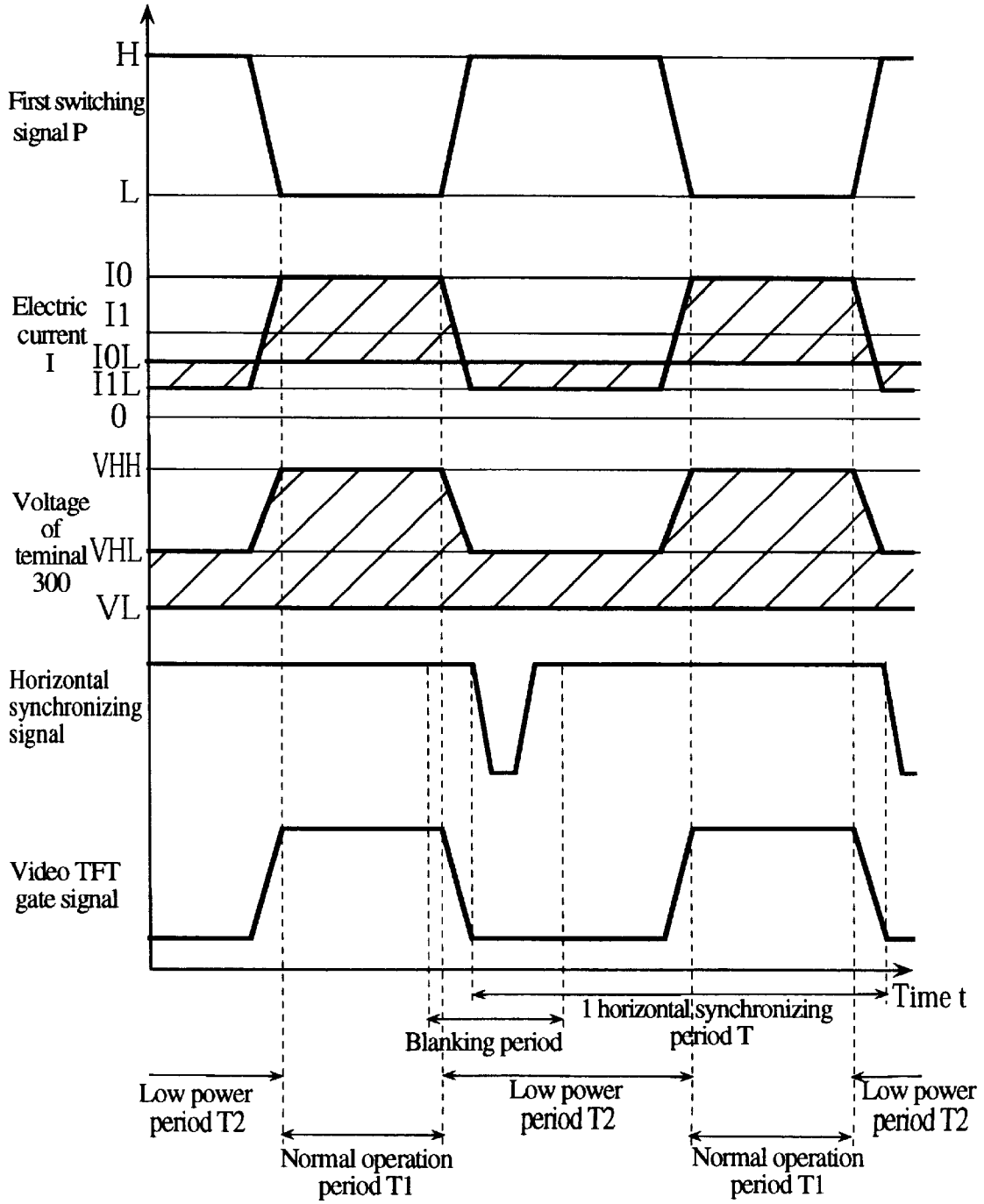
FIG. 25 is a timing chart of a DAC incorporated in the LCD driver circuit in accordance with Embodiment 2-8 of the present invention.

FIG. 24 is a circuit diagram showing the construction of the DAC of Embodiment 2-8, and FIG. 25 is the timing chart thereof. This Embodiment 2-8 has a similar construction to Embodiment 2-7, and the same reference characters are used for the corresponding parts. This Embodiment 2-8 employs a tenth switch 210 for alternatively selecting either a first high voltage power supply VHH or a second high voltage power supply VHL having a lower voltage level than the first high voltage power supply VHH, in place of the sixth switch TrP used in Embodiment 2-7. This tenth switch 210 is composed of an n-channel TFT and a p-channel TFT, and the first switching signal P is fed to each gate of the n-channel TFT and the p-channel TFT. Thereby, in the case of the first switching signal P being high-level, i.e. during the low power period T2, the second high voltage power supply VHL is selected, while in the case of the first switching signal P being low-level, i.e., during the normal operation period T1, the first high voltage power supply VHH is selected.

The operation of the DAC having the aforementioned construction is explained hereinafter. An electric current I consumed in all the resistance elements in the DAC is represented by the sum of an electric current I1 which flows in the resistance elements in the first DAC section 201 allotted for the more significant bits and an electric current I2 which flows in the resistance elements in the second DAC section 202 allotted for the lesser significant bits. That is, I=I1+I2.

During the normal operation period T1, regardless of the input data, the electric current I1 becomes I1=(VHH−VL)/(R7+R6+R5+R4). On the other hand, the electric current I2 varies according to the input data, as shown in the above Table 2, the minimum value being "0" and the maximum value being I2max=0.3125·(VHH2−VL2)max/r1, where r1 is a resistance value of the resistance element R01. Therefore, the electric current I varies within the range between I1 and I0 (I0=I1+I2max).

During the low power period T2, regardless of the input data, the electric current I1 becomes I1=(VHL−VL)/(R7+R6+R5+R4). I2max also becomes lower since (VH2−VL2)max becomes lower. In this case, when I1L=(VHL−VL)/(R7+R6+R5+R4) and 10L=I1L+I2max, the electric current I1 varies within the range between I1L and I0L. Hence, the reduction of power consumption during the low power period T2 can be achieved.

During the normal operation period T1, the voltage at the output terminal 300 is a potential between VL and VHH. However, during the low power period T2, it becomes a potential between VL and VH. For this reason, a source line is cut off by making the output switch 119 OFF so that the potential of the capacitive load 120 is retained.

The reduction in power consumption is thus achieved by selecting the power supplies of the first DAC section 201, which is a voltage potentiometer type DAC allotted for more significant bits.

(Embodiment 2-9)

Figure 26:
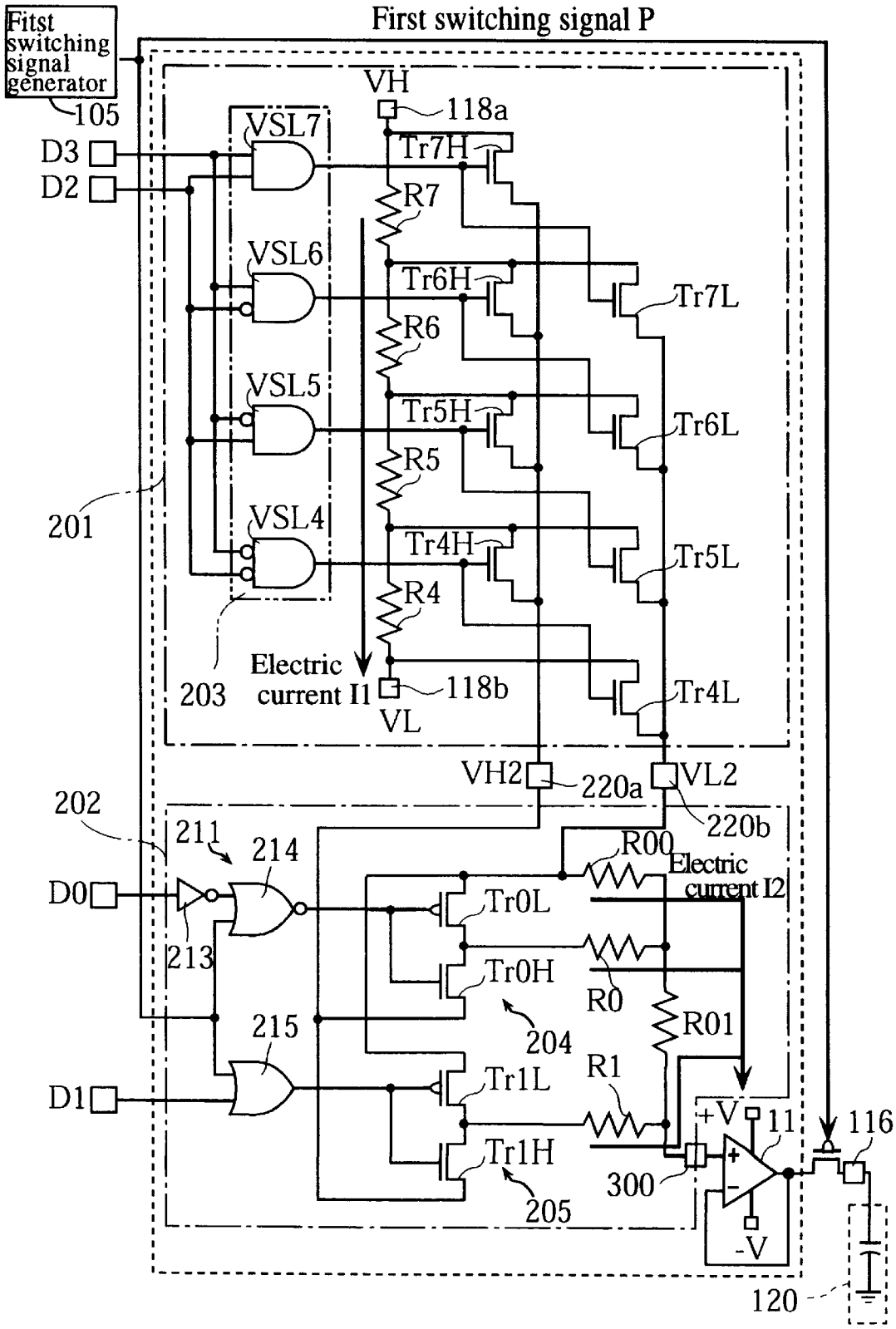
FIG. 26 is a circuit diagram of a DAC incorporated in the LCD driver circuit in accordance with Embodiment 2-9 of the present invention.
Figure 27:
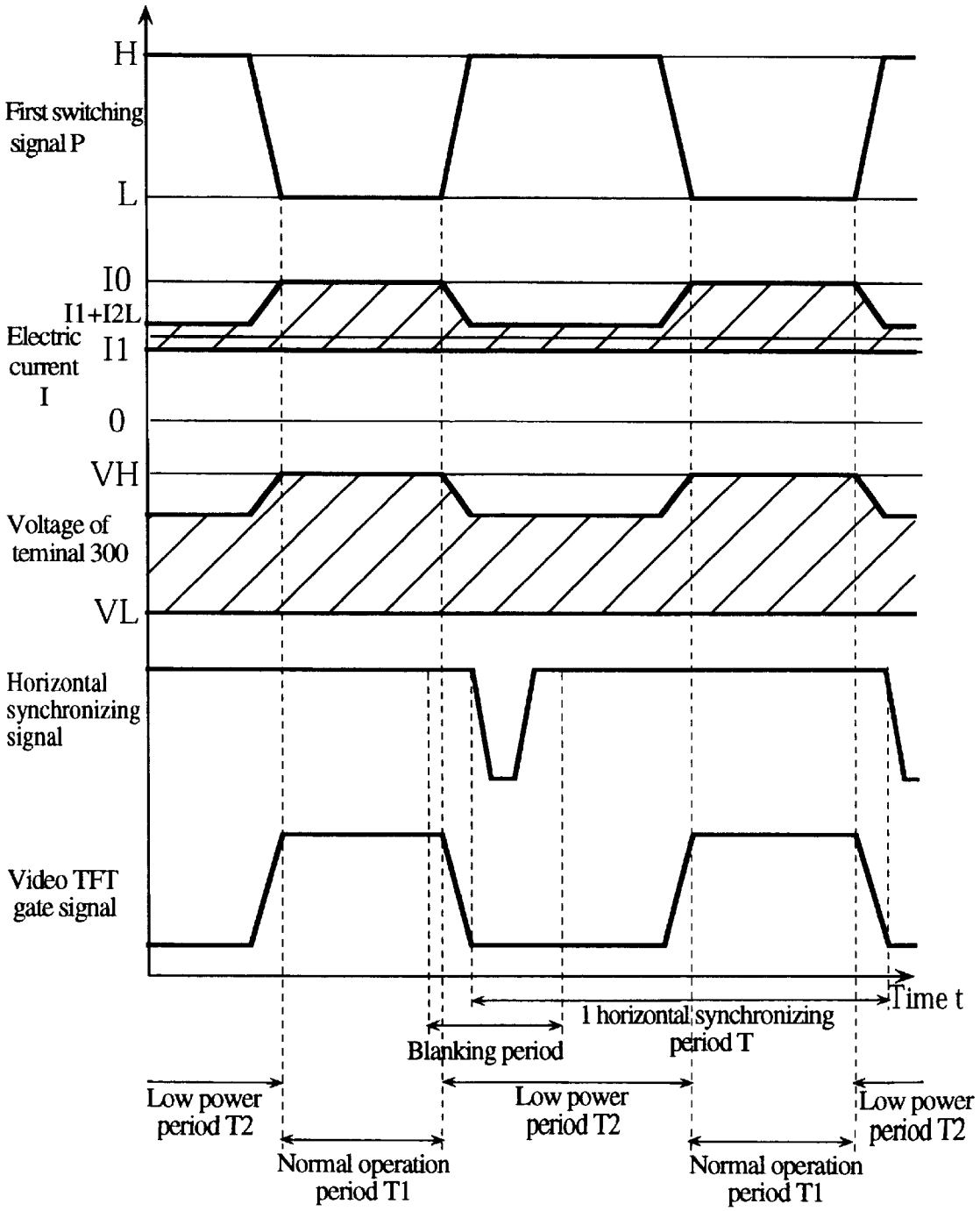
FIG. 27 is a timing chart of a DAC incorporated in the LCD driver circuit in accordance with Embodiment 2-9 of the present invention.

FIG. 26 is a circuit diagram showing the construction of the DAC of Embodiment 2-9, and FIG. 27 is the timing chart thereof. This Embodiment 2-9 has a similar construction to Embodiment 2-8, and the same reference characters are used for the corresponding parts. In this Embodiment 2-9, the switch 210 for switching the power supply used in Embodiment 2-8 is eliminated. Instead, in the second DAC section 202, a fourth switching signal generator circuit 211 is provided. The fourth switching signal generator circuit 211 generates a fourth switching signal for controlling switching states of ninth switches 204 and 205, and outputs the fourth switching signal to the ninth switches 204 and 205. The fourth switching signal generator circuit 211 comprises an inverter 213, a NOR gate 214, and an OR gate 215. A bit D0 is inputted to the inverter 213. The output signal from the inverter 213 and the first switching signal P are inputted to the NOR gate 214, and the NOR gate 214 outputs the fourth switching signal to a p-channel TFT Tr0L and an n-channel TFT Tr0H. A bit D1 and the first switching signal P is inputted to the OR gate 215, and the OR gate 215 outputs the fourth switching signal to a p-channel TFT Tr1L and an n-channel TFT Tr1H. Having such a construction, during the normal operation period T1, the fourth switching signal generator circuit 211 outputs the fourth switching signal corresponding to digital video input data. By contrast, during the low power period T2, it fixes the lesser significant bits D0 and D1 of the digital video data to be a fixed data which results in the second least electric current value among the electric current values in the resistance element network, and outputs the fixed input data as the fourth switching signal.

The operation of the DAC having the aforementioned construction is explained hereinafter. An electric current I consumed in all the resistance elements in the DAC is represented by the sum of an electric current I1 which flows in the resistance elements in the first DAC section 201 and an electric current I2 which flows in the resistance elements in the second DAC section 202. That is, I=I1+I2.

In this case, regardless of the input data, the electric current I1 is I1=(VH−VL/(R7+R6+R5+R4). On the other hand, the electric current I2 varies according to the input data, as shown in the above Table 2, the minimum value being 0 and the maximum value being I2max=0.3125(VH2−VL2)max/r1.

During the normal operation period T1, the electric current I varies within the range between I1 and I0 (=I1+I2max). The potential of the terminal 300 is within the range between VL and VH.

During the low power period T2, the data D0 is masked to be "0" and the data D1 is masked to be "1". As a result, the electric current I2 becomes I2=0.25·(VH2−VL2)/r1. Naturally, I2 can be made smaller when the both data D0 and D1 are "0". However, in an R-2R ladder type DAC, the electric current becomes the second least when only the data D1 is fixed to be "1", and the output voltage can be more quickly changed to the desired voltage in a transition to the normal operation period T1 by giving a certain potential to each contact point in the circuit. It is noted that during the low power period T2, the potential of the capacitive load 120 does not vary since the output switch 119 is turned OFF.

The reduction of power consumption is thus achieved by switching the input data of the second DAC section, which is an R-2R ladder type DAC allotted for lesser significant bits.

(Embodiment 2-10)

Figure 28:
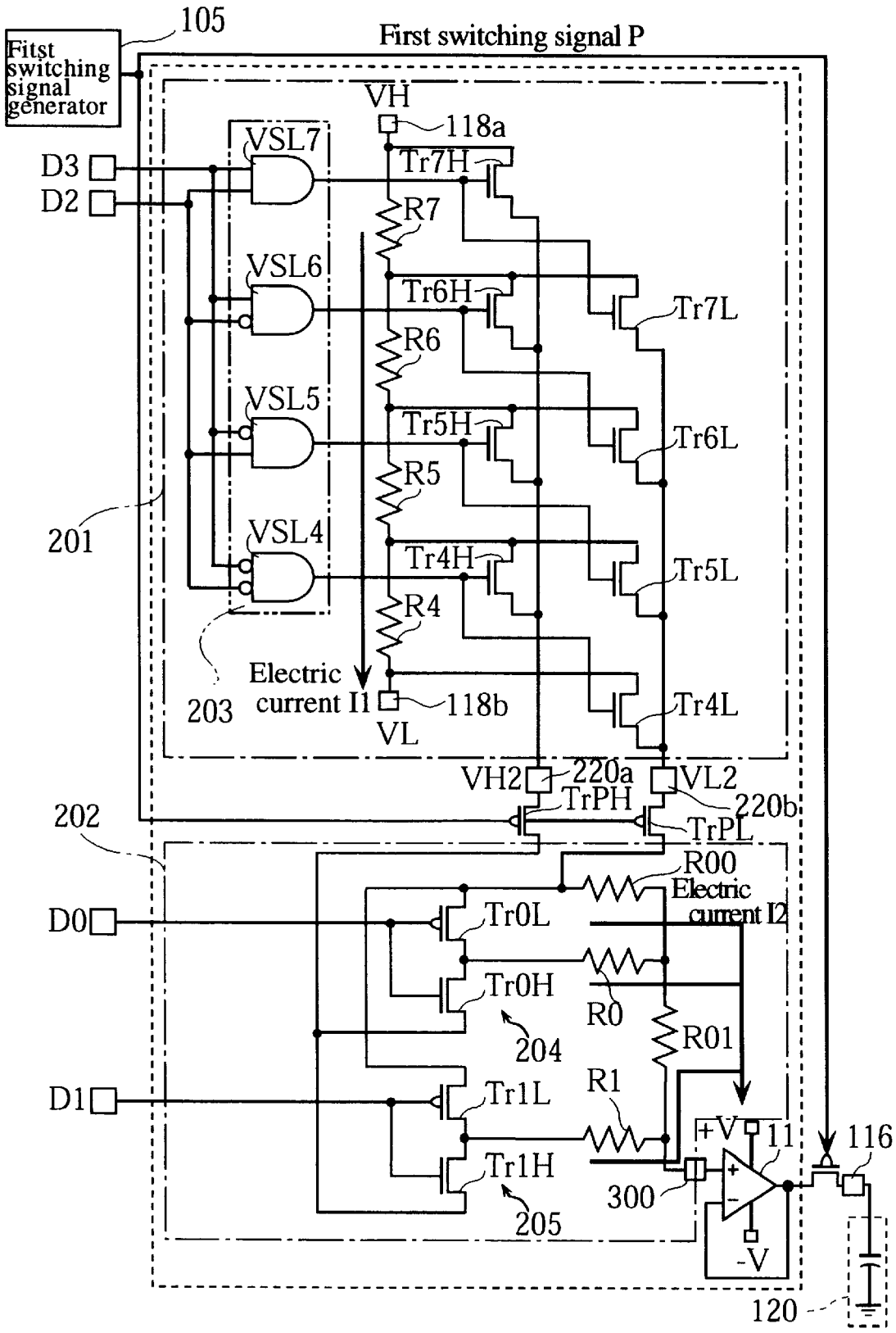
FIG. 28 is a circuit diagram of a DAC incorporated in the LCD driver circuit in accordance with Embodiment 2-10 of the present invention.
Figure 29:
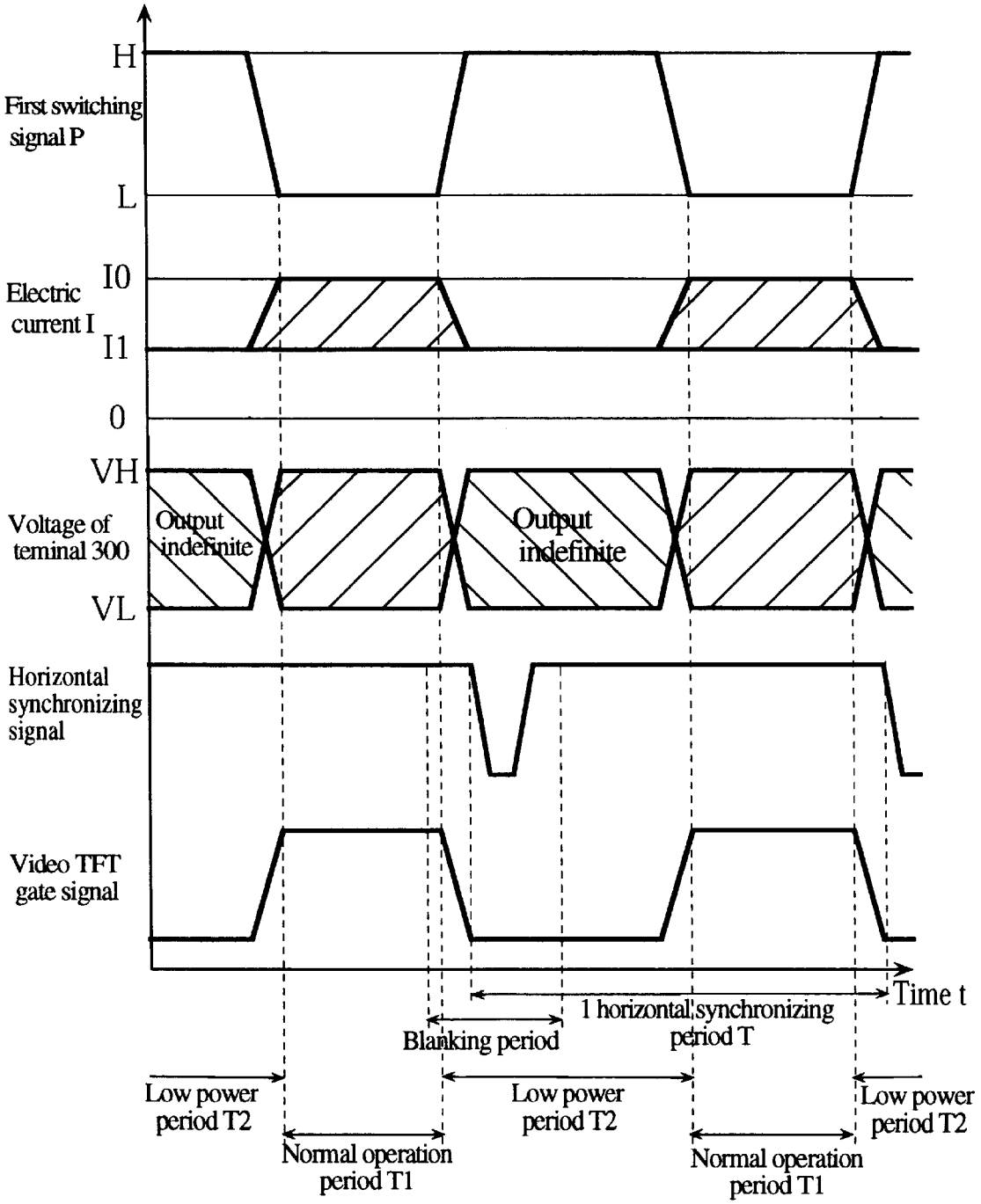
FIG. 29 is a timing chart of a DAC incorporated in the LCD driver circuit in accordance with Embodiment 2-10 of the present invention.

FIG. 28 is a circuit diagram showing the construction of the DAC of Embodiment 2-10, and FIG. 29 is the timing chart thereof. This Embodiment 2-10 has a similar construction to Embodiment 2-7, and the same reference characters are used for the corresponding parts. In this Embodiment 2-9, the sixth switch TrP used in Embodiment 2-7 is eliminated. On the other hand, an eleventh switch TrPH is provided between the first connecting terminal 220*a* and an input of the second DAC section 202, and a twelfth switch TrPL is provided between the second connecting terminal 220*b* and an input of the second DAC section 202. The ON/OFF states of the eleventh switch TrPH and the twelfth switch TrPL are controlled by the first switching signal P.

The operation of the DAC having the aforementioned construction is explained hereinafter. An electric current I consumed in all the resistance elements in the DAC is represented by the sum of an electric current I1 which flows in the resistance elements in the first DAC section 201 allotted for the more significant bits and an electric current I2 which flows in the resistance elements in the second DAC section 202 allotted for the lesser significant bits. That is, I=I1+I2.

Regardless of the input data, the electric current I1 is I1=(VH−VL)/(R7+R6+R5+R4). On the other hand, the electric current I2 varies according to the input data, as shown in the above Table 2, the minimum value being "0" and the maximum value being I2max=0.3125(VH2−VL2)max/r1 in the case of two-bit data.

During the normal operation period T1, the electric current I varies within the range between I1 and I0 (=I1+I2max). During the low power period T2, the eleventh switch TrPH and the twelfth switch are turned OFF, and the electric current I2 thereby results in I2=0, and consequently the electric current I becomes I=I1.

The potential of the terminal 300 is within the range between VL and VH during the normal operation period T1, and it becomes indefinite during the low power period T2. The potential of the capacitive load 120 does not vary during the low power period T2 since the output switch 119 is turened OFF.

The reduction of power consumption is thus achieved by cutting off the power supply of the second DAC section, which is an R-2R ladder type DAC allotted for lesser significant bits.

(Embodiment 2-11)

Figure 30:
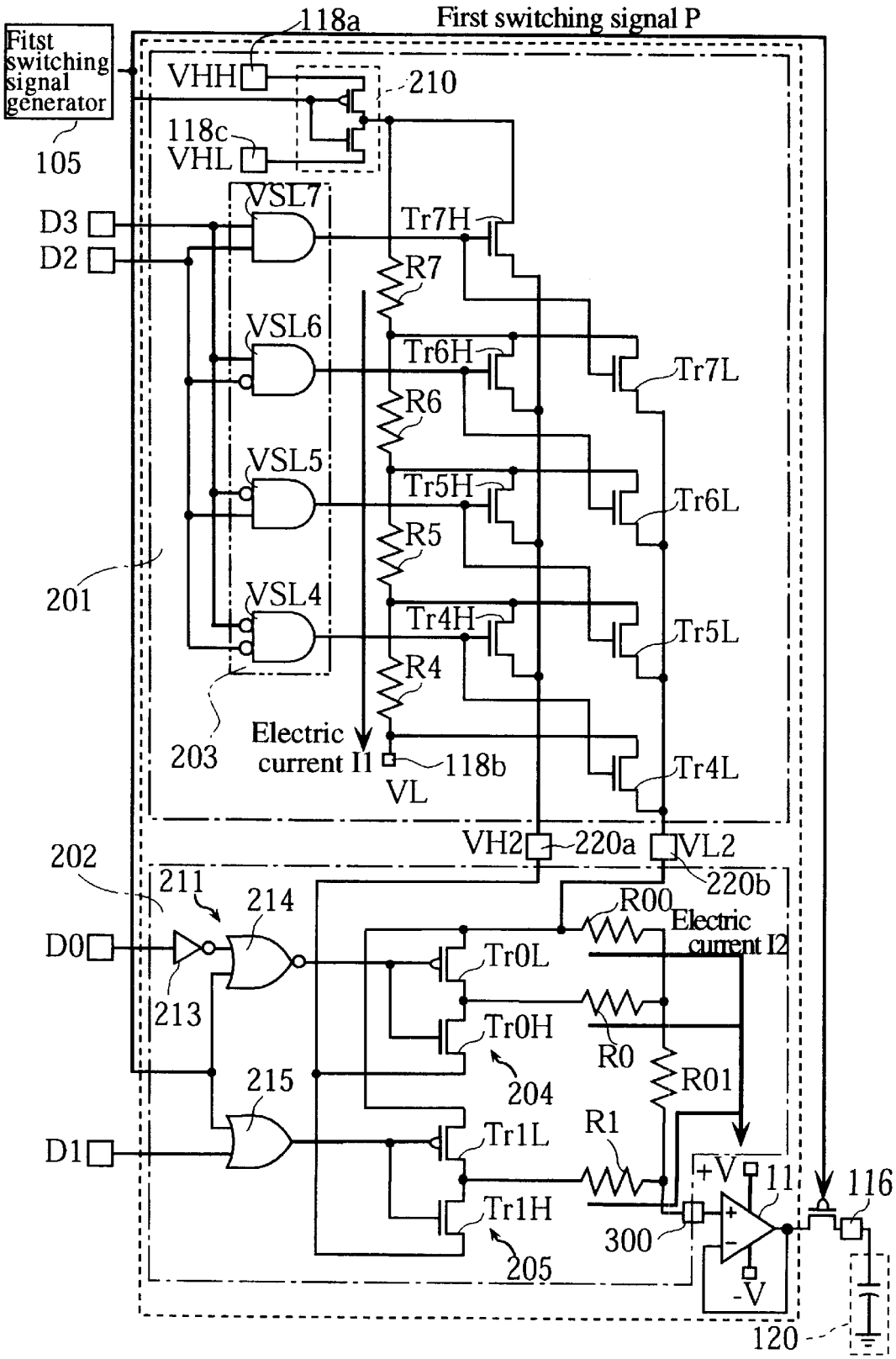
FIG. 30 is a circuit diagram of a DAC incorporated in the LCD driver circuit in accordance with Embodiment 2-11 of the present invention.
Figure 31:
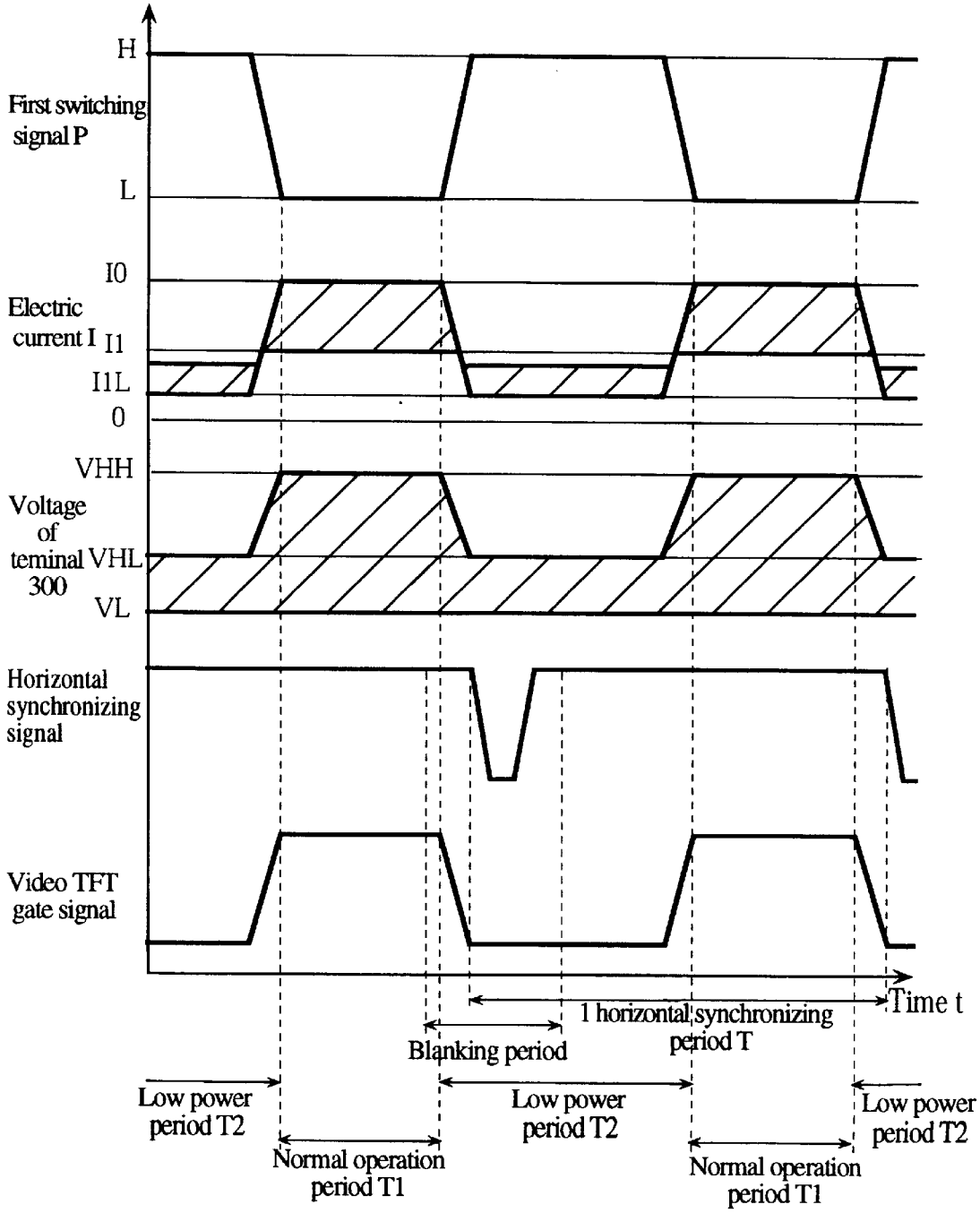
FIG. 31 is a timing chart of a DAC incorporated in the LCD driver circuit in accordance with Embodiment 2-11 of the present invention.

FIG. 30 is a circuit diagram showing the construction of the DAC of Embodiment 2-11, and FIG. 31 is the timing chart thereof. This Embodiment 2-10 has a similar construction to Embodiment 2-9, and the same reference characters are used for the corresponding parts. In this Embodiment 2-11, two high voltage power supplies, a first high voltage power supply VHH and a second high voltage power supply VHL are employed in place of the high voltage power supply VH used in Embodiment 2-9. The second high voltage power supply VHL has a lower voltage level than the first high voltage power supply VHH. In addition, a tenth switch 210 is provided for selecting one power supply between the power supplies VHH and VHL.

The operation of the DAC having the aforementioned construction is explained hereinafter. An electric current I consumed in all the resistance elements in the DAC is represented by the sum of an electric current I1 which flows in the resistance elements in the first DAC section 201 allotted for the more significant bits and an electric current I2 which flows in the resistance elements in the second DAC section 202 allotted for the lesser significant bits. That is, I=I1+I2.

During the normal operation period T1, the electric current I1 is I1=(VHH−VL)/(R7+R6+R5+R4) regardless of the input data. On the other hand, the electric current I2 varies according to the input data, as shown in the above Table 2, the minimum value being "0" and the maximum value being I2max=0.3125(VH2−VL2)max/r1. Consequently, the electric current I varies within the range between I1 and I0(=I1+I2max).

During the low power period T2, the power supply VHH is switched to the power supply VHL, and the electric current I1 becomes I1=(VHL−VL)/(R7+R6+R5+R4). In addition, during the low power period T2, a data D0 is masked to be "0" and a data D1 is masked to be "1", and therefore the electric current I2 becomes I2=0.25·(VH2−VL2)/r1. As a result, the electric current I becomes smaller than that in the normal operation period T1. As in Embodiment 2-7, the data can be masked by selecting a logic. During the low power period T2, the potential of the capacitive load 120 does not vary since the output switch 119 is turned OFF.

The reduction of power consumption is thus achieved by selecting the power supplies of the first DAC section allotted for more significant bits, which is a voltage potentiometer type DAC, and by switching the input data of the second DAC section allotted for lesser significant bits, which is an R-2R ladder type DAC.

(Embodiment 2-12)

Figure 32:
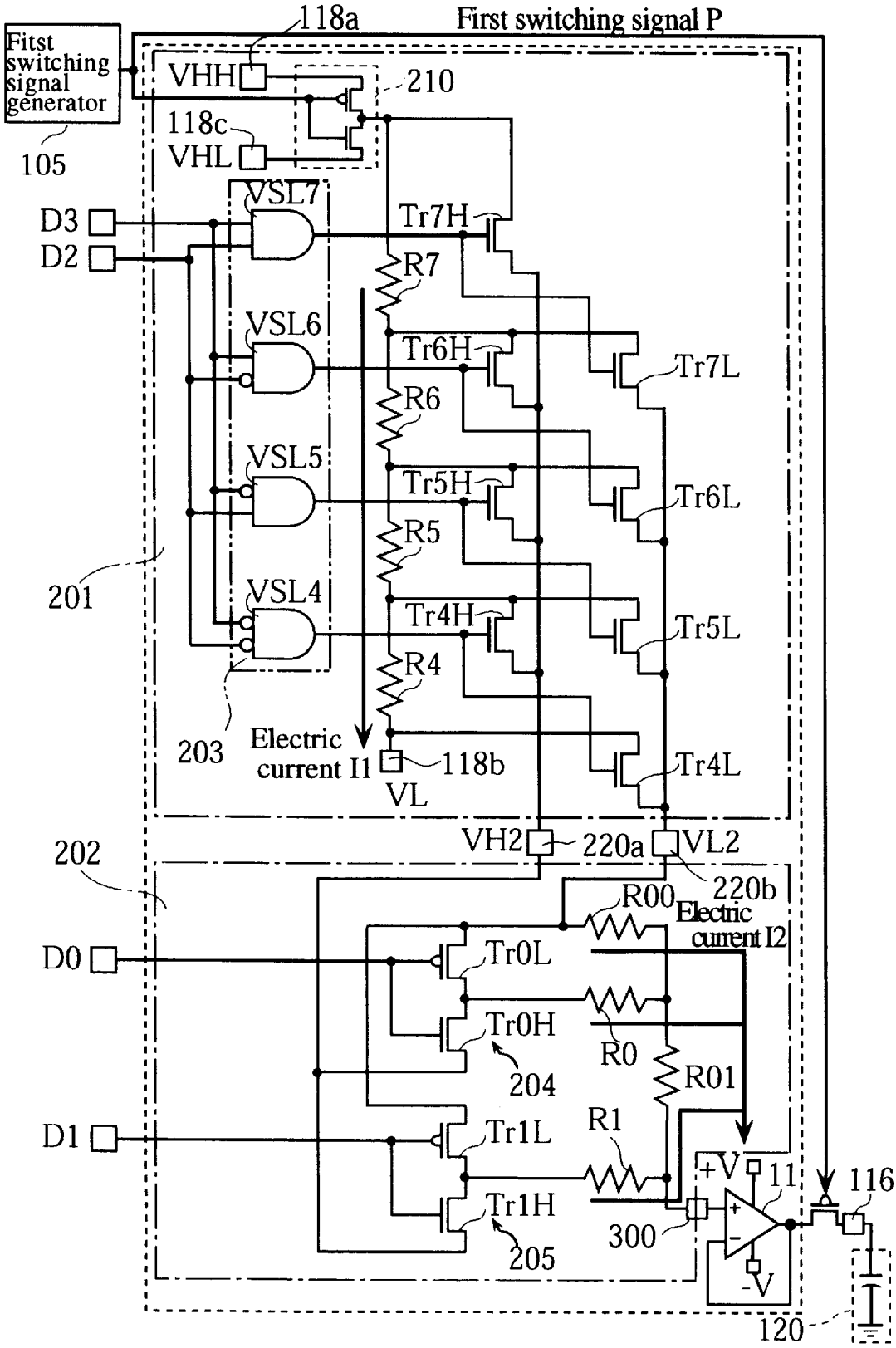
FIG. 32 is a circuit diagram of a DAC incorporated in the LCD driver circuit in accordance with Embodiment 2-12 of the present invention.
Figure 33:
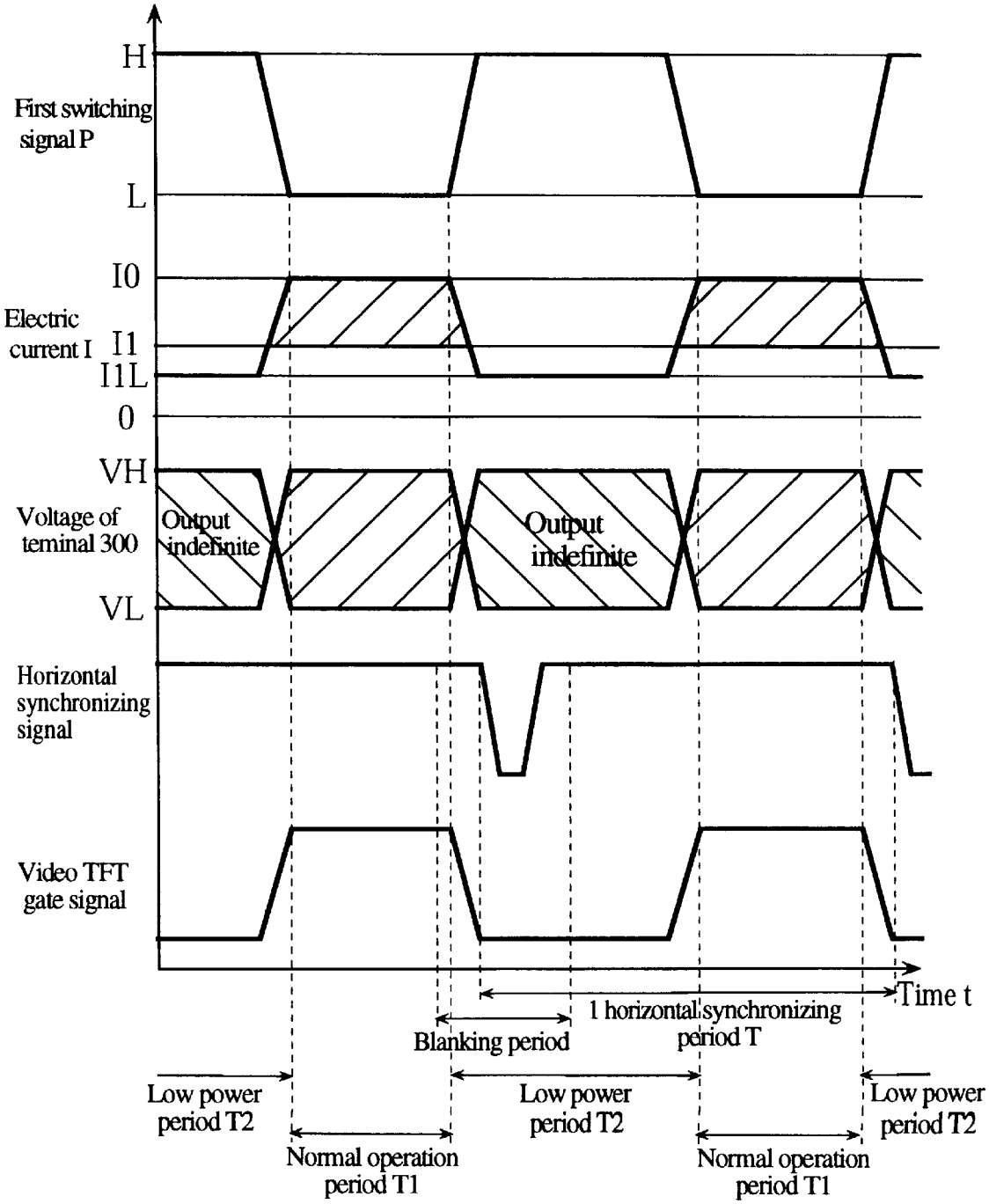
FIG. 33 is a timing chart of a DAC incorporated in the LCD driver circuit in accordance with Embodiment 2-12 of the present invention.

FIG. 32 is a circuit diagram showing the construction of the DAC of Embodiment 2-12, and FIG. 33 is the timing chart thereof. This Embodiment 2-12 has a similar construction to Embodiment 2-8, and the same reference characters are used for the corresponding parts. This Embodiment 2-12 differs from Embodiment 2-8 in that an eleventh connecting terminal 220*a* and a twelfth connecting terminal 220*b* are provided.

The operation of the DAC with the aforementioned construction is explained hereinafter. An electric current I consumed in all the resistance elements in the DAC is represented by the sum of an electric current I1 which flows in the resistance elements in the first DAC section 201 allotted for the more significant bits and an electric current I2 which flows in the resistance elements in the second DAC section 202 allotted for the lesser significant bits. That is, I=I1+I2.

During the normal operation period T1, the electric current I1 is I1=(VHH−VL)/(R7+R6+R5+R4) regardless of the input data. On the other hand, the electric current I2 varies according to the input data, as shown in the above Table 2, the minimum value being "0" and the maximum value being I2max=0.3125(VH2−VL2)max/r1. Consequently, the electric current I varies within the range between I1 and I0 (=I1+I2max).

During the low power period T2, the power supply VHH is switched to the power supply VHL, and the electric current I1 becomes I1=(VHL−VL)/(R7+R6+R5+R4). In addition, the switches TrPH and TrPL are turned OFF, and thereby the electric current I2 becomes "0".

The potential of the terminal 300 is within the range between VL and VH during the normal operation period T1, and becomes indefinite during the low power period T2. The potential of the capacitive load 120 does not vary during the low power period T2 since the output switch 119 is turned OFF.

The reduction of power consumption is thus achieved by selecting the power supplies of the first DAC section allotted for more significant bits, which is a voltage potentiometer type DAC, and by cutting off the power supply of the second DAC section allotted for lesser significant bits, which is an R-2R ladder type DAC.

(Embodiment 2-13)

Figure 34:
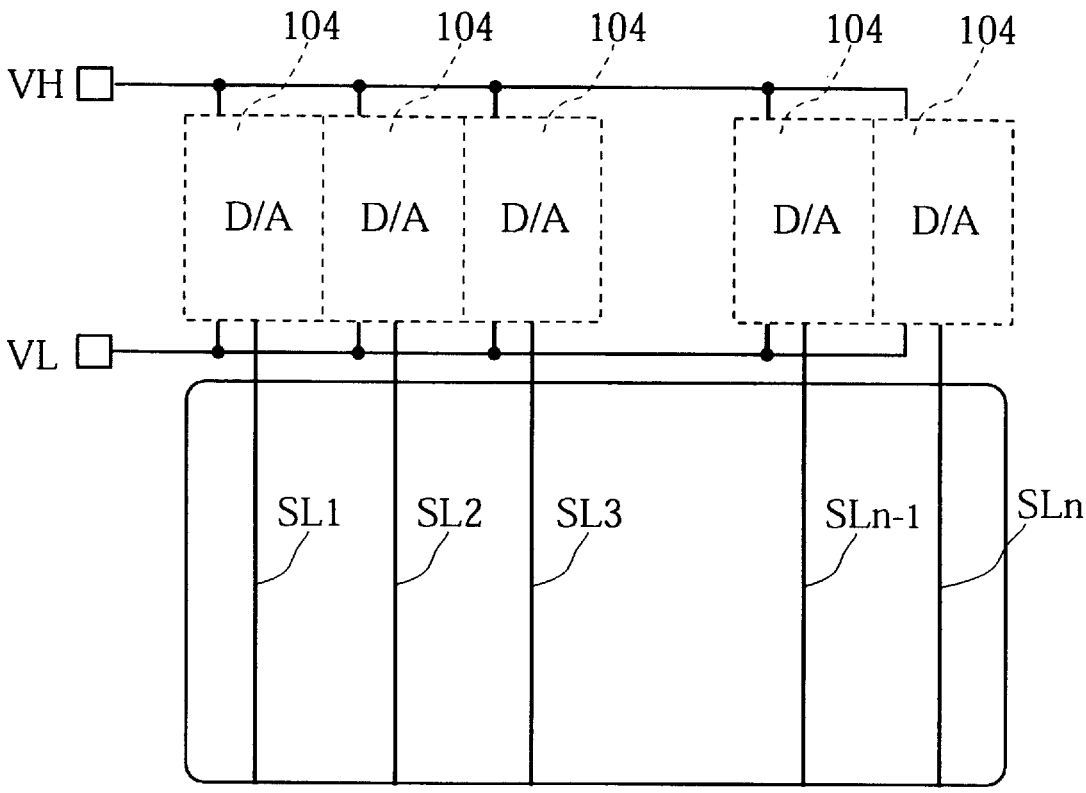
FIG. 34 is a schematic diagram showing the construction of a DAC incorporated in the LCD driver circuit in accordance with Embodiment 2-13 of the present invention.
Figure 35:
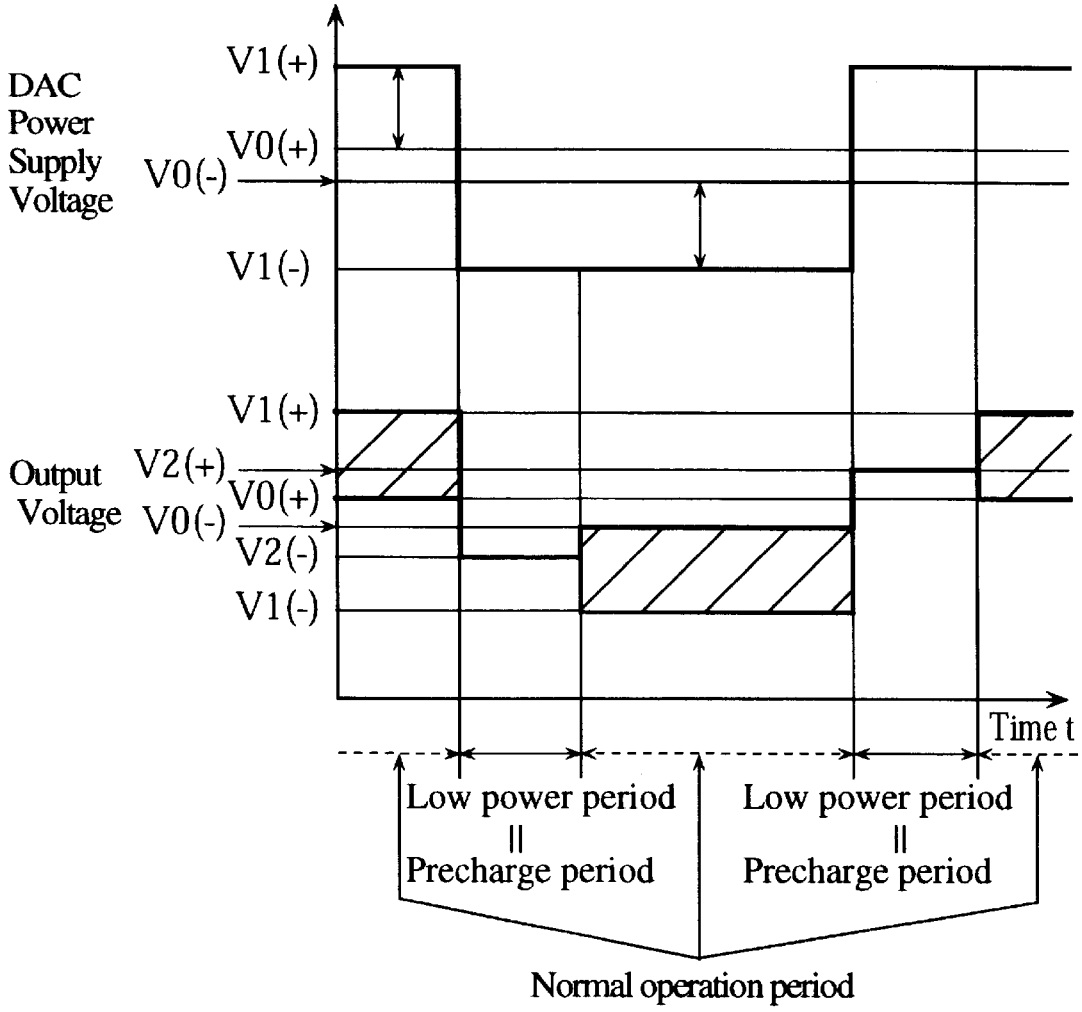
FIG. 35 is a timing chart of a DAC incorporated in the LCD driver circuit in accordance with Embodiment 2-13 of the present invention.

FIG. 34 shows the constructions of a portion of an array in the active matrix liquid crystal panel and of a portion of a driver circuit of Embodiment 2-13, and FIG. 35 is the timing chart thereof. In FIG. 34, it is shown that each one of DACs is connected to each one of source lines SL in the array, and that a power supply terminal 118*a* and a power supply terminal 118*b* are connected to each DAC. These DACs have a similar construction to the one shown in Embodiment 2-5. More specifically, a fifth switching signal generator circuit is provided in place of the first switching signal generator circuit 105. The fifth switching signal generator circuit receives a horizontal synchronizing signal and generates a fifth switching signal for selecting between a precharge period mode, which is for a precharge to be carried out prior to writing a video data to a source line, and a remaining period mode, which is a period except the precharge period. In addition, a sixth switching signal generator circuit is provided in place of the second switching signal generator circuit for controlling the switching states of a group of the previously-mentioned fourth switches. The sixth switching signal generator circuit generates a sixth switching signal for controlling switching states of the fourth switches, and outputs the sixth switching signal to the fourth switches. The sixth switching signal generator circuit receives digital video data and the fifth switching signal from the above-mentioned fifth switching signal generator circuit, and during the above-mentioned remaining period, it outputs the sixth switching signal corresponding to the digital video data. During the above-mentioned precharge period, it fixes the input data to be any one of the data by which a value of the electric current flowing in the resistance element network results in a smaller value than the median electric current value between the largest and the smallest, and outputs the fixed input data as the sixth switching signal. As a result, during the low power period T2, a voltage V2 which is determined by the data which is masked by the fifth switching signal is outputted. It is noted that the output switch 119 is eliminated in this embodiment. Therefore, during the low power period T2, the voltage V2 is written to the source line SL as a precharge voltage.

In such an active matrix liquid crystal panel, it is necessary that a polarity of a source line voltage be inverted in a certain periodic cycle in order to apply an alternating voltage to the liquid crystal elements. The time required for this polarity inversion of the source line voltage depends on a capacity and resistance of the source line, but generally, it tends to be longer as the size and resolution of the LCD increases. If the polarity inversion of the source line voltage is carried out simultaneously with a writing of video data, a shortage of the writing of video data will be brought about in the case where the capacitance and resistance of the source line increases and thereby the time required for the polarity inversion is made longer.

In view of this, prior to the writing of video data, the polarity inversion of the source line is carried out by utilizing the period in which a gate of a pixel switch transistor for driving a liquid crystal element is turned OFF, generally during the blanking period of the horizontal synchronizing period. Such an operation is called a precharge. During this precharge period, a certain voltage with an inverted polarity is intentionally written to the source line, but at the same time, it is made possible to utilize the voltage V2 as a voltage for the precharge by making the fifth switching signal in the DAC high level and thereby switching over to the low power period. As a result, the improvement of image quality as well as the reduction of power consumption can be achieved at a time.

In the above example, although this embodiment is applied to the DAC in Embodiment 2-5, this embodiment is not limited thereto and can be suitably applied to the other embodiments.

(Embodiment 2-14)

Figure 36:
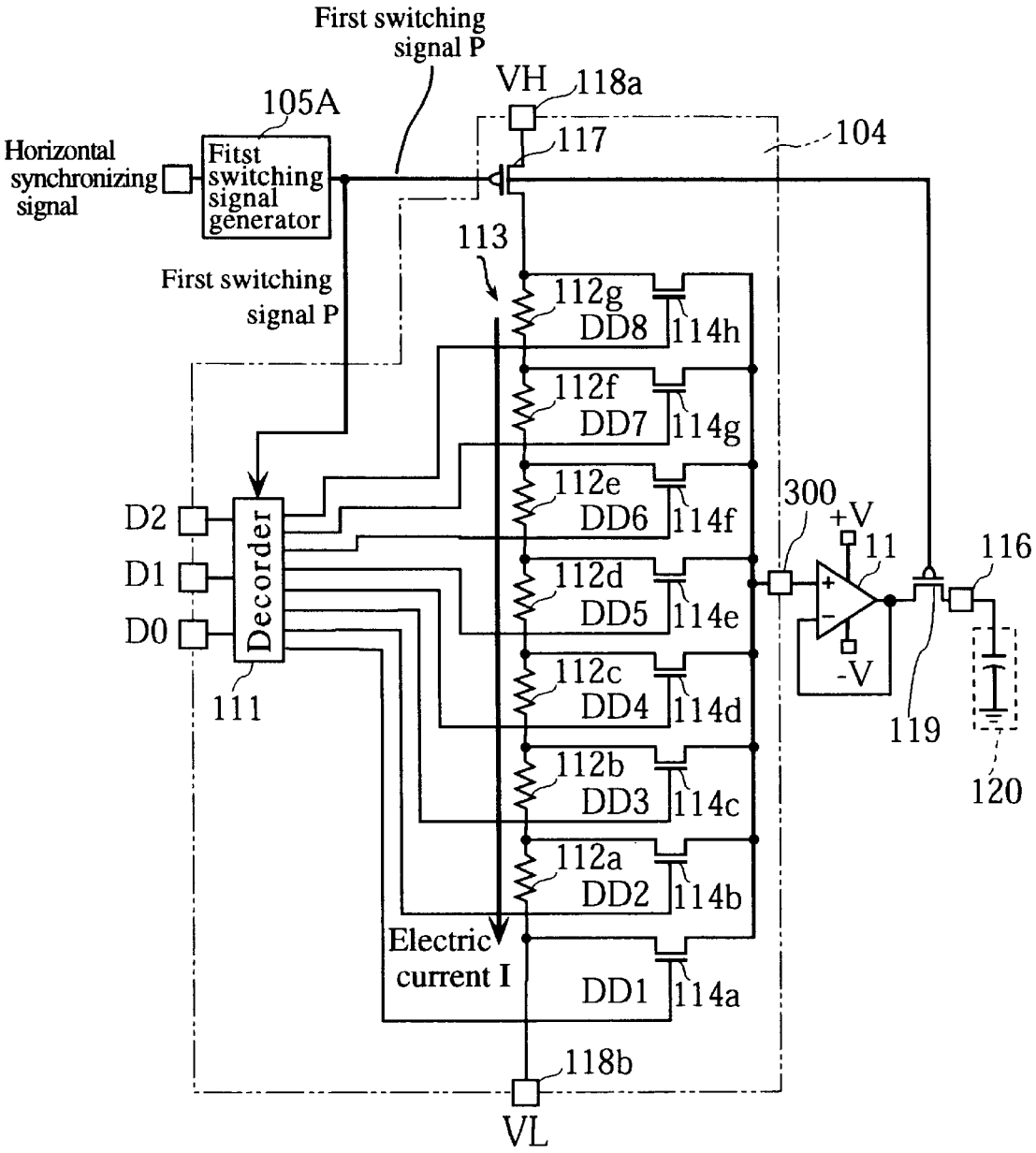
FIG. 36 is a circuit diagram of a DAC incorporated in the LCD driver circuit in accordance with Embodiment 2-14 of the present invention.
Figure 37:
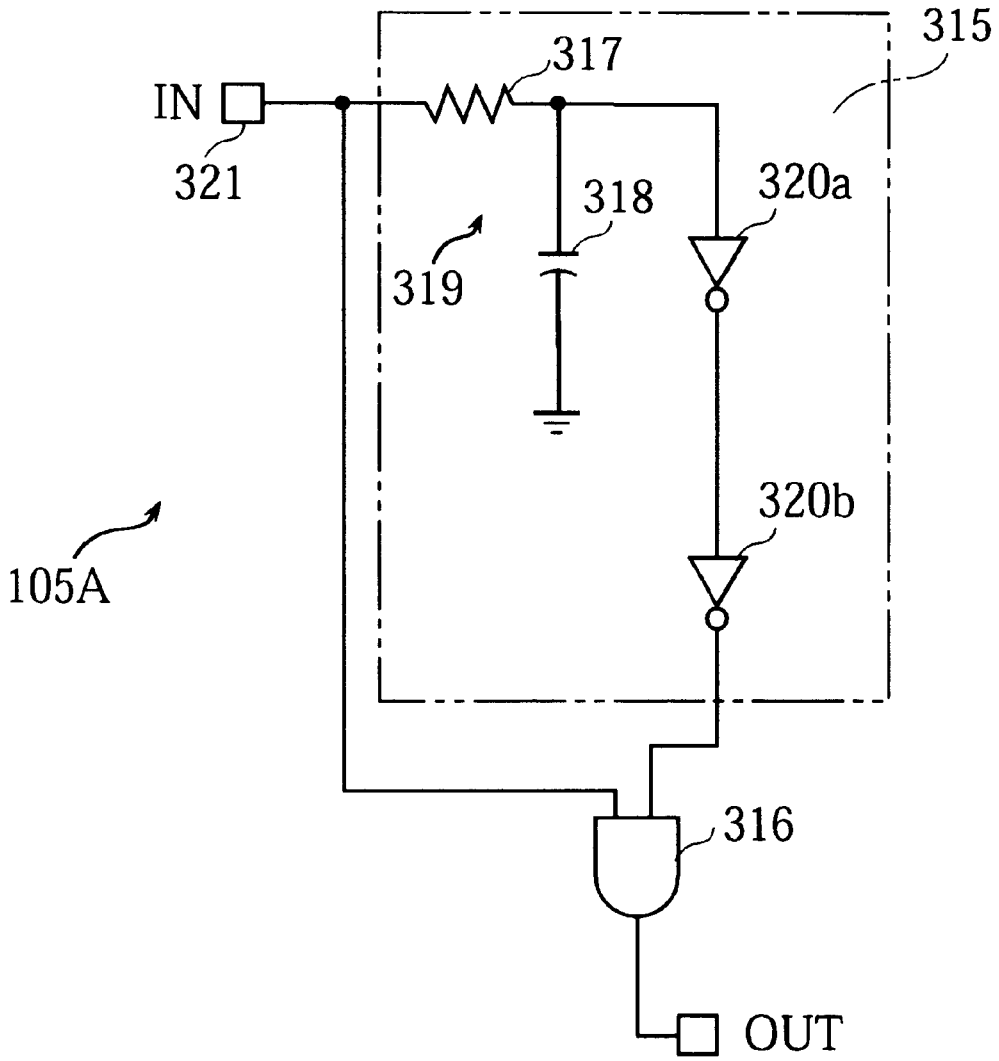
FIG. 37 is a circuit diagram of a first switching signal generator circuit provided in the LCD driver circuit in accordance with Embodiment 2-14 of the present invention.

FIG. 36 illustrates the construction of a driver circuit of Embodiment 2-14. This Embodiment 2-14 has a similar construction to Embodiment 2-1, and the same reference characters are used for the corresponding parts. In this Embodiment 2-14, a first switching signal generator circuit 105A is employed in place of the first switching signal generator circuit 105 used in Embodiment 2-1. As shown in FIG. 37, this first switching signal generator circuit 105A comprises a delay circuit 315 and an AND gate 316. The delay circuit 315 receives a horizontal synchronizing signal and delays the horizontal synchronizing signal for a predetermined delay time. The AND gate 316 outputs a first switching signal P when it obtains an AND condition of an output from the delay circuit 315 and the horizontal synchronizing signal. The delay circuit 315 comprises an integrator circuit 319, and inverters 320*a* and 320*b*. The integrator circuit comprises a resistance element 317 that is formed by the impurity-containing semiconductor layer on the array substrate, and a capacitance element 318 that is formed by the insulation layer on the array substrate. The inverters 320*a* and 320*b* are composed of a TFT on the array substrate. The AND gate 316 is also composed of a TFT on the array substrate.

Figure 38:
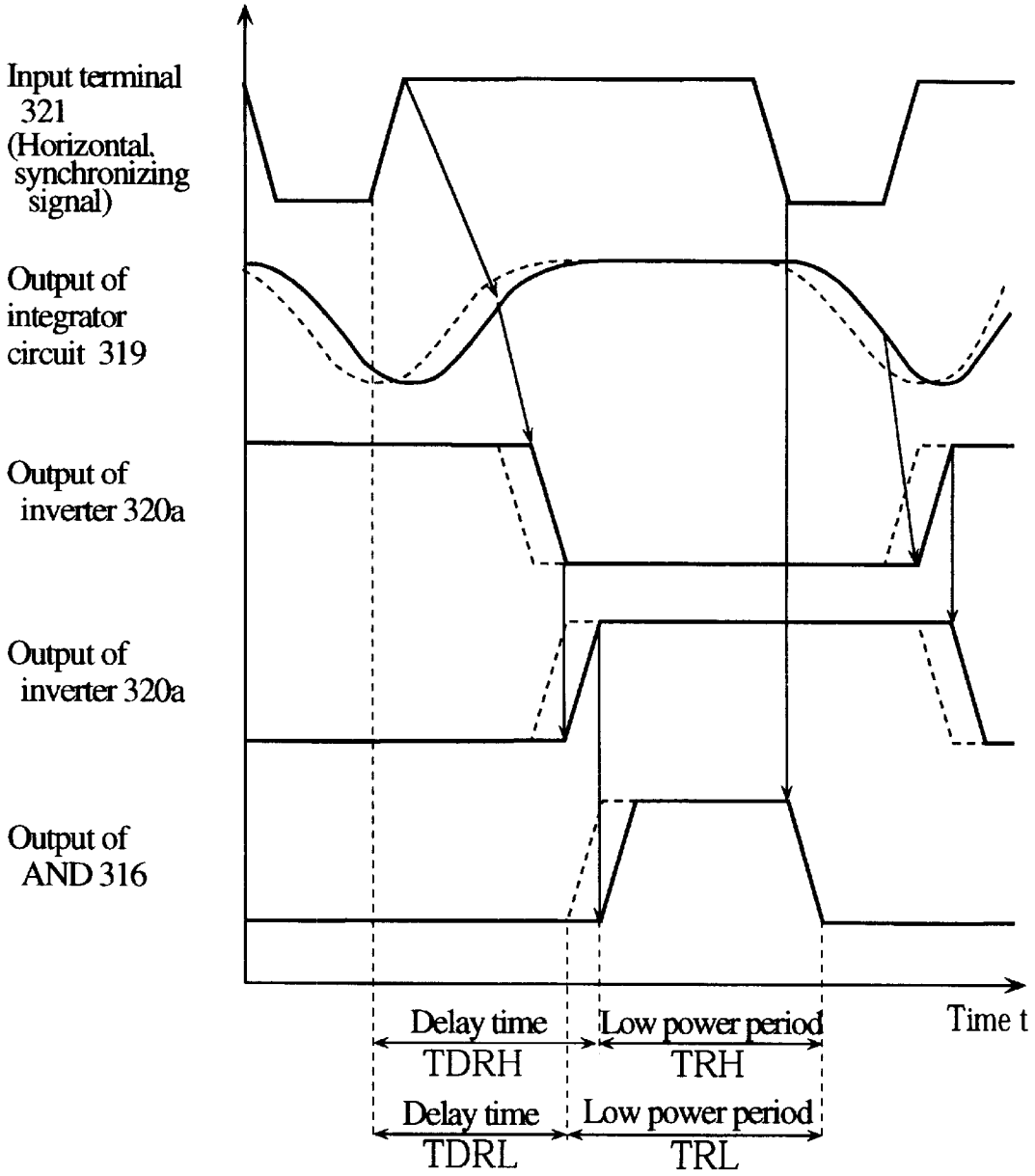
FIG. 38 is a timing chart of the first switching signal generator circuit.

Referring now to the timing chart of FIG. 38, there is detailed the workings of input signals in the first switching signal generator circuit 105A having such a construction. When a horizontal synchronizing signal inputted to an input terminal 321 turns to high level, an output level of the integrator circuit 319, which is composed of the resistance element 317 and capacitance element 318, ascends in accordance with a time constant determined by the resistance element 317 and capacitance element 318. Thereupon, when the output level of the integrator circuit 319 reaches a threshold voltage of the inverter 320*a*, an output of the inverter 320*a* turns from high level to low level. An output of the inverter 320*b* thereby turns from low level to high level. Thereafter, when the horizontal synchronizing signal turns to low level, the output level of the integrator circuit 319 descends in accordance with the time constant determined by the resistance element 317 and capacitance element 318. Thereupon, when the output of the integrator circuit 319 reaches the threshold voltage of the inverter 320*a*, the output of the inverter 320*a* turns from low level to high level, and thereby the output of the inverter 320*b* turns from high level to low level. As a consequence, the output of the inverter 320*b* is delayed for a time TD determined by a time constant of the integrator circuit 319. Thus, a signal in which the horizontal synchronizing signal and the output of the inverter 320*b*, which is a delayed horizontal synchronizing signal, are ANDed together, is outputted from the AND gate 316 as a first switching signal.

The delay time TD is the total of each delay time in the integrator circuit 319 and the inverters 320*a* and 320*b*. However, when compared with a delay time in the integrator circuit 319, a delay time in the inverters 320*a* and 320*b* is so small that it is negligible. Therefore, only the delay time in the integrator circuit 319 should be taken into consideration. That is, the circuit should be arranged so that the delay by the integrator circuit 319 is dominant. Specifically, the capacitance value C should be set far smaller than the resistance value R of the resistance element 317. Therefore, it is considered that the time constant of the integrator circuit 319 is determined by the resistance value R of the resistance element 317, and thereby the delay time can be determined by the resistance value R of the resistance element 317. Hence, when the resistance element 317 has a large resistance value, the first switching signal P results in a waveform shown by the solid line in FIG. 38, and accordingly the delay time of the horizontal synchronizing signal becomes long as shown by the reference character TDRH. On the other hand, when the resistance element 317 has a small resistance value, the first switching signal P results in a waveform as shown by the dashed line in FIG. 38, and accordingly the delay time of the horizontal synchronizing signal becomes short as shown by the reference character TDRL. It is noted that the length of the low power period also changes correspondingly, as illustrated in the following. When the resistance element 317 has a large resistance value, the low power period accordingly becomes short as shown by the reference character TRH, and conversely, when the resistance element 317 has a small resistance value, the low power period accordingly becomes long as shown by the reference character TRL.

In the case where the resistance elements on the array substrate have a large resistance value, the electric current in the DAC is small and thereby a time for charging a capacitive load 120, which is connected to a source line SL via an output terminal 116, becomes long. Therefore, in this case, it is preferable that the low power period T2 be relatively short. Even if the low power period T2 is short (i.e., the normal operation period T1 is long), the power consumption in the normal operation period T1 is still reduced since the resistance elements have a high resistance value. Hence, no adverse effect will be caused in the reduction of power consumption. On the other hand, in the case where the resistance elements on the array substrate have a small resistance value, the current in the DAC is large, and therefore the time required for charging a source lines SL becomes short. Therefore, in this case, it is preferable that the low power period T2 be relatively long. As has been described, there arises a necessity to change lengths of the normal operation period T1 and the low power period T2 corresponding to a resistance value of the resistance elements on the array substrate, in order to meet two requirements, one being the charge of the source line and the other being the reduction in power consumption. In such a case, the first switching signal generator circuit 105A automatically adjusts the length of a high level period of the first switching signal P most suitably to meet those requirements. Hence, it is made possible to automatically adjust the power consumption optimally at any time, regardless of the precision of the resistance elements, by constructing the integrator circuit by the resistance element formed on the same array substrate as the resistance elements in the DAC are formed.

Now the effect of the first switching signal generator circuit 105A is further detailed below.

The high level period of the first switching signal is defined as a period except the normal operation period (the normal operation period is a period in which a period to completely change a potential of a pixel electrode is added to a period to completely change a potential of a capacitive load connected to a source line SL in the entire period of one horizontal synchronizing period). The resistance value of the resistance element 317 is determined so that the period except the normal operation period equals to the high level period of the first switching signal. However, in practice, there occurs an error in the resistance value. This error brings about such adverse effects that a shortage of charging to the source line SL causes the deterioration of display characteristics and that a desired amount of power consumption cannot be obtained, since the length of the high level period of the first switching signal P results in a different length from a predetermined length. However, according to this embodiment, since the first switching signal generator circuit 105A has such a construction as described above, it is made possible to avoid the above-mentioned adverse effects as well as the shortage of the charging to the source line SL, and thus an optimization of power consumption can be achieved.

For instance, in the case of a resistance value of each resistance element in the DAC being larger than a predetermined resistance value, a resistance value of the resistance element 317 is also larger than the predetermined value. On the other hand, in the case of the resistance value of each resistance element in the DAC being smaller than the predetermined resistance value, the resistance value of the resistance element 317 is also smaller than the predetermined value. The reason is that it is considered that the same degree of error will occur to both of the resistance elements since they are both formed by the impurity-containing semiconductor layer on the same array substrate.

In addition, in the case where a resistance value is larger than a predetermined value, an electric current flowing in the resistance elements of the DACs is made smaller during the normal operation period. As a result, the potential of the source line SL cannot be changed to a desired potential unless the high level period of the first switching signal P is precisely adjusted according to the resistance elements, and therefore, the deterioration of display characteristics will be incurred. However, according to this embodiment, a precise adjustment of the high level period (i.e., the low power period) of the first switching signal P can be achieved by constructing the first switching signal generator circuit 105A in accordance with the construction shown in FIG. 37. Thereby, the high level period becomes shorter than the original length, and accordingly, the normal operation period T1 becomes longer. Therefore, it is made possible to change the potential of the source line to a desired potential, and as a result to prevent the deterioration of display characteristics. It is noted that although the low power period is made shorter, the power consumption is practically not increased since the electric current in the normal operation period is reduced.

On the other hand, in the case where the resistance value is smaller than a predetermined value, the current flowing in the resistance elements in the DAC is made larger during the normal operation period. As a result, the power required for a normal operation is consumed even after the potential of the source line SL is changed to the desired potential, unless the high level period of the first switching signal P is precisely adjusted according to the resistance elements. It is a waste of power consumption when considered from the viewpoint of the reduction in power consumption. However, according to this embodiment, a precise adjustment of the high level period (i.e., the low power period) of the first switching signal P can be achieved by constructing the first switching signal generator circuit 105A in accordance with the construction shown in FIG. 37, and thereby the high level period is made longer (i.e., the normal operation period is made shorter) than the original length. The waste of power consumption can be thus avoided.

Hence, according to this embodiment, a variation of power consumption caused by a resistance value variation of the resistance elements in each manufactured array substrate can be compensated without relying on an adjustment by external circuits, and therefore the simplification of external circuits and the optimization of power consumption are easily achieved.

It is noted that, although an insulation layer on the array substrate is utilized for the capacitance element in this embodiment, a generally available capacitor component may be used for the capacitance element.

Figure 39:
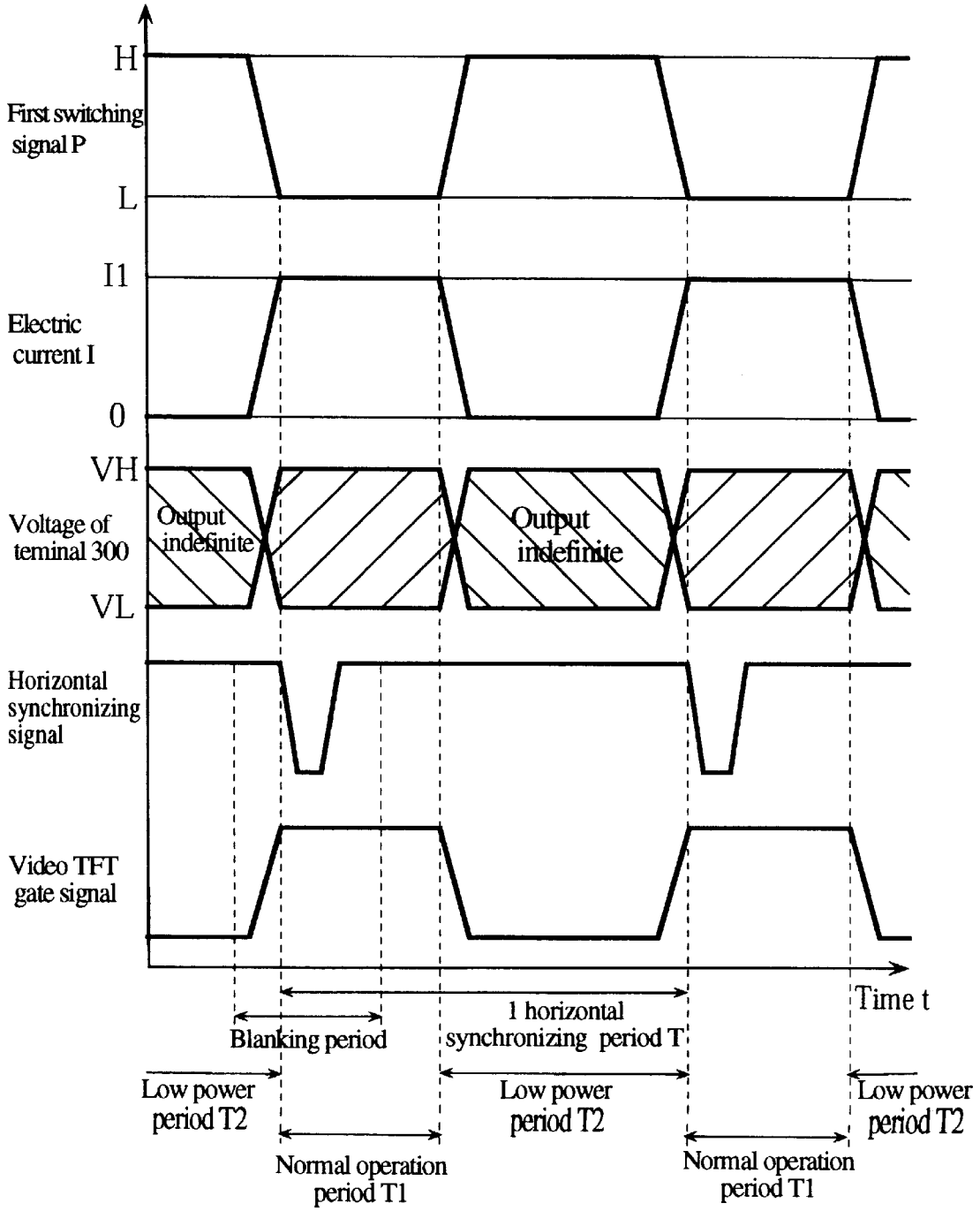
FIG. 39 is a timing chart of a DAC incorporated in the LCD driver circuit in accordance with Embodiment 2-14 of the present invention.

FIG. 39 is the timing chart showing the operation of the DAC in Embodiment 2-14. Although this Embodiment 2-14 differs from Embodiment 2-1 in that the first switching signal P is generated from the horizontal synchronizing signal, the operation of the DAC is basically identical to Embodiment 2-1.

(Embodiment 2-15)

Figure 40:
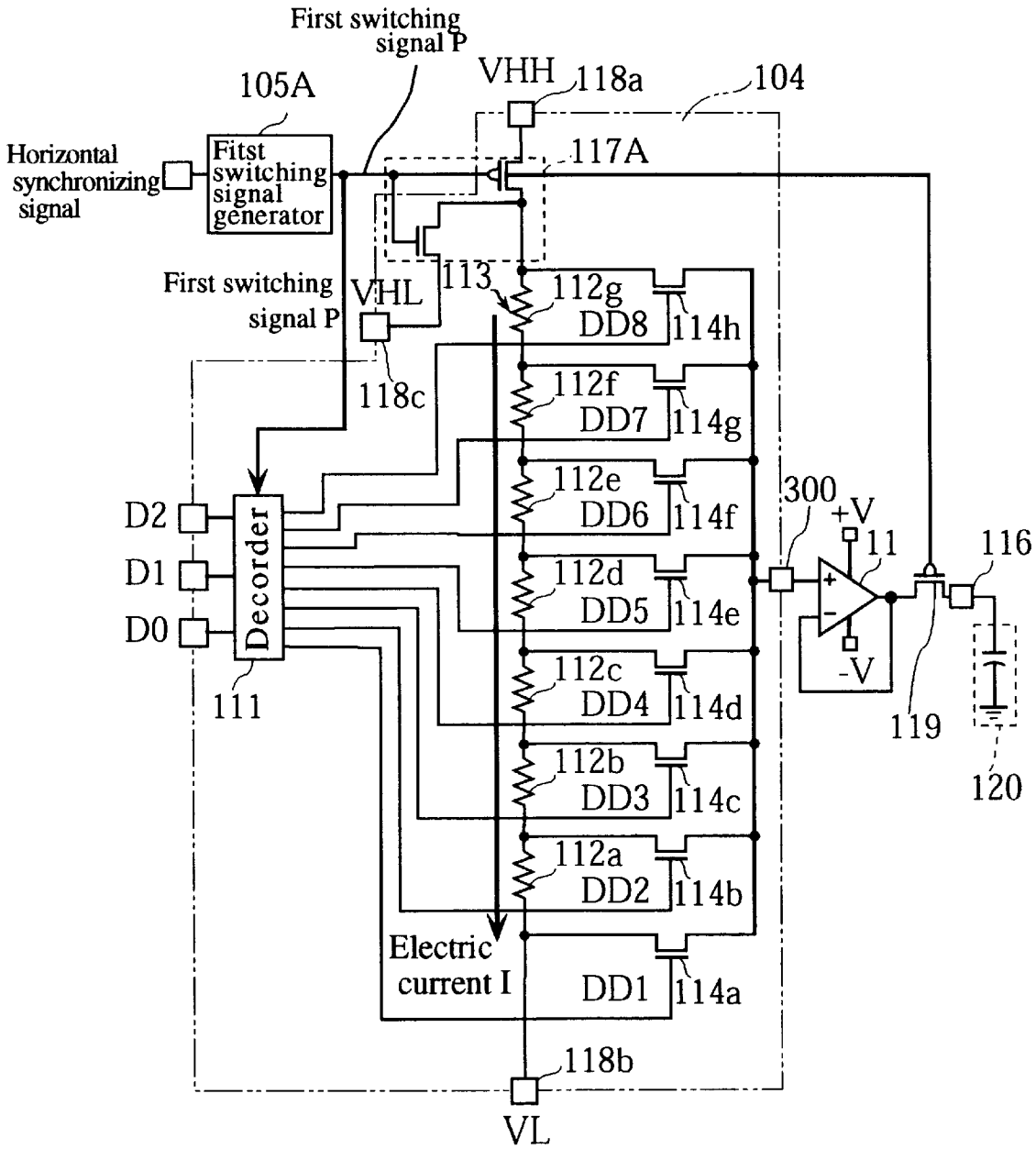
FIG. 40 is a circuit diagram of a DAC incorporated in the LCD driver circuit in accordance with Embodiment 2-15 of the present invention.

FIG. 40 shows the construction of a DAC in Embodiment 2-15. This Embodiment 2-15 has a similar construction to Embodiment 2-3, and the same reference characters are used for the corresponding parts. In this Embodiment 2-15, the first switching signal generator circuit 105A is employed in place of the first switching signal generator circuit 105 employed in Embodiment 2-3.

Figure 41:
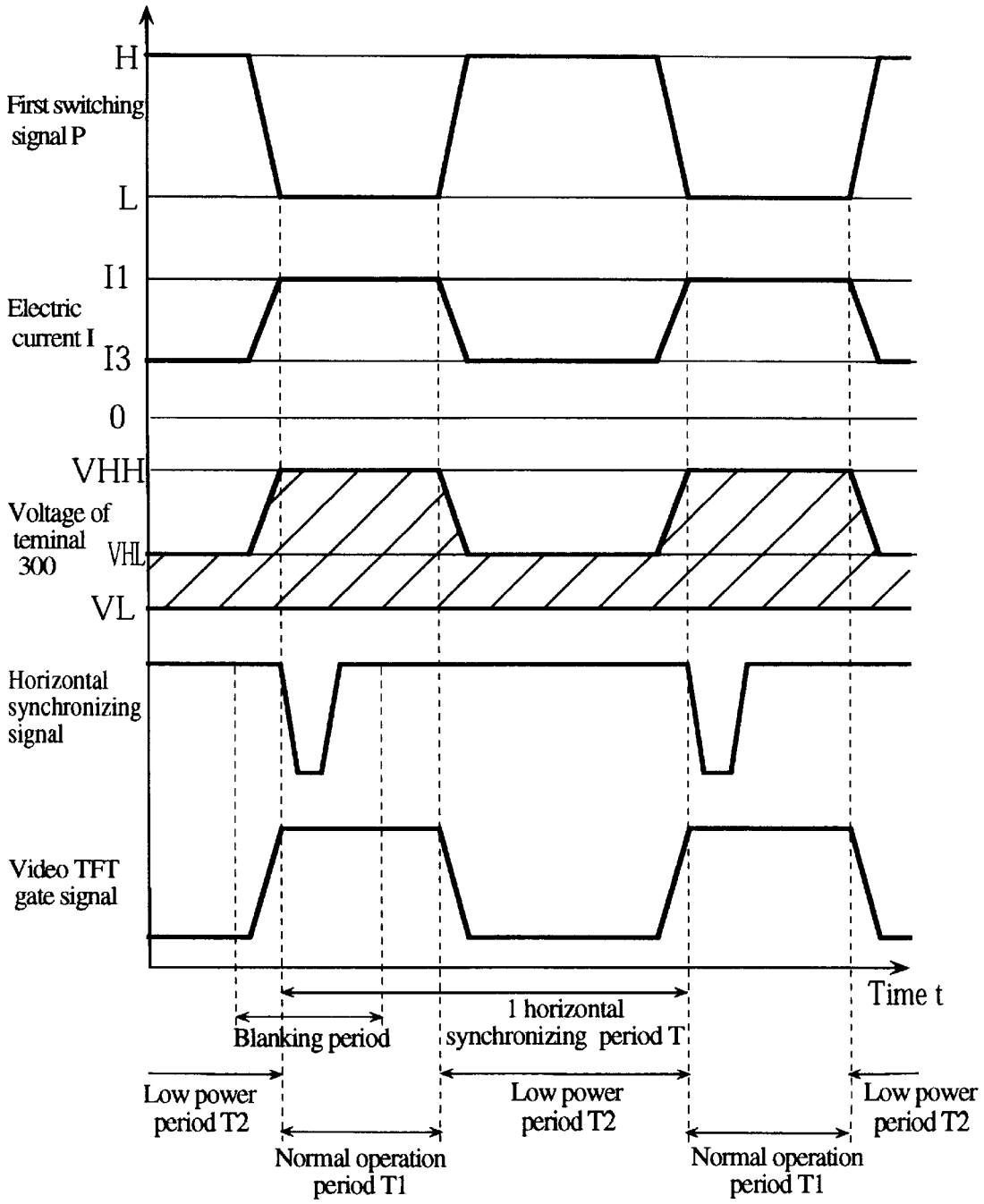
FIG. 41 is a timing chart of a DAC incorporated in the LCD driver circuit in accordance with Embodiment 2-15 of the present invention.

FIG. 41 is the timing chart showing the operations of the driver circuit. Although this Embodiment 2-15 differs from Embodiment 2-3 in that the first switching signal P is generated from the horizontal synchronizing signal, the operation of the DAC is basically identical to Embodiment 2-3. As well as Embodiment 2-14, this Embodiment 2-15 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-16)

Figure 42:
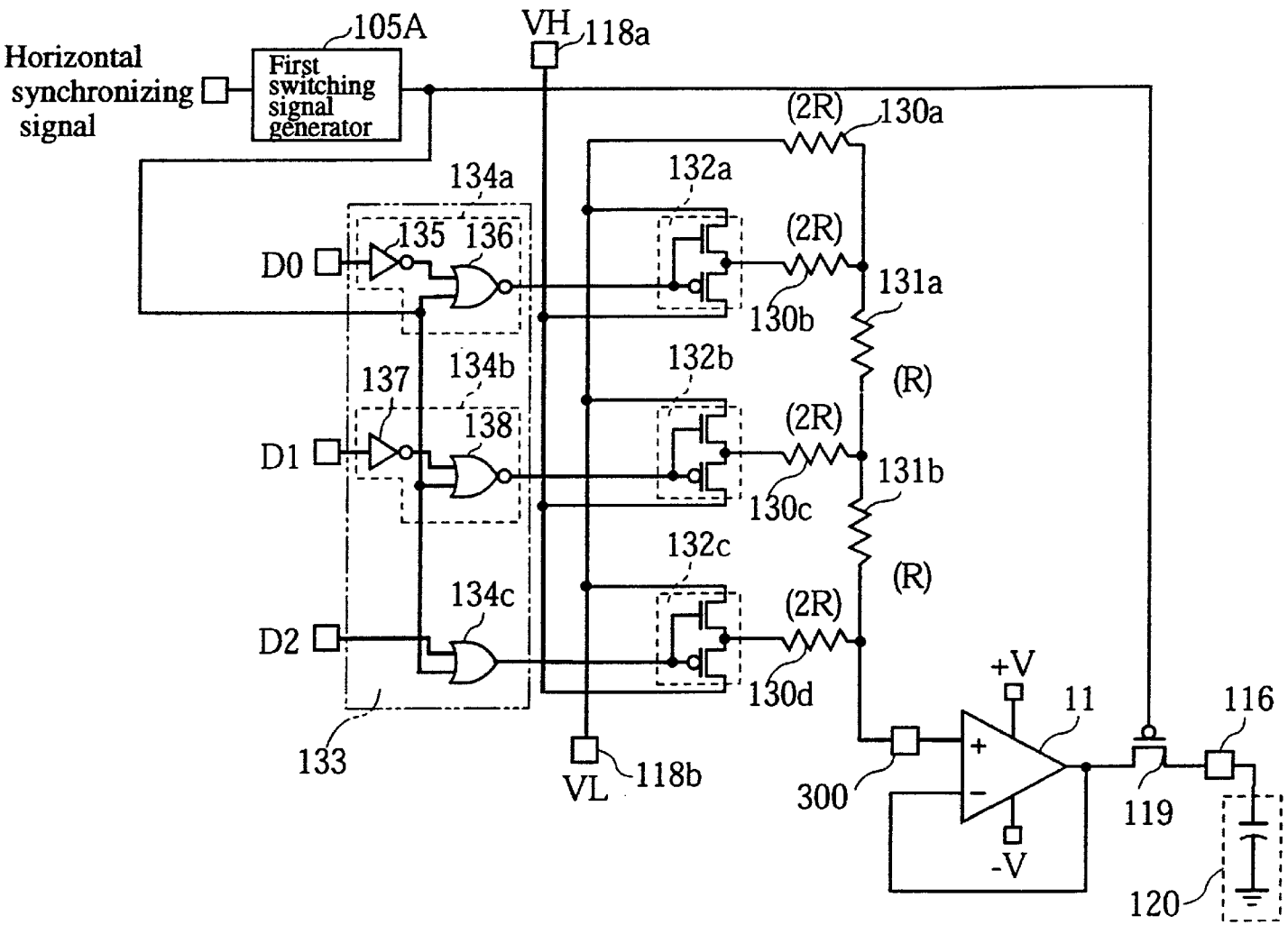
FIG. 42 is a circuit diagram of a DAC incorporated in the LCD driver circuit in accordance with Embodiment 2-16 of the present invention.

FIG. 42 shows the construction of a DAC in Embodiment 2-16. This Embodiment 2-16 has a similar construction to Embodiment 2-5, and the same reference characters are used for the corresponding parts. In this Embodiment 2-16, the first switching signal generator circuit 105A is employed in place of the first switching signal generator circuit 105 employed in Embodiment 2-5.

Figure 43:
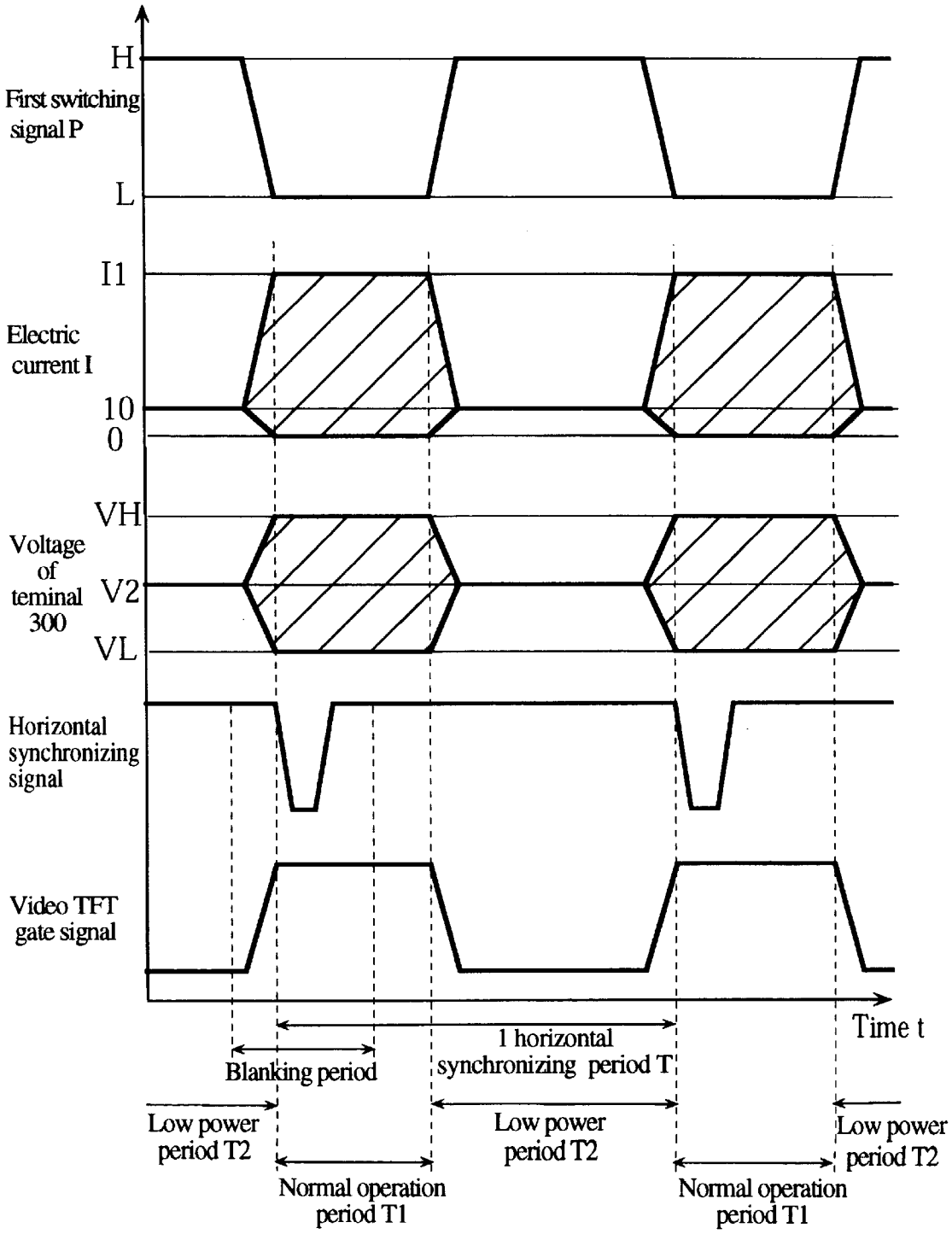
FIG. 43 is a timing chart of a DAC incorporated in the LCD driver circuit in accordance with Embodiment 2-16 of the present invention.

FIG. 43 is the timing chart showing the operations of the DAC. Although this Embodiment 2-15 differs from Embodiment 2-5 in that the first switching signal P is generated from the horizontal synchronizing signal, the operation of the DAC is basically identical to Embodiment 2-5. As well as Embodiment 2-14, this Embodiment 2-16 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-17)

Figure 44:
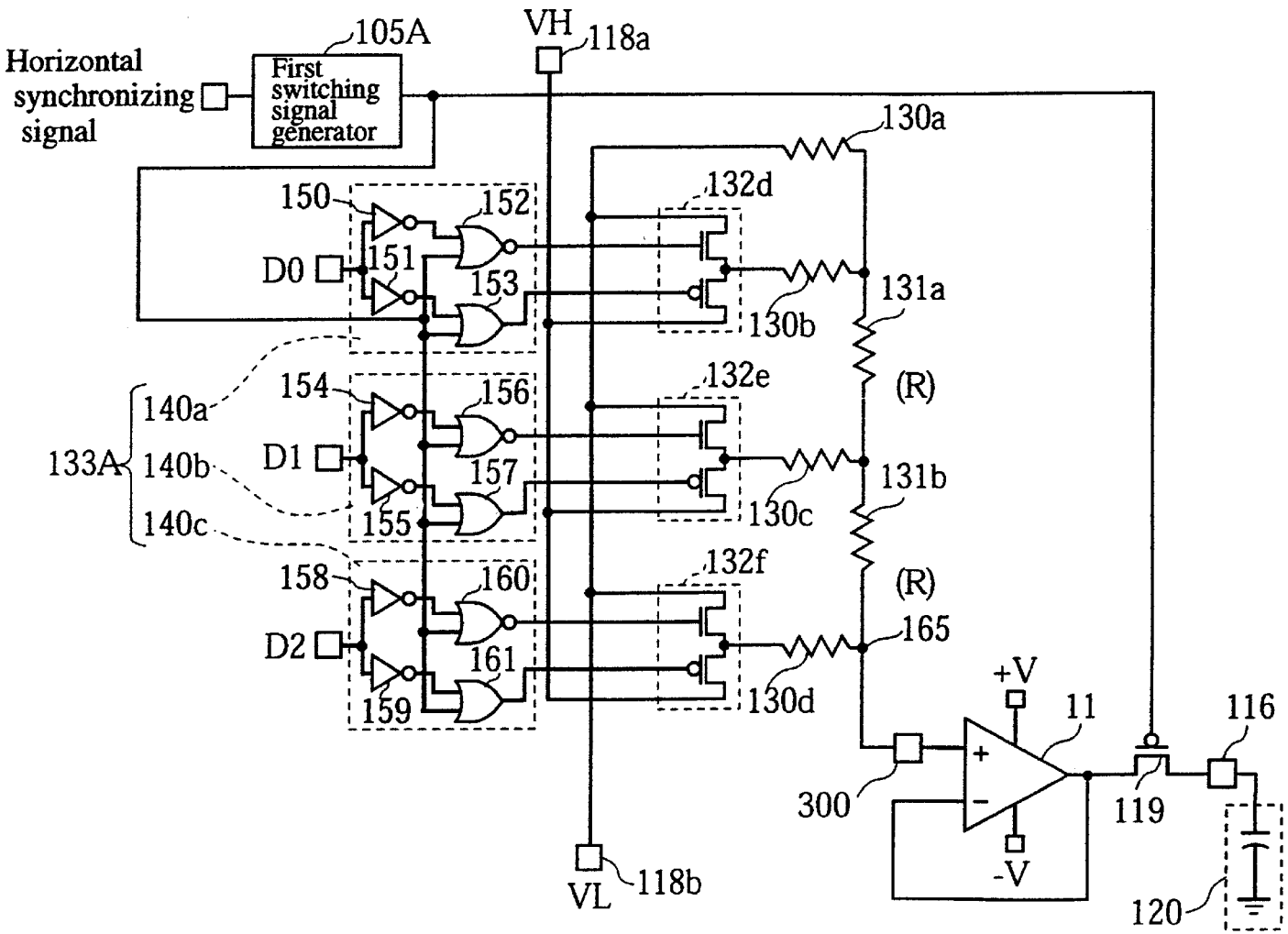
FIG. 44 is a circuit diagram of a DAC incorporated in the LCD driver circuit in accordance with Embodiment 2-17 of the present invention.

FIG. 44 shows the construction of a DAC in Embodiment 2-17. This Embodiment 2-17 has a similar construction to Embodiment 2-6, and the same reference characters are used for the corresponding parts. In this Embodiment 2-17, the first switching signal generator circuit 105A is employed in place of the first switching signal generator circuit 105 employed in Embodiment 2-6.

Figure 45:
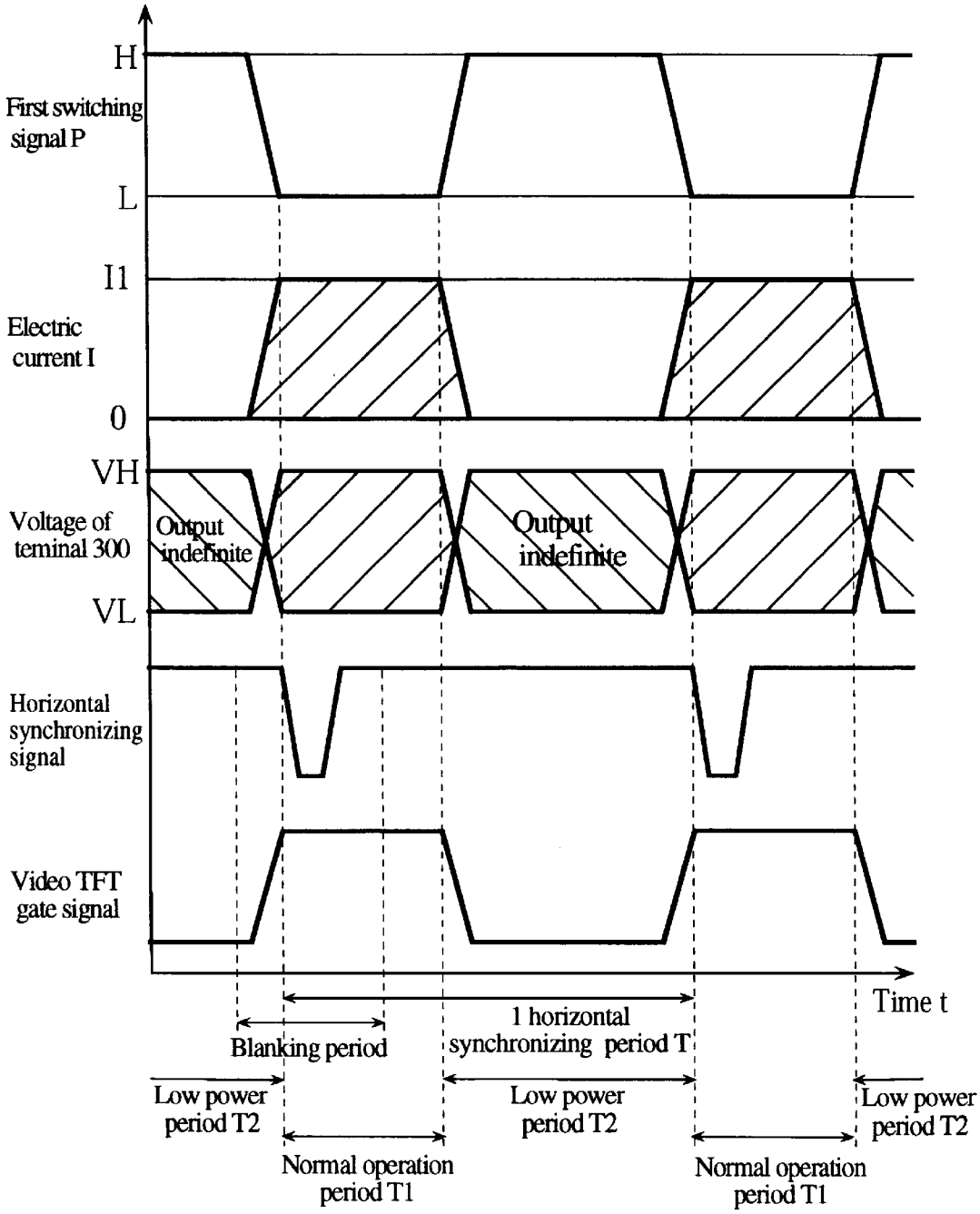
FIG. 45 is a timing chart of a DAC incorporated in the LCD driver circuit in accordance with Embodiment 2-17 of the present invention.

FIG. 45 is the timing chart showing the operations of the driver circuit. Although this Embodiment 2-17 differs from Embodiment 2-6 in that the first switching signal P is generated from the horizontal synchronizing signal, the operation of the DAC is basically identical to Embodiment 2-6. As well as Embodiment 2-14, this Embodiment 2-17 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-18)

Figure 46:
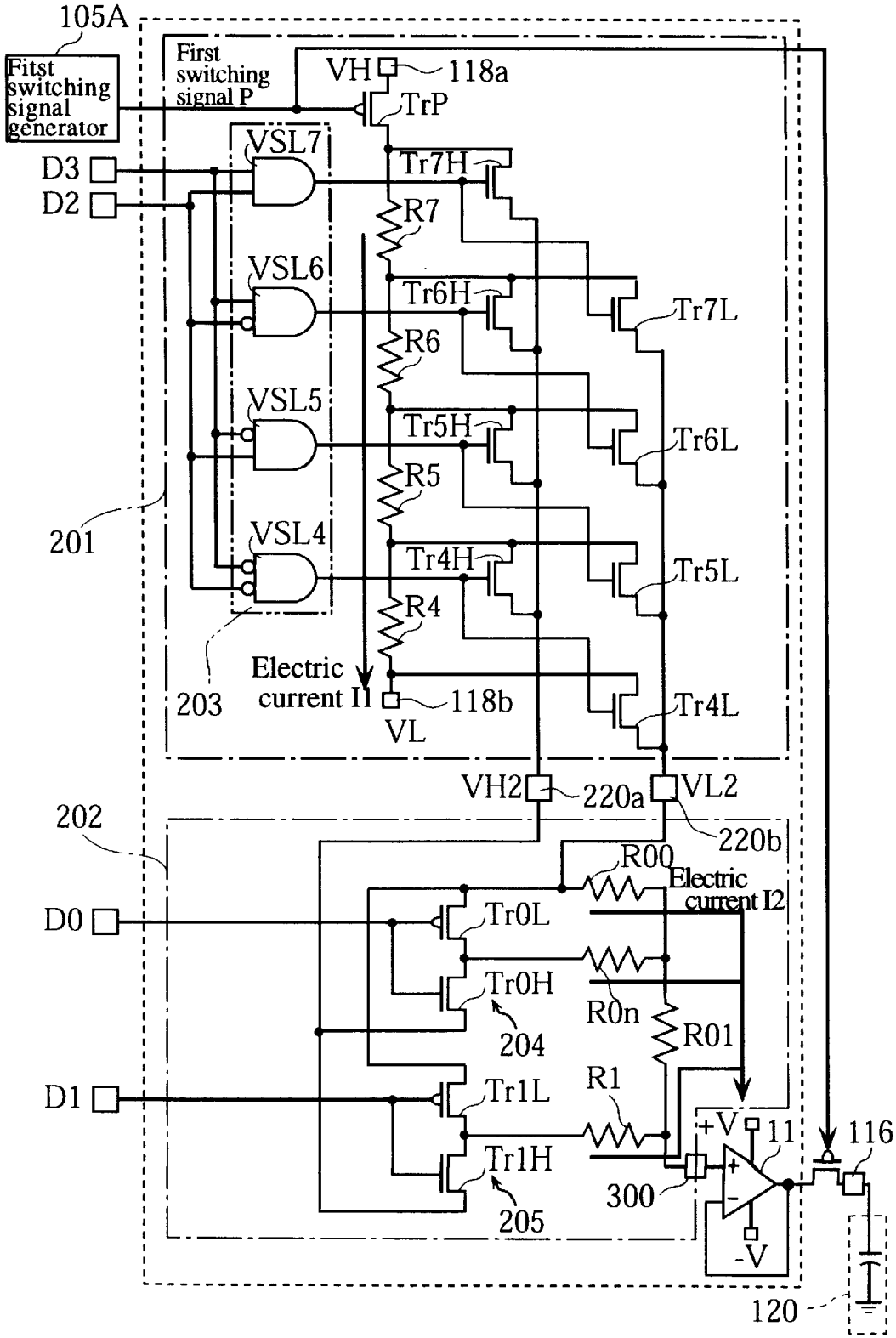
FIG. 46 is a circuit diagram of a DAC incorporated in the LCD driver circuit in accordance with Embodiment 2-18 of the present invention.

FIG. 46 shows the construction of a DAC in Embodiment 2-18. This Embodiment 2-18 has a similar construction to Embodiment 2-7, and the same reference characters are used for the corresponding parts. In this Embodiment 2-17, the first switching signal generator circuit 105A is employed in place of the first switching signal generator circuit 105 employed in Embodiment 2-7.

Figure 47:
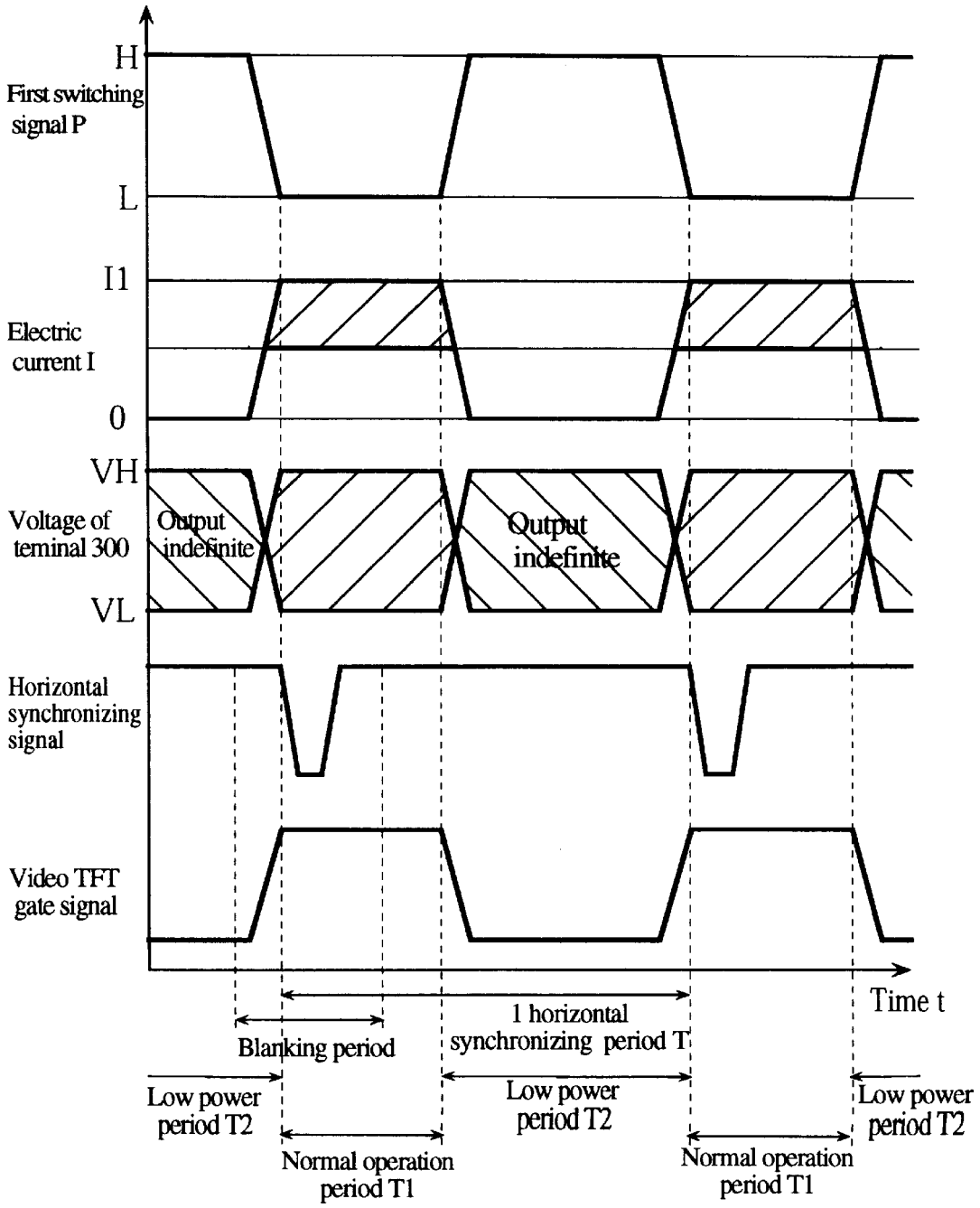
FIG. 47 is a timing chart of a DAC incorporated in the LCD driver circuit in accordance with Embodiment 2-18 of the present invention.

FIG. 47 is the timing chart showing the operations of the driver circuit. Although this Embodiment 2-17 differs from Embodiment 2-7 in that the first switching signal P is generated from the horizontal synchronizing signal, the operation of the DAC is basically identical to Embodiment 2-7. As well as Embodiment 2-14, this Embodiment 2-18 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-19)

Figure 48:
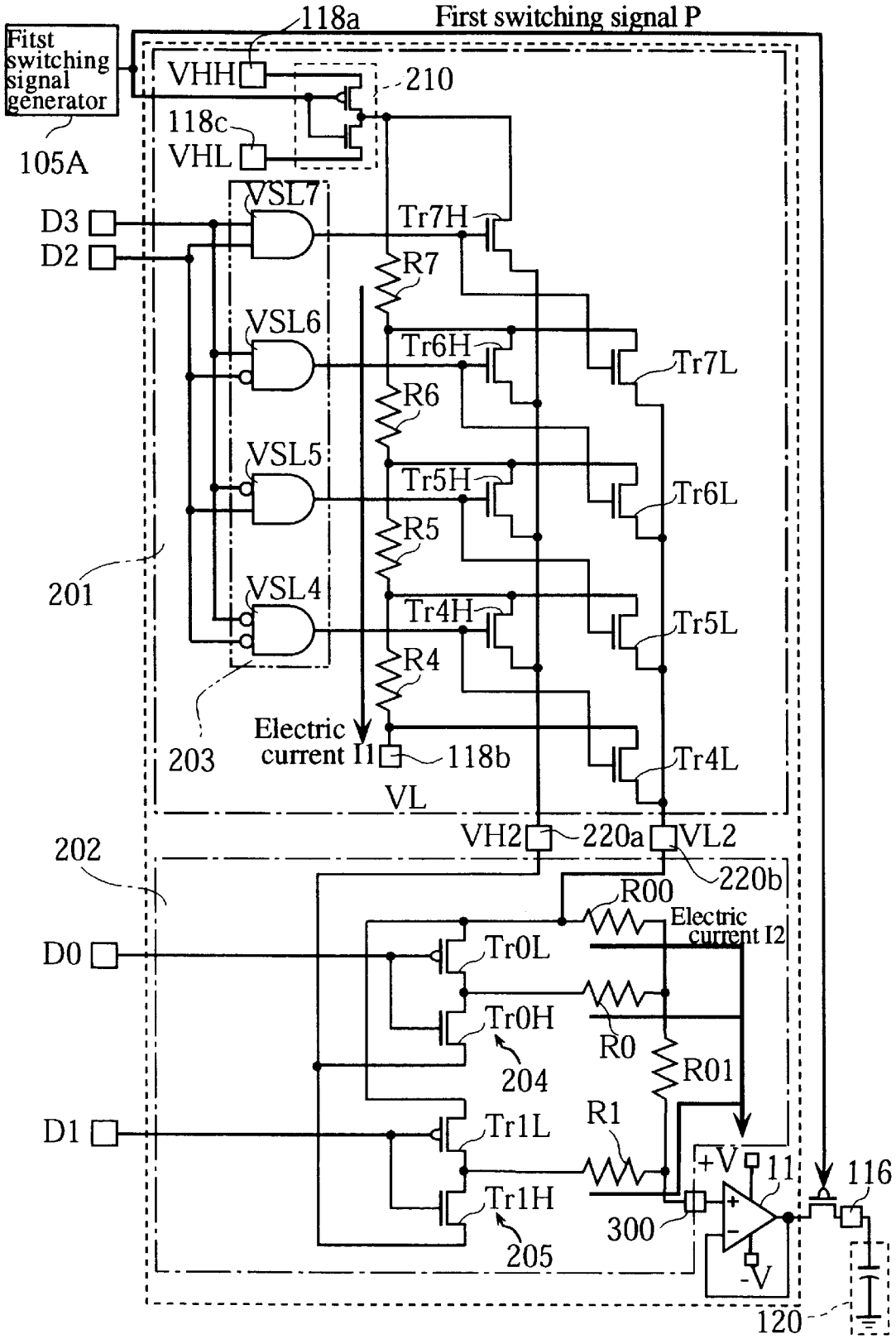
FIG. 48 is a circuit diagram of a DAC incorporated in the LCD driver circuit in accordance with Embodiment 2-19 of the present invention.

FIG. 48 shows the construction of a driver circuit in Embodiment 2-19. This Embodiment 2-19 has a similar construction to Embodiment 2-8, and the same reference characters are used for the corresponding parts. In this Embodiment 2-19, the first switching signal generator circuit 105A is employed in place of the first switching signal generator circuit 105 employed in Embodiment 2-8.

Figure 49:
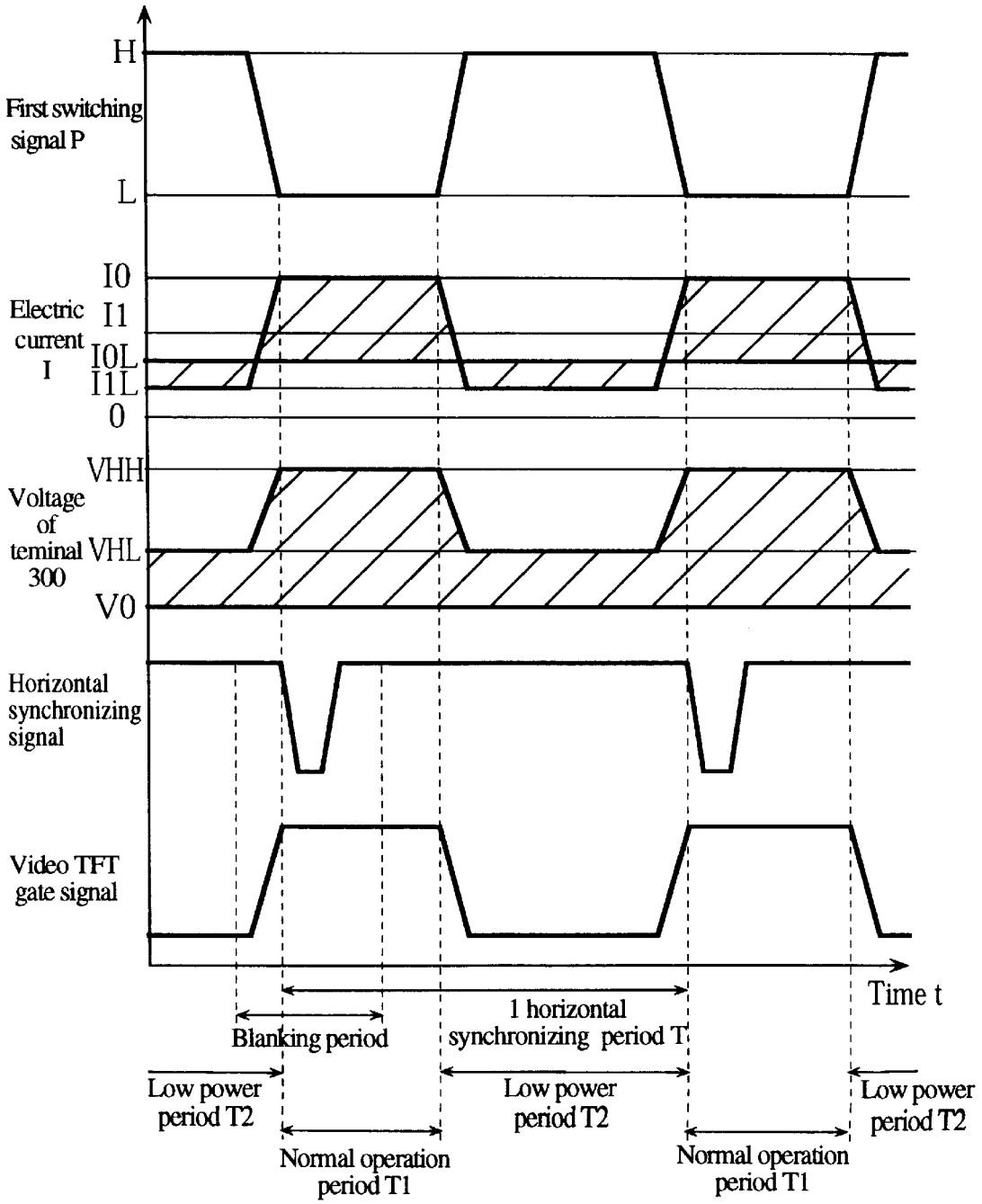
FIG. 49 is a timing chart of a DAC incorporated in the LCD driver circuit in accordance with Embodiment 2-19 of the present invention.

FIG. 49 is the timing chart showing the operations of the DAC. Although this Embodiment 2-19 differs from Embodiment 2-8 in that the first switching signal P is generated from the horizontal synchronizing signal, the operation of the DAC is basically identical to Embodiment 2-8. As well as Embodiment 2-14, this Embodiment 2-19 makes it possible to compensate the variation of power consumption caused by the resistance value variation of the resistance elements in each manufactured array substrate without relying on an adjustment by external circuits and therefore easily achieves the simplification of external circuits and the optimization of power consumption.

(Embodiment 2-20)

Figure 50:
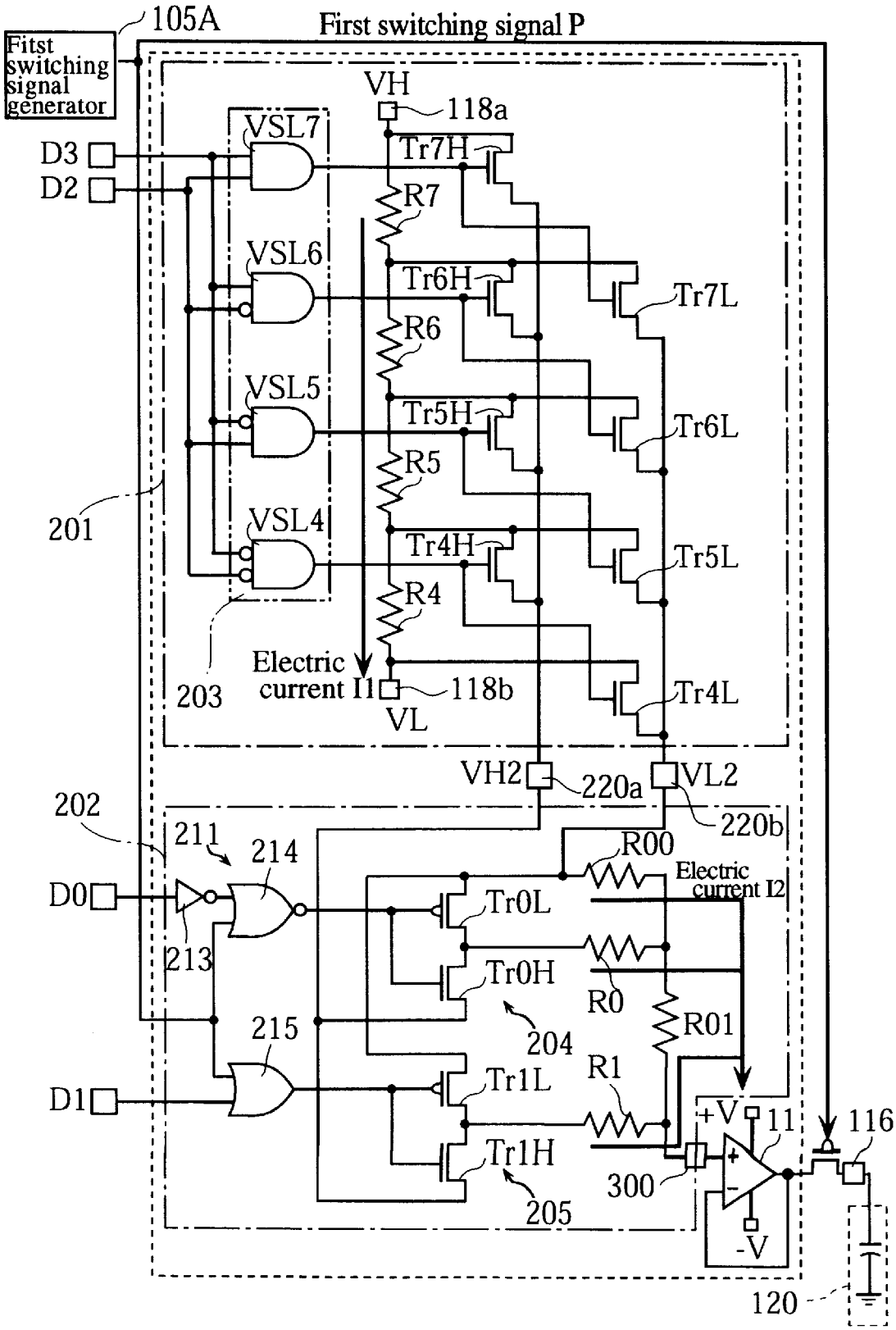
FIG. 50 is a circuit diagram of a DAC incorporated in the LCD driver circuit in accordance with Embodiment 2-20 of the present invention.

FIG. 50 shows the construction of a DAC in Embodiment 2-20. This Embodiment 2-20 has a similar construction to Embodiment 2-9, and the same reference characters are used for the corresponding parts. In this Embodiment 2-20, the first switching signal generator circuit 105A is employed in place of the first switching signal generator circuit 105 employed in Embodiment 2-9.

Figure 51:
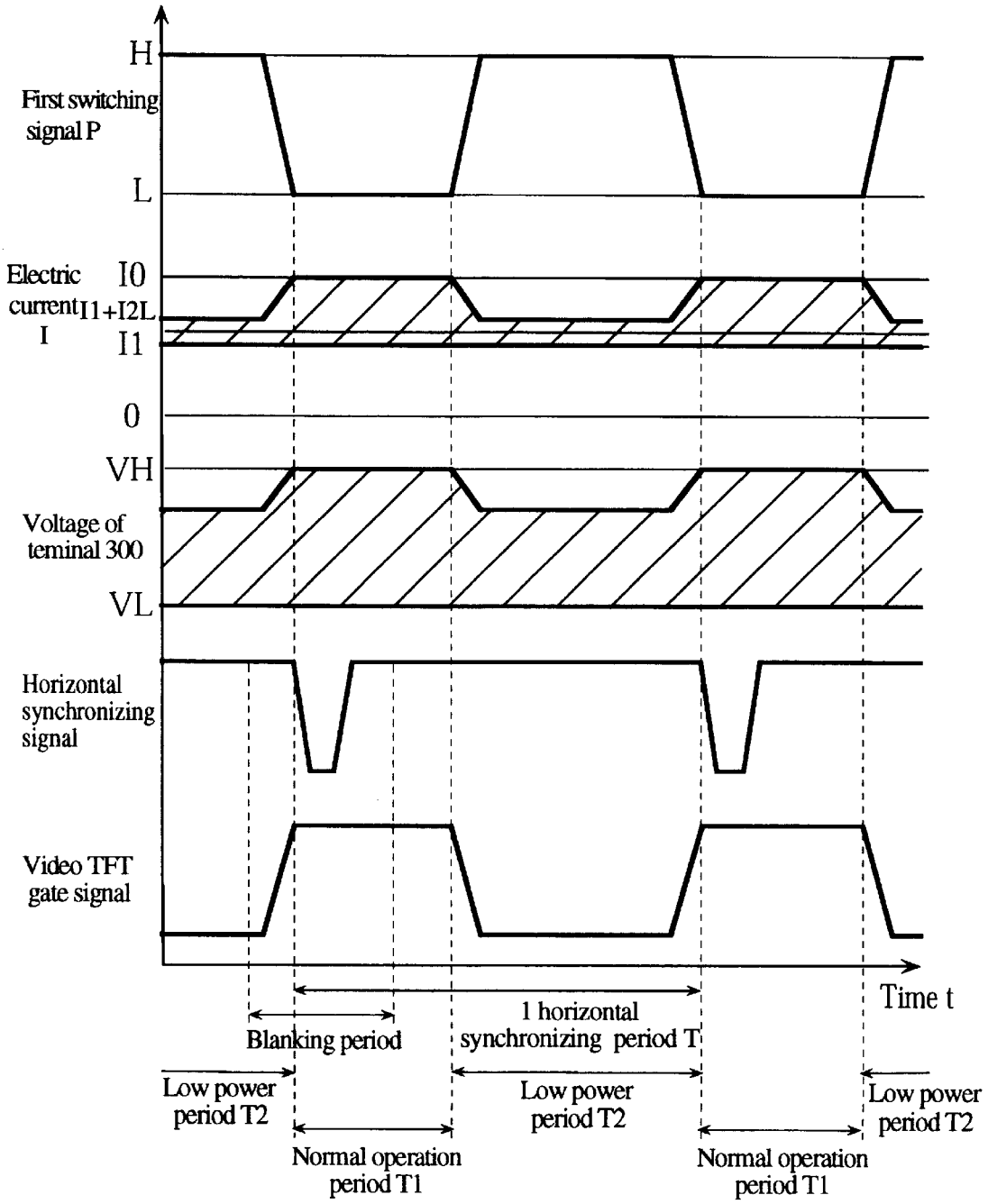
FIG. 51 is a timing chart of a DAC incorporated in the LCD driver circuit in accordance with Embodiment 2-20 of the present invention.

FIG. 51 is the timing chart showing the operations of the DAC. Although this Embodiment 2-20 differs from Embodiment 2-9 in that the first switching signal P is generated from the horizontal synchronizing signal, the operation of the DAC is basically identical to Embodiment 2-9. As well as Embodiment 2-14, this Embodiment 2-20 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-21)

Figure 52:
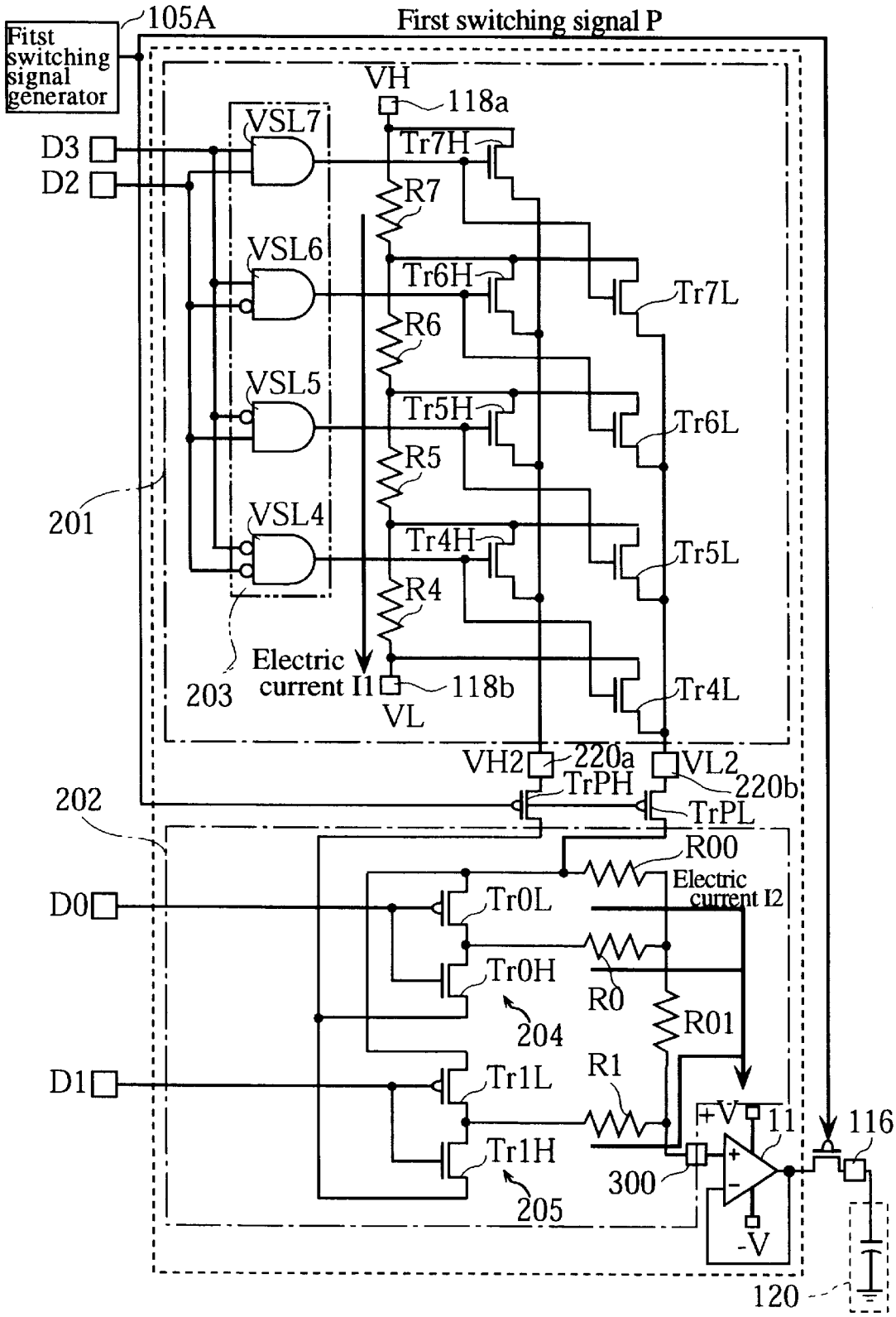
FIG. 52 is a circuit diagram of a DAC incorporated in the LCD driver circuit in accordance with Embodiment 2-21 of the present invention.

FIG. 52 shows the construction of a DAC in Embodiment 2-21. This Embodiment 2-21 has a similar construction to Embodiment 2-10, and the same reference characters are used for the corresponding parts. In this Embodiment 2-21, the first switching signal generator circuit 105A is employed in place of the first switching signal generator circuit 105 employed in Embodiment 2-10.

Figure 53:
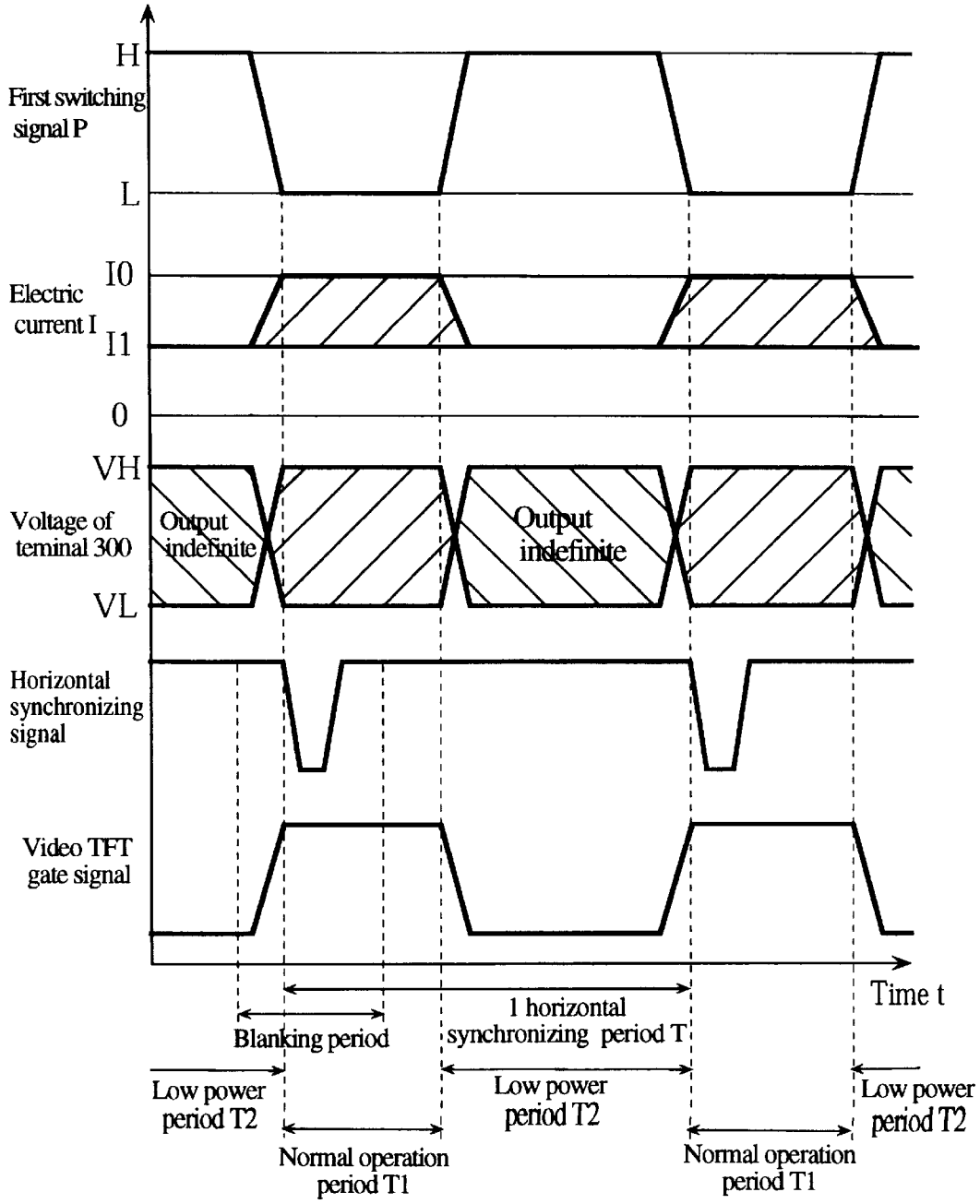
FIG. 53 is a timing chart of a DAC incorporated in the LCD driver circuit in accordance with Embodiment 2-21 of the present invention.

FIG. 53 is the timing chart showing the operations of the DAC. Although this Embodiment 2-21 differs from Embodiment 2-10 in that the first switching signal P is generated from the horizontal synchronizing signal, the operation of the DAC is basically identical to Embodiment 2-10. As well as Embodiment 2-14, this Embodiment 2-21 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-22)

Figure 54:
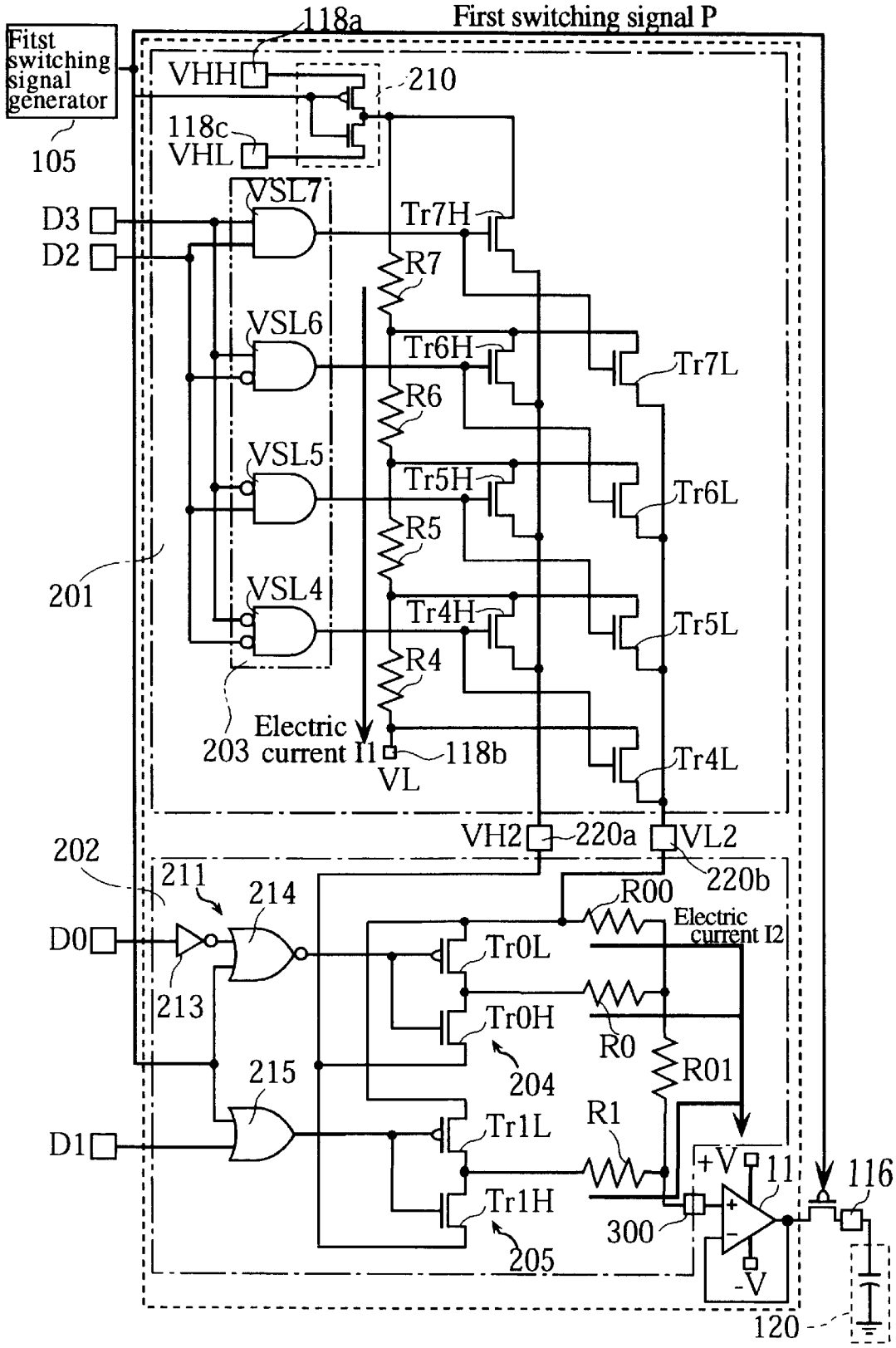
FIG. 54 is a circuit diagram of a DAC incorporated in the LCD driver circuit in accordance with Embodiment 2-22 of the present invention.

FIG. 54 shows the construction of a DAC in Embodiment 2-22. This Embodiment 2-22 has a similar construction to Embodiment 2-11, and the same reference characters are used for the corresponding parts. In this Embodiment 2-22, the first switching signal generator circuit 105A is employed in place of the first switching signal generator circuit 105 employed in Embodiment 2-11.

Figure 55:
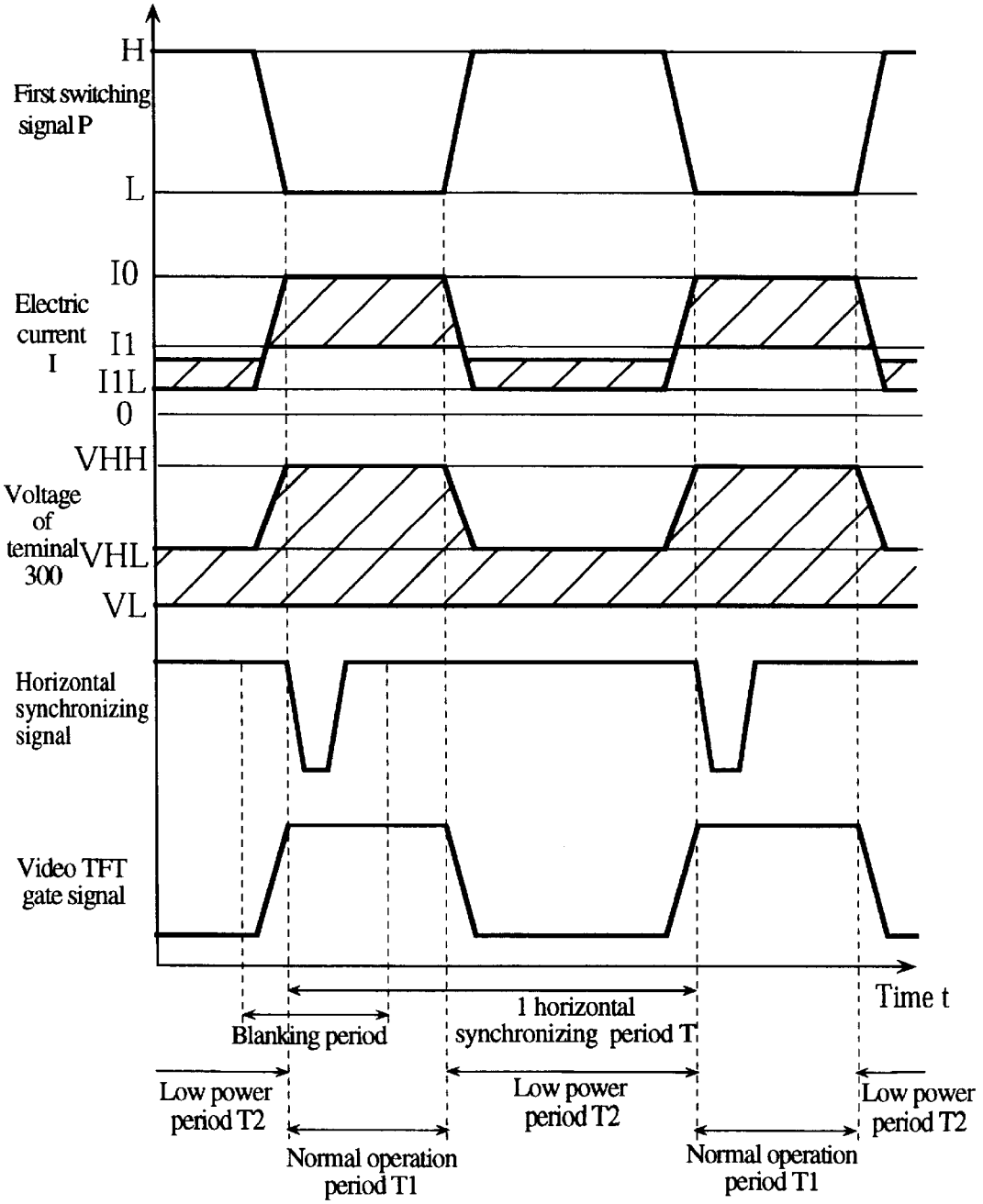
FIG. 55 is a timing chart of a DAC incorporated in the LCD driver circuit in accordance with Embodiment 2-22 of the present invention.

FIG. 55 is the timing chart showing the operations of the DAC. Although this Embodiment 2-22 differs from Embodiment 2-11 in that the first switching signal P is generated from the horizontal synchronizing signal, the operation of the DAC is basically identical to Embodiment 2-11. As well as Embodiment 2-14, this Embodiment 2-22 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-23)

Figure 56:
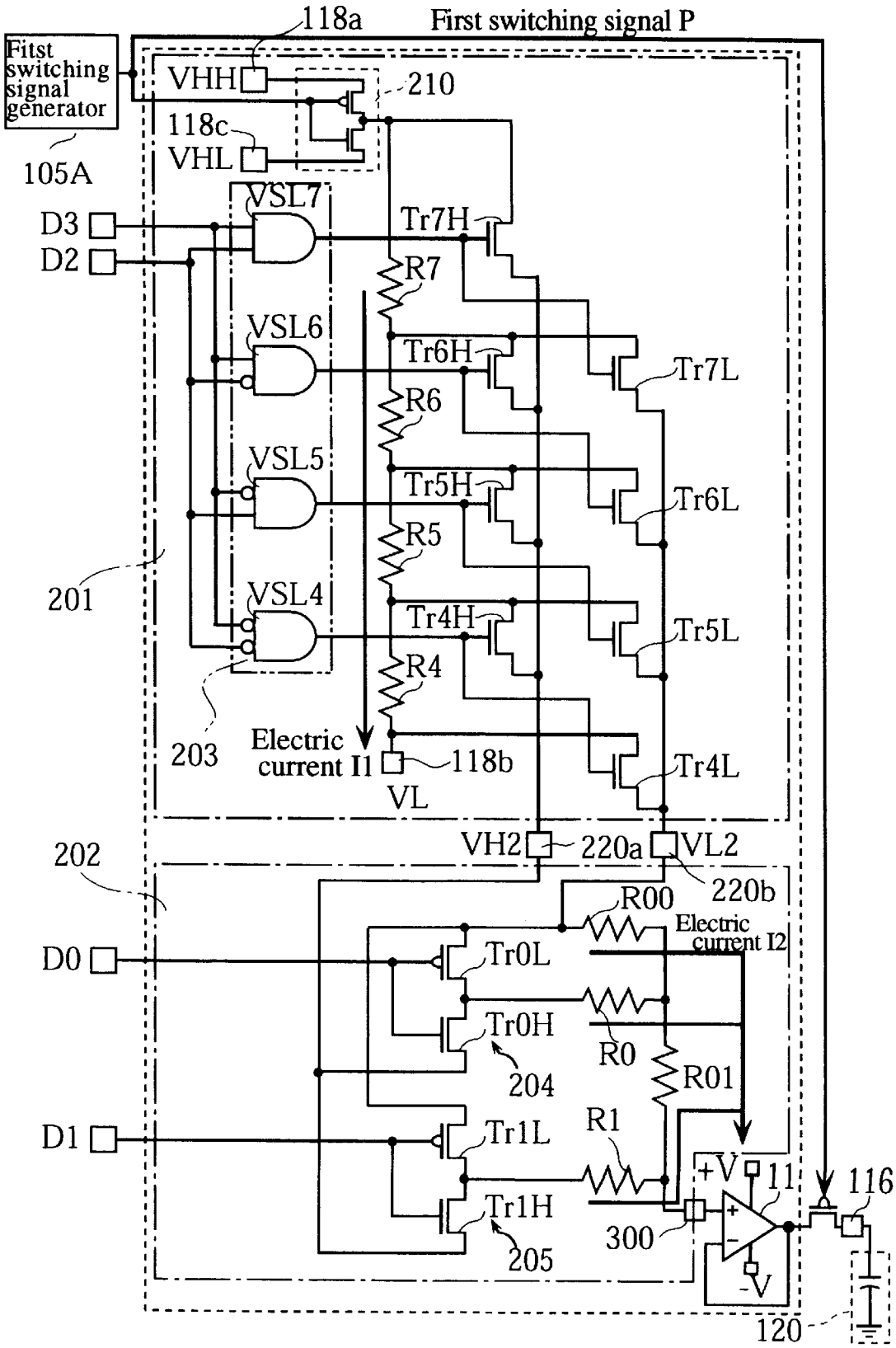
FIG. 56 is a circuit diagram of a DAC incorporated in the LCD driver circuit in accordance with Embodiment 2-23 of the present invention.

FIG. 56 shows the construction of a DAC in Embodiment 2-23. This Embodiment 2-23 has a similar construction to Embodiment 2-12, and the same reference characters are used for the corresponding parts. In this Embodiment 2-23, the first switching signal generator circuit 105A is employed in place of the first switching signal generator circuit 105 employed in Embodiment 2-12.

Figure 57:
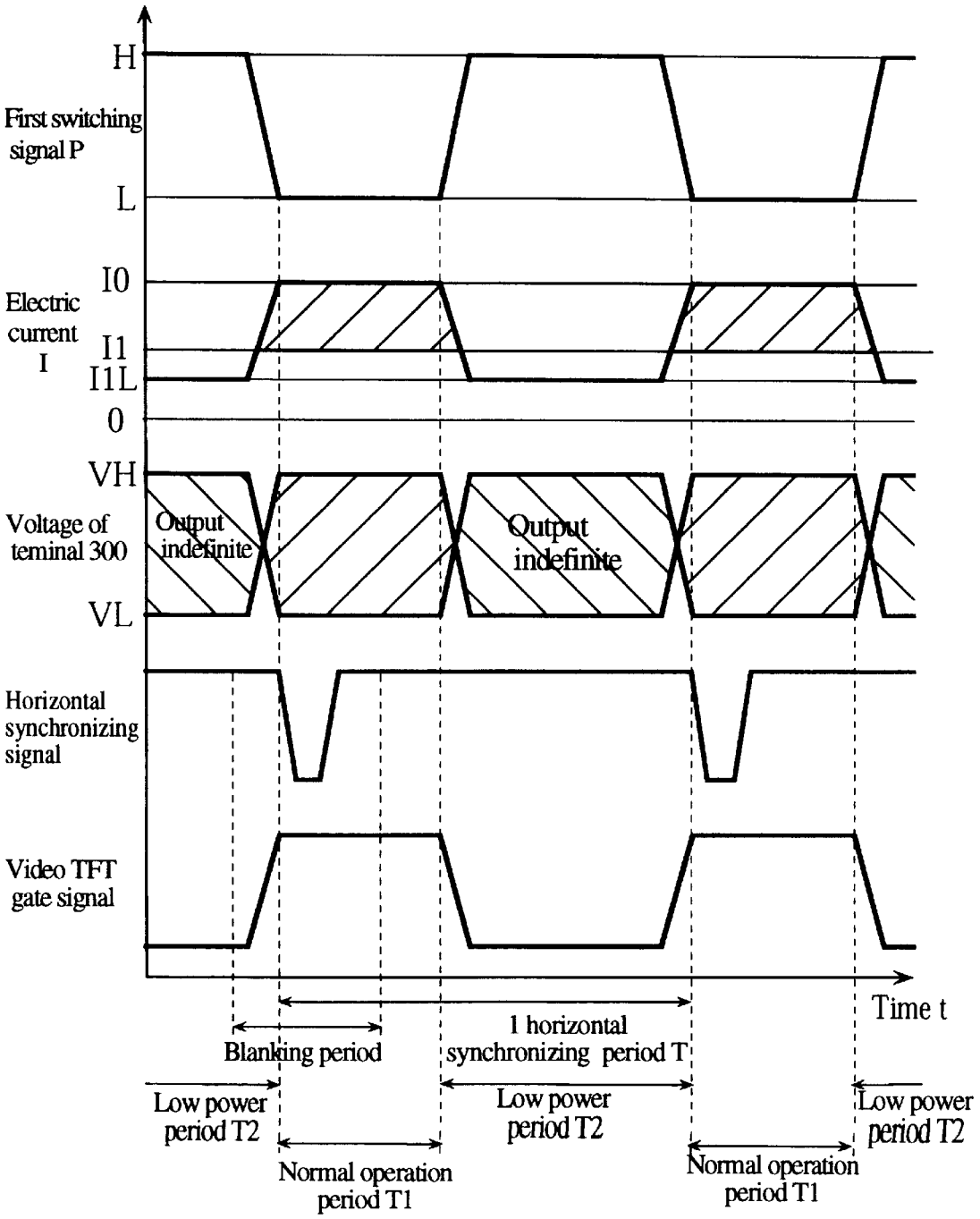
FIG. 57 is a timing chart of a DAC incorporated in the LCD driver circuit in accordance with Embodiment 2-23 of the present invention.

FIG. 57 is the timing chart showing the operations of the DAC. Although this Embodiment 2-23 differs from Embodiment 2-12 in that the first switching signal P is generated from the horizontal synchronizing signal, the operation of the DAC is basically identical to Embodiment 2-12. As well as Embodiment 2-14, this Embodiment 2-23 makes it possible to compensate the variation of power consumption caused by the resistance value variation of the resistance elements in each manufactured array substrate without relying on an adjustment by external circuits, and therefore easily achieves the simplification of external circuits and the optimization of power consumption.

(Embodiment 2-24)

Figure 58:
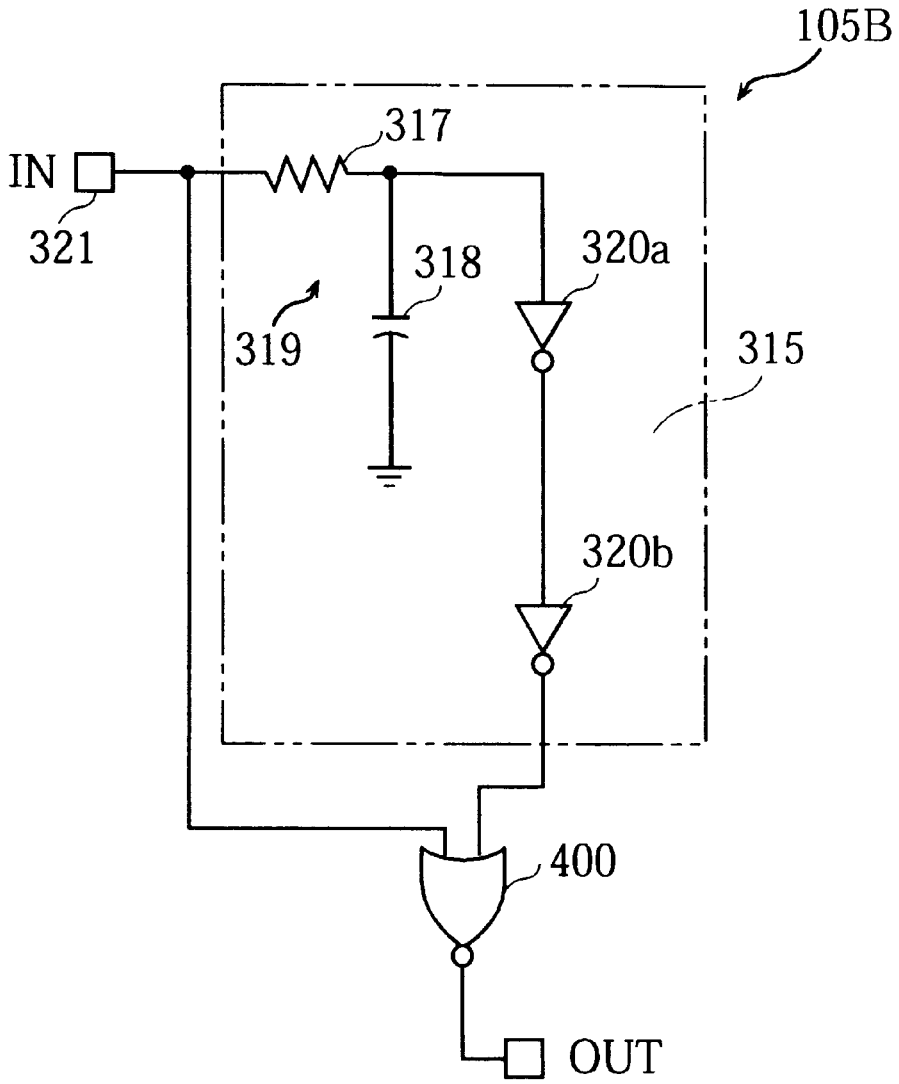
FIG. 58 is a circuit diagram showing the construction of a first switching signal generator circuit 105B in accordance with Embodiment 2-24 of the present invention.
Figure 59:
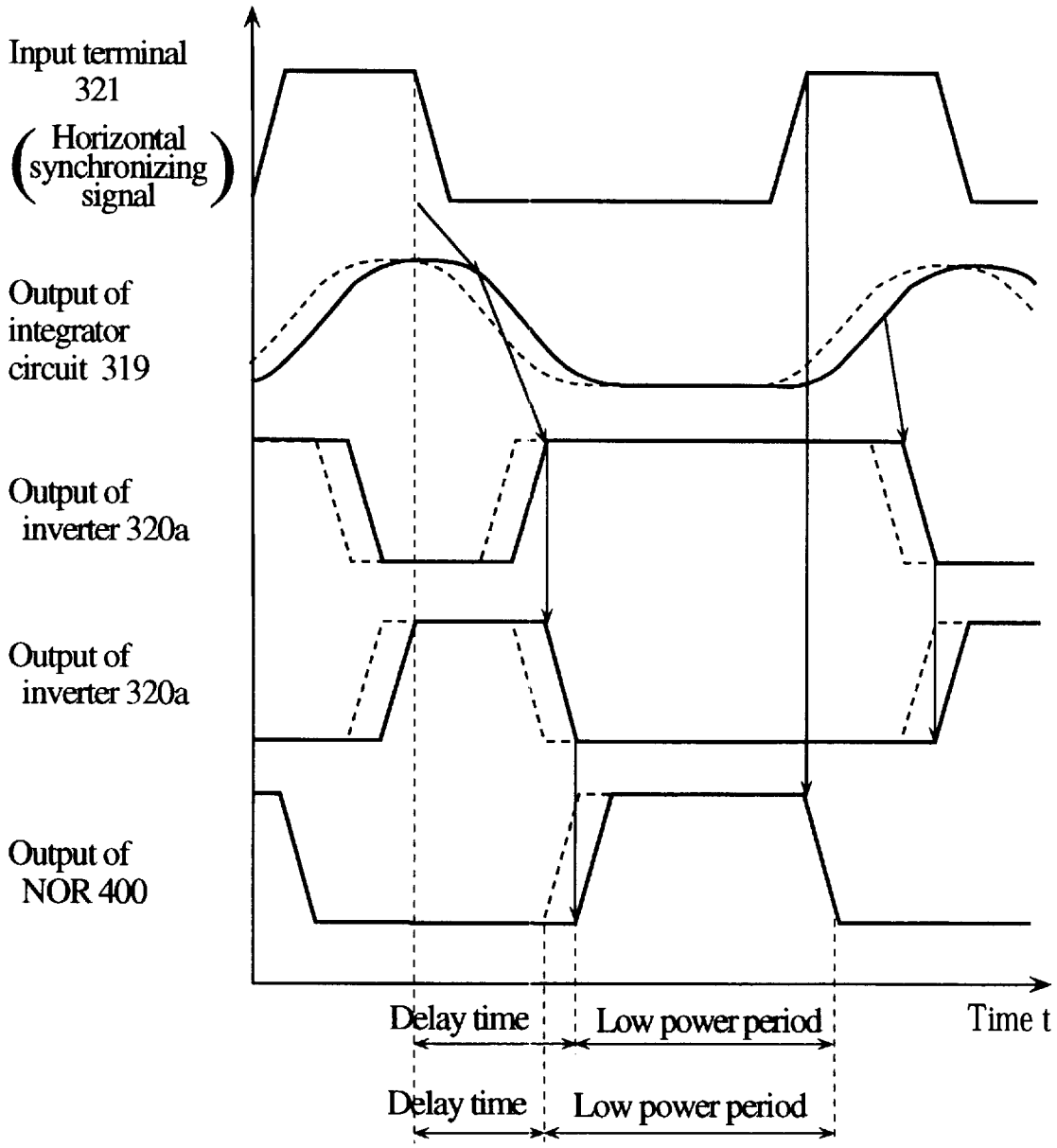
FIG. 59 is a timing chart of the first switching signal generator 105B.

FIG. 58 is a circuit diagram showing the construction of another first switching signal generator circuit 105B, and FIG. 59 is the timing chart showing the operation thereof. This first switching signal generator circuit 105*b* receives an inverted horizontal synchronizing signal, which has an inverted polarity to a horizontal synchronizing signal, and generates a first switching signal P. It is noted that in the DACs utilizing this first switching signal generator circuit 105B, the inverted horizontal synchronizing signals are used in place of the horizontal synchronizing signals, and accordingly the first switching signal generator circuit 105B is used. This first switching signal generator circuit 105B has a similar construction to the first switching signal generator circuit 105A, and the same reference characters are used for the corresponding parts. The first switching signal generator circuit 105B differs from the first switching signal generator circuit 105A in that a NOR gate 400 is provided in place of the AND gate 316.

Referring now to the timing chart of FIG. 55, there is explained hereinafter the workings of input signals in the first switching signal generator circuit 105B having such a construction. When a horizontal synchronizing signal inputted to an input terminal 321 turns to high level, an output level of an integrator circuit 319, which is composed of a resistance element 317 and capacitance element 318, ascends in accordance with a time constant set by the resistance element 317 and capacitance element 318. Thereupon, when the output level of the integrator circuit 319 reaches a threshold voltage of the inverter 320*a*, an output of the inverter 320*a* turns from high level to low level. An output of the inverter 320*b* thereby turns from low level to high level. Thereafter, when the horizontal synchronizing signal turns to low level, the output level of the integrator circuit 319 descends in accordance with the time constant determined by the resistance element 317 and capacitance element 318. Thereupon, when the output of the integrator circuit 319 reaches the threshold voltage of the inverter 320*a*, the output of the inverter 320*a* turns from low level to high level, and thereby the output of the inverter 320*b* turns from high level to low level. As a consequence, the output of the inverter 320*b* is delayed for a time TD determined by a time constant of the integrator circuit 319, as shown in FIG. 59. Thus, an inverted signal of a logical sum of the inverted horizontal synchronizing signal and the output of the inverter 320*b*, which is a delayed inverted horizontal synchronizing signal, is outputted from the NOR gate 400 as the first switching signal.

In this first switching signal generator circuit 105B, the first switching signal P is delayed by the R-C integrator circuit 319. Therefore, as seen in the first switching signal generator circuit 105A, when the resistance element 317 has a large resistance value, the first switching signal P results in a waveform shown by the solid line in FIG. 59, and accordingly the delay time of the horizontal synchronizing signal becomes long as shown by the reference character TDRH. On the other hand, when the resistance element 317 has a small resistance value, the first switching signal P results in a waveform as shown by the dashed line in FIG. 59, and accordingly the delay time of the horizontal synchronizing signal becomes short as shown by the reference character TDRL. It is noted that the length of the low power period also changes correspondingly, as illustrated in the following. When the resistance element 317 has a large resistance value, the low power period accordingly becomes short as shown by the reference character TRH, and conversely, when the resistance element 317 has a small resistance value, the low power period accordingly becomes long as shown by the reference character TRL. Hence, the optimization of power consumption can be also achieved by employing the first switching signal generator circuit 105B having such a construction.

It is noted that, in place of the circuit construction of FIG. 58, it is also possible to employ a circuit construction in which an inverter for inverting an inverted horizontal synchronizing signal is provided and the first switching signal generator circuit 105A is connected to the inverter succeedingly.

(Embodiment 2-25)

Figure 60:
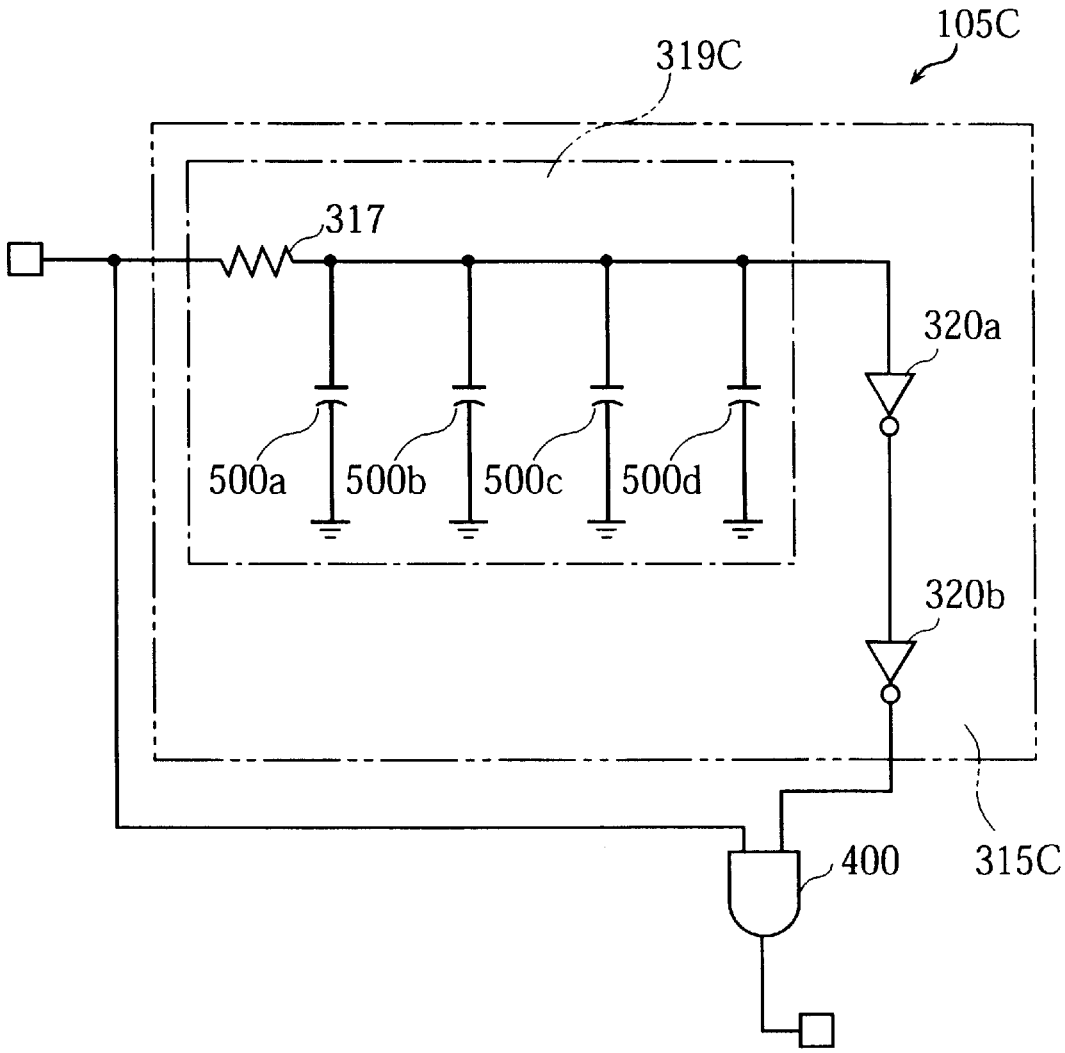
FIG. 60 is a circuit diagram showing the construction of a first switching signal generator circuit 105C in accordance with Embodiment 2-25 of the present invention.

FIG. 60 is a circuit diagram showing the construction of further another first switching signal generator circuit 105C. This first switching signal generator circuit 105C has a similar construction to the first switching signal generator circuit 105, and the same reference characters are used for the corresponding parts. In this first switching signal generator circuit 105C, an integrator circuit 319C is employed in place of the integrator circuit 319 employed in the first switching signal generator circuit 105. This integrator circuit 319C comprises a resistance element 317 and four capacitance elements 500*a*, 500*b*, 500*c*, and 500*d*. These capacitance elements are composed of the capacitive load 120. The capacitance element 500*a* is a capacitance generated in a liquid crystal layer and insulation layer whose electrodes are an entire source line and a counter substrate. The capacitance element 500*b* is a capacitance generated in an insulation layer whose electrodes are a source line and a gate line at the intersection of these lines. The capacitance element 500*c* is a capacitance generated in an insulation layer whose electrodes are a source line and a pixel electrode terminal parallel to the source line. The capacitance element 500*d* is a capacitance retained by a pixel transistor at the intersection of a source line and a gate line. The normal operation period T1 is further optimized by forming the capacitance elements 500*a* to 500*d* by the capacitive load 120. The reason is explained in detail hereinafter.

The normal operation period is determined by a driving ability of a driver circuit and the degree of an output load. The driving ability of a driver circuit entirely depends on the resistance value of the resistance elements composing the DAC. The degree of the output load is, seen from the driver circuit, the capacitive load of a source line. It is considered that there are four types of capacitive loads of a source line, which are 1) a capacitance generated in a liquid crystal layer and an insulation layer wherein the electrodes are an entire source line and a counter substrate, 2) a capacitance generated in an insulation layer wherein the electrodes are a source line and a gate line in the intersection of the lines, 3) a capacitance generated in an insulation layer wherein the electrodes are a source line and a pixel electrode terminal parallel to the source line, and 4) a capacitance retained by a pixel transistor at the intersection of a source line and a gate line. Therefore, the degree of the output load is determined by the total sum of these capacitive loads, 1) to 4).

When a driver circuit is integrally formed on the array substrate, in the present state of art, a variation in resistance elements and capacitance elements therein is inevitably caused. Since the resistance elements are formed in the impurity-containing semiconductor layer, the variation of the resistance value of the resistance elements is mainly caused by the degree of impurity implantation. The variation of the capacitance value of the capacitance elements is mainly caused by the quality and thickness of each insulation layer that forms each capacitance element. The variation of the resistance value is approximately from twice to five times, which is very large, while the variation of the capacitance value is approximately from several % to 10%, which is very small in comparison with the variation of the resistance value. These variations of the resistance value and capacitance value occurs in each manufactured substrate, and therefore the most suitable value of the normal operation period for each substrate is different. Therefore, in order to find an optimal normal operation period for each substrate and to determine the low power period, it is primarily required to reflect the variation of the resistance value. On the basis of this ground, Embodiments 2-14 to 2-24 described hereinbefore are intended to optimize the normal operation period by constructing the integrator circuits with taking into account the variation of the resistance value. As mentioned above, since the variation of the resistance value is far larger than that of the capacitance value, reflecting only the variation of the resistance value will suffice when realizing the optimization of the normal operation period.

However, a variation of electric power as large as approximately from several % to 10% cannot be suppressed unless the optimization is carried out by reflecting the capacitance variation. Therefore, it is preferable that the capacitance variation be also taken into account, in order to further improve the optimization of the normal operation period. For this reason, the further improved optimization of the reduction in power consumption can be achieved by reflecting the capacitance elements as well as the resistance elements when optimizing the low power period, i.e., detecting the normal operation period.

More specifically, in this embodiment, the resistance element that is formed by the same manner as is the resistance elements in the driver circuit and the capacitance elements that uses the same insulation layers as each of the above capacitive loads are employed in constructing an R-C integrator circuit so as to reflect a resistance value per unit area in a semiconductor layer and a capacitance value per unit area in each of the above capacitances, both values being the absolute values for each manufactured substrate. The normal operation period is pseudo-detected by a delay time of the output from the R-C integrator circuit, and the low power period is automatically determined accordingly. According to this construction, in driving the capacitive load by the driver circuit, the normal operation period becomes longer (=the low power period becomes shorter) as the resistance value increases, while the driving period becomes shorter (=the low power period becomes longer) as the resistance value decreases. In the R-C integrator circuit, likewise, the output delay becomes larger as the resistance value increases, while the output delay becomes smaller as the resistance value decreases. The output delay of the R-C integrator circuit thus reflects a variation of the length of the driving period caused by the variation of the resistance value.

On the other hand, as for the variation of the capacitance value, in driving the capacitive load by the driver circuit, the driving period becomes longer (=the low power period becomes shorter) as the capacitive load increases, while the driving period becomes shorter (=the low power period becomes longer) as the capacitive load decreases. In the R-C integrator circuit, likewise, the output delay becomes larger as the capacitive load increases, while the output delay becomes smaller as the capacitive load decreases. The output delay of the R-C integrator circuit thus reflects a variation of the length of the driving period caused by the variation of the capacitive load.

As has been described, this embodiment can further optimize the normal operation period and the low power period when compared with the embodiments wherein only the resistance elements are taken into account and the capacitance loads are not.

It is noted that one dummy source line may be provided for the capacitive loads in the R-C integrator circuit for detecting the normal operation period.

(Other Remarks)

In Embodiments 2-1 to 2-25, although the amplifier element 11 continues to operate throughout one horizontal synchronizing period, the power supply thereto can be cut off during the low power period. This achieves further reduction of power consumption.

INDUSTRIAL APPLICABILITY

As has been described thus far, according to the present invention, DACs are integrated in an array substrate of an LCD, and thereby reduction in cost can be achieved by eliminating driver ICs from the components of an LCD. Moreover, it is made possible to eliminate a manufacturing step of mounting the driver ICs onto the array substrate, and as a result, reduction in the sizes and thickness of an LCD can be also achieved.

Furthermore, according to the present invention, the reduction in power consumption can be achieved by, in a low power period, cutting off or selecting a power supply to a DAC or by fixing an input data to be a data capable of reducing an electric current flowing in the resistance elements. Furthermore, since a potential of an output terminal is retained by a capacitive load, the low power period can include a period in which the period necessary to completely change the voltage of the capacitive load connected to the output terminal is excluded.

What is claimed is:

1. A driver circuit for an active matrix liquid crystal display formed on an array substrate of said liquid crystal display comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate.

2. A driver circuit for an active matrix liquid crystal display as in claim 1, wherein said semiconductor layer is composed of a non-single crystalline material including silicon and germanium, and contains an impurity which acts as a donor or an acceptor.

3. A driver circuit for an active matrix liquid crystal display as in claim 1, wherein said semiconductor layer is a non-single crystalline silicon layer and is at least one layer of an n-type layer and a p-type layer.

4. A driver circuit for an active matrix liquid crystal display as in claim 1, wherein said digital-to-analog converter circuit is an R-2R ladder type digital-to-analog converter circuit.

5. A driver circuit for an active matrix liquid crystal display as in claim 2, wherein said digital-to-analog converter circuit is an R-2R ladder type digital-to-analog converter circuit.

6. A driver circuit for an active matrix liquid crystal display as in claim 3, wherein said digital-to-analog converter circuit is an R-2R ladder type digital-to-analog converter circuit.

7. A driver circuit for an active matrix liquid crystal display as in claim 1, wherein said digital-to-analog converter circuit is a voltage potentiometer type digital-to-analog converter circuit.

8. A driver circuit for an active matrix liquid crystal display as in claim 2, wherein said digital-to-analog converter circuit is a voltage potentiometer type digital-to-analog converter circuit.

9. A driver circuit for an active matrix liquid crystal display as in claim 3, wherein said digital-to-analog converter circuit is a voltage potentiometer type digital-to-analog converter circuit.

10. A driver circuit for an active matrix liquid crystal display formed on an array substrate of said liquid crystal display comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate.

11. A driver circuit for an active matrix liquid crystal display comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1, said current amplifier element being mounted on said array substrate and a remaining portion of said driver circuit excluding said current amplifier element being formed on said array substrate;

said driver circuit characterized in that said resistance elements are composed of an impurity-containing semiconductor layer formed on said array substrate.

12. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, wherein said digital-to-analog converter circuit comprises:

a first digital-to-analog converter circuit section which operates in response to one of more significant bit data and lesser significant bit data of digital video input data; and a second digital-to-analog converter circuit section which uses an output voltage as a reference voltage and operates in response to the other one of more significant bit data and lesser significant bit data of digital video input data; and wherein one of said digital-to-analog converter circuit sections is an R-2R ladder type digital-to-analog converter circuit, and the other one of said digital-to-analog converter circuit sections is a voltage potentiometer type digital-to-analog converter circuit.

13. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of a voltage potentiometer type digital-to-analog converter circuit comprising:

a series circuit wherein a plurality of said resistance elements are connected in series, one end of said series circuit is connected to a high voltage power supply terminal, and the other end is connected to a low voltage power supply terminal;

a first switch connected between said one end of said series circuit and said high voltage power supply terminal or between said other end of said series circuit and said low voltage supply terminal, said first switch to be turned to an ON state during said normal operation period and to be turned to an OFF state during said remaining period in response to said first switching signal; and a group of second switches wherein a switching state of each of said second switches is controlled in response to a digital video data, and each of said second switches is connected between a connecting point of each of said resistance elements and an output terminal of said digital-to-analog converter circuit.

14. A driver circuit for an active matrix liquid crystal display as in claim 13, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

15. A driver circuit for an active matrix liquid crystal display as in claim 13, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

16. A driver circuit for an active matrix liquid crystal display as in claim 13, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

17. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of a voltage potentiometer type digital-to-analog converter circuit comprising:

a series circuit wherein said resistance elements are connected in series, one end of said series circuit is commonly connected to a first high voltage power supply terminal and a second high voltage power supply terminal having a lower voltage level than said first high voltage power supply, and the other end is connected to a low voltage power supply terminal;

a third switch connected between one end of said series circuit and said power supply terminals, said third switch for switching an electrical connection of said one end of said series circuit in response to said first switching signal so that said one end of said series circuit is connected to said first high voltage power supply terminal during said normal operation period and is connected to said second high voltage power supply terminal during said remaining period; and a group of second switches wherein a switching state of each of said second switches is controlled in response to a digital video data, and each of said second switches is connected between a connecting point of each of said resistance elements and an output terminal of said digital-to-analog converter circuit.

18. A driver circuit for an active matrix liquid crystal display as in claim 17, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

19. A driver circuit for an active matrix liquid crystal display as in claim 17, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

20. A driver circuit for an active matrix liquid crystal display as in claim 17, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

21. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of an R-2R ladder type digital-to-analog converter circuit comprising:

an R-2R ladder resistance element network composed of two types of said resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a second switching signal generator circuit for generating a second switching signal to control a switching state of each of said fourth switches and outputting said second switching signal to said group of fourth switches, wherein said second switching signal generator circuit receives said first switching signal and said digital video data, and outputs a data corresponding to said digital video input data as said second switching signal during said normal operation period, and outputs a fixed data as said second switching signal during said remaining period, said fixed data causing a current value in said resistance element network to be not more than an median current value between a minimum current value and a maximum current value in said resistance element network.

22. A driver circuit for an active matrix liquid crystal display as in claim 21, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

23. A driver circuit for an active matrix liquid crystal display as in claim 21, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

24. A driver circuit for an active matrix liquid crystal display as in claim 21, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

25. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of an R-2R ladder type digital-to-analog converter circuit comprising:

an R-2R ladder resistance element network composed of two types of said resistance elements, each type having a different resistance value;

a group of fifth switches for determining an output voltage; and a third switching signal generator circuit for generating a third switching signal to control a switching state of each of said fifth switches and outputting said third switching signal to said group of fifth switches, said third switching signal generator circuit comprising a storage circuit for storing a fixed data causing said group of fifth switches to be OFF state, wherein said third switching signal generator circuit receives said first switching signal and digital video data, and outputs during said normal operation period a data corresponding to said digital video data as said third switching signal, and outputs during said remaining period said fixed data stored in said storage circuit as said third switching signal so as to cut off the power supply to said resistance element network.

26. A driver circuit for an active matrix liquid crystal display as in claim 25, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

27. A driver circuit for an active matrix liquid crystal display as in claim 25, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

28. A driver circuit for an active matrix liquid crystal display as in claim 25, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

29. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a sixth switch connected between one end of said series circuit and said high voltage power supply terminal or between the other end of said series circuit and said low voltage power supply circuit, said sixth switch to be turned to an ON state during said normal operation period and to be turned to an OFF state during said remaining period in response to said first switching signal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches for alternatively selecting between a connecting state with said first connecting terminal and a connecting state with said second connecting terminal in response to said lesser significant bits of said digital video input data;

said driver circuit, wherein:

during said normal operation period, said sixth switch is turned to the ON state, a switching state of each of said seventh switches and a switching state of each of said eighth switches are controlled corresponding to said more significant bits of said digital video input data, and a switching state of each of said ninth switches is controlled corresponding to said lesser significant bits of said digital video input data; and during said remaining period, said sixth switch is turned to the OFF state and said electrical connection with said capacitive load is cut off by said means for cutting off said electrical connection.

30. A driver circuit for an active matrix liquid crystal display as in claim 29, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

31. A driver circuit for an active matrix liquid crystal display as in claim 29, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

32. A driver circuit for an active matrix liquid crystal display as in claim 29, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

33. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, said tenth switch controlled by said first switching signal, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches for alternatively selecting between a connecting state with said first connecting terminal and a connecting state with said second connecting terminal in response to said lesser significant bits of said digital video input data;

said driver circuit wherein:

during said normal operation period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said remaining period, said tenth switch is switched to said second high voltage power supply terminal and said electrical connection with a capacitive load is cut off by said means for cutting off said electrical connection.

34. A driver circuit for an active matrix liquid crystal display as in claim 33, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

35. A driver circuit for an active matrix liquid crystal display as in claim 33, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

36. A driver circuit for an active matrix liquid crystal display as in claim 33, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

37. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising: an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a fourth switching signal to control a switching state of each of said ninth switches and outputting said fourth switching signal to said group of ninth switches, wherein said fourth switching signal generator circuit receives said lesser significant bits of said digital video input data and said first switching signal, and outputs during said normal operation period said fourth switching signal corresponding to said lesser significant bits of said digital video data, and outputs during said remaining period a fixed data as said fourth switching signal, said fixed data causing a current value in said resistance element network to be not more than the median current value between a minimum current value and a maximum current value in said resistance element network.

38. A driver circuit for an active matrix liquid crystal display as in claim 37, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

39. A driver circuit for an active matrix liquid crystal display as in claim 37, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

40. A driver circuit for an active matrix liquid crystal display as in claim 37, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

41. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section comprising a first connecting terminal receiving a higher voltage output from said first digital-to-analog converter circuit section, an eleventh switch connected between said first connecting terminal and a power supply input line connected to said first connecting terminal, a second connecting terminal receiving a lower voltage output from said first digital-to-analog converter circuit section, and a twelfth switch connected between said second connecting terminal and a power supply input line connected to said second connecting terminal, said second digital-to-analog converter circuit section employing as a reference voltage a voltage between said first connecting terminal and said second connecting terminal, and said second digital-to-analog converter operating in response to lesser significant bit of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section further comprising:

an R-2R ladder resistance element network composed of two types of said resistance elements, each type having a different resistance value; and a group of ninth switches provided for each of said lesser significant bits of said digital input data for alternatively selecting between a connecting state with said first connecting terminal and a connecting state with said second connecting terminal;

said driver circuit wherein:

during said normal operation period, said eleventh switch and said twelfth switch are turned to an ON state and a switching state of each of said seventh switches and a switching state of each of said eighth switches are controlled corresponding to said more significant bits of said digital video input data, and a switching state of each of said ninth switches is controlled corresponding to said lesser significant bits of said digital video input data; and during said remaining period, said eleventh switch and said twelfth switch are turned to the OFF state and said electrical connection with said capacitive load is cut off by said means for cutting off said electrical connection.

42. A driver circuit for an active matrix liquid crystal display as in claim 41, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

43. A driver circuit for an active matrix liquid crystal display as in claim 41, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

44. A driver circuit for an active matrix liquid crystal display as in claim 41, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

45. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a fourth switching signal to control a switching state of each of said ninth switches and outputting said fourth switching signal to said group of ninth switches, wherein said fourth switching signal generator circuit receives said lesser significant bits of said digital video input data and said first switching signal, and outputs during said normal operation period said fourth switching signal corresponding to said lesser significant bits of said digital video data, and outputs during said remaining period a fixed data as said fourth switching signal, said fixed data causing a current value in said resistance element network to be not more than the median current value between a minimum current value and a maximum current value in said resistance element network;

said driver circuit wherein:

during said normal operation period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said remaining period, said tenth switch is switched to said second high voltage power supply terminal, said ninth switches are switched corresponding to said fixed input data, and said electrical connection with said capacitive load is cut off by said means for cutting off said electrical connection.

46. A driver circuit for an active matrix liquid crystal display as in claim 45, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

47. A driver circuit for an active matrix liquid crystal display as in claim 45, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

48. A driver circuit for an active matrix liquid crystal display as in claim 45, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

49. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section comprising a first connecting terminal receiving a higher voltage output from said first digital-to-analog converter circuit section, an eleventh switch connected between said first connecting terminal and a power supply input line connected to said first connecting terminal, a second connecting terminal receiving a lower voltage output from said first digital-to-analog converter circuit section, and a twelfth switch connected between said second connecting terminal and a power supply input line connected to said second connecting terminal, said second digital-to-analog converter circuit section employing as a reference voltage a voltage between said first connecting terminal and said second connecting terminal, and said second digital-to-analog converter operating in response to lesser significant bit of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches provided for each of said lesser significant bits of said digital input data for alternatively selecting between a connecting state with said first connecting terminal and a connecting state with said second connecting terminal;

said driver circuit wherein:

during said normal operation period, said tenth switch is switched to said first high voltage power supply terminal, a switching state of said seventh switches and a switching state of said eighth switches are controlled corresponding to said more significant bits of said digital video input data and a switching state of said ninth switches is controlled corresponding to said lesser significant bits of said digital video input data; and during said remaining period, said tenth switch is switched to said second high voltage power supply terminal, said eleventh switch and said twelfth switch are turned to the OFF state and said electrical connection with said capacitive load is cut off by said means for cutting off said electrical connection.

50. A driver circuit for an active matrix liquid crystal display as in claim 49, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

51. A driver circuit for an active matrix liquid crystal display as in claim 49, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

52. A driver circuit for an active matrix liquid crystal display as in claim 49, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

53. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding said precharge period mode;

wherein said digital-to-analog converter circuit is composed of an R-2R ladder type digital-to-analog converter circuit comprising:

an R-2R ladder resistance element network composed of two types of said resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a sixth switching signal generator circuit for generating a sixth switching signal to control a switching state of each of said fourth switches and outputting said sixth switching signal to said group of fourth switches, wherein said sixth switching signal generator circuit receives said fifth switching signal and digital video data, and outputs a data corresponding to said digital video data as said sixth switching signal during said remaining period, and outputs a fixed data as said sixth switching signal during said precharge period, said fixed data causing a current value in said resistance element network to be not more than an median current value between a minimum current value and a maximum current value in said resistance element network.

54. A driver circuit for an active matrix liquid crystal display formed on an array substrate of said liquid crystal display comprising:

a resistive dividing type digital-to-analog converter circuit, comprising a plurality of resistance elements and a plurality of switches related to said resistance elements;

said driver circuit constructed so that an output signal from said digital-to-analog converter circuit is outputted as a driving voltage for a liquid crystal display portion of said liquid crystal display via a current amplifier element having an impedance conversion function wherein a voltage amplification ratio of said current amplifier element is 1;

said driver circuit characterized in that said resistance elements are composed of an impurity-containing semiconductor layer formed on said array substrate, and further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding said precharge period mode;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising: a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a seventh switching signal to control a switching state of each of said ninth switches and outputting said seventh switching signal to said group of ninth switches, wherein said seventh switching signal generator circuit receives said fifth switching signal and said lesser significant bits of said digital video data, and outputs a data corresponding to said lesser significant bits of said digital video input data as said seventh switching signal during said remaining period, and outputs a fixed data as said seventh switching signal during said precharge period, said fixed data causing a current value in said resistance element network to be not more than an median current value between a minimum current value and a maximum current value in said resistance element network;

said driver circuit wherein:

during said remaining period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said precharge period, said tenth switch is switched to said second high voltage power supply terminal, said ninth switches are switched corresponding to said fixed input data, and said electrical connection with said capacitive load is cut off by said means for cutting off said electrical connection.

55. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of a voltage potentiometer type digital-to-analog converter circuit comprising:

a series circuit wherein a plurality of said resistance elements are connected in series, one end of said series circuit is connected to a high voltage power supply terminal, and the other end is connected to a low voltage power supply terminal;

a first switch connected between said one end of said series circuit and said high voltage power supply terminal or between said other end of said series circuit and said low voltage supply terminal, said first switch to be turned to an ON state during said normal operation period and to be turned to an OFF state during said remaining period in response to said first switching signal; and a group of second switches wherein a switching state of each of said second switches is controlled in response to a digital video data, and each of said second switches is connected between a connecting point of each of said resistance elements and an output terminal of said digital-to-analog converter circuit.

56. A driver circuit for an active matrix liquid crystal display as in claim 55, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

57. A driver circuit for an active matrix liquid crystal display as in claim 55, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

58. A driver circuit for an active matrix liquid crystal display as in claim 55, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

59. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of a voltage potentiometer type digital-to-analog converter circuit comprising:

a series circuit wherein said resistance elements are connected in series, one end of said series circuit is commonly connected to a first high voltage power supply terminal and a second high voltage power supply terminal having a lower voltage level than said first high voltage power supply, and the other end is connected to a low voltage power supply terminal;

a third switch connected between one end of said series circuit and said power supply terminals, said third switch for switching an electrical connection of said one end of said series circuit in response to said first switching signal so that said one end of said series circuit is connected to said first high voltage power supply terminal during said normal operation period and is connected to said second high voltage power supply terminal during said remaining period; and a group of second switches wherein a switching state of each of said second switches is controlled in response to a digital video data, and each of said second switches is connected between a connecting point of each of said resistance elements and an output terminal of said digital-to-analog converter circuit.

60. A driver circuit for an active matrix liquid crystal display as in claim 59, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

61. A driver circuit for an active matrix liquid crystal display as in claim 59, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

62. A driver circuit for an active matrix liquid crystal display as in claim 59, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

63. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of an R-2R ladder type digital-to-analog converter circuit comprising:

an R-2R ladder resistance element network composed of two types of said resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a second switching signal generator circuit for generating a second switching signal to control a switching state of each of said fourth switches and outputting said second switching signal to said group of fourth switches, wherein said second switching signal generator circuit receives said first switching signal and said digital video data, and outputs a data corresponding to said digital video input data as said second switching signal during said normal operation period, and outputs a fixed data as said second switching signal during said remaining period, said fixed data causing a current value in said resistance element network to be not more than an median current value between a minimum current value and a maximum current value in said resistance element network.

64. A driver circuit for an active matrix liquid crystal display as in claim 63, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

65. A driver circuit for an active matrix liquid crystal display as in claim 63, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

66. A driver circuit for an active matrix liquid crystal display as in claim 63, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

67. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit is composed of an R-2R ladder type digital-to-analog converter circuit comprising:

an R-2R ladder resistance element network composed of two types of said resistance elements, each type having a different resistance value;

a group of fifth switches for determining an output voltage; and a third switching signal generator circuit for generating a third switching signal to control a switching state of each of said fifth switches and outputting said third switching signal to said group of fifth switches, said third switching signal generator circuit comprising a storage circuit for storing a fixed data causing said group of fifth switches to be OFF state, wherein said third switching signal generator circuit receives said first switching signal and digital video data, and outputs during said normal operation period a data corresponding to said digital video data as said third switching signal, and outputs during said remaining period said fixed data stored in said storage circuit as said third switching signal so as to cut off the power supply to said resistance element network.

68. A driver circuit for an active matrix liquid crystal display as in claim 67, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

69. A driver circuit for an active matrix liquid crystal display as in claim 67, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

70. A driver circuit for an active matrix liquid crystal display as in claim 67, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

71. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a sixth switch connected between one end of said series circuit and said high voltage power supply terminal or between the other end of said series circuit and said low voltage power supply circuit, said sixth switch to be turned to an ON state during said normal operation period and to be turned to an OFF state during said remaining period in response to said first switching signal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches for alternatively selecting between a connecting state with said first connecting terminal and a connecting state with said second connecting terminal in response to said lesser significant bits of said digital video input data;

said driver circuit, wherein:

during said normal operation period, said sixth switch is turned to the ON state, a switching state of each of said seventh switches and a switching state of each of said eighth switches are controlled corresponding to said more significant bits of said digital video input data, and a switching state of each of said ninth switches is controlled corresponding to said lesser significant bits of said digital video input data; and during said remaining period, said sixth switch is turned to the OFF state and said electrical connection with said capacitive load is cut off by said means for cutting off said electrical connection.

72. A driver circuit for an active matrix liquid crystal display as in claim 71, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

73. A driver circuit for an active matrix liquid crystal display as in claim 71, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

74. A driver circuit for an active matrix liquid crystal display as in claim 71, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

75. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, said tenth switch controlled by said first switching signal, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches for alternatively selecting between a connecting state with said first connecting terminal and a connecting state with said second connecting terminal in response to said lesser significant bits of said digital video input data;

said driver circuit wherein:

during said normal operation period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said remaining period, said tenth switch is switched to said second high voltage power supply terminal and said electrical connection with a capacitive load is cut off by said means for cutting off said electrical connection.

76. A driver circuit for an active matrix liquid crystal display as in claim 75, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

77. A driver circuit for an active matrix liquid crystal display as in claim 75, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

78. A driver circuit for an active matrix liquid crystal display as in claim 75, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

79. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a fourth switching signal to control a switching state of each of said ninth switches and outputting said fourth switching signal to said group of ninth switches, wherein said fourth switching signal generator circuit receives said lesser significant bits of said digital video input data and said first switching signal, and outputs during said normal operation period said fourth switching signal corresponding to said lesser significant bits of said digital video data, and outputs during said remaining period a fixed data as said fourth switching signal, said fixed data causing a current value in said resistance element network to be not more than the median current value between a minimum current value and a maximum current value in said resistance element network.

80. A driver circuit for an active matrix liquid crystal display as in claim 79, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

81. A driver circuit for an active matrix liquid crystal display as in claim 79, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

82. A driver circuit for an active matrix liquid crystal display as in claim 79, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

83. A driver circuit for an active matrix liquid crystal display formed on an array substrate of said liquid crystal display comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section comprising a first connecting terminal receiving a higher voltage output from said first digital-to-analog converter circuit section, an eleventh switch connected between said first connecting terminal and a power supply input line connected to said first connecting terminal, a second connecting terminal receiving a lower voltage output from said first digital-to-analog converter circuit section, and a twelfth switch connected between said second connecting terminal and a power supply input line connected to said second connecting terminal, said second digital-to-analog converter circuit section employing as a reference voltage a voltage between said first connecting terminal and said second connecting terminal, and said second digital-to-analog converter operating in response to lesser significant bit of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is connected to a high voltage power supply terminal, and the other end is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section further comprising:

an R-2R ladder resistance element network composed of two types of said resistance elements, each type having a different resistance value; and a group of ninth switches provided for each of said lesser significant bits of said digital input data for alternatively selecting between a connecting state with said first connecting terminal and a connecting state with said second connecting terminal;

said driver circuit wherein:

during said normal operation period, said eleventh switch and said twelfth switch are turned to an ON state and a switching state of each of said seventh switches and a switching state of each of said eighth switches are controlled corresponding to said more significant bits of said digital video input data, and a switching state of each of said ninth switches is controlled corresponding to said lesser significant bits of said digital video input data; and during said remaining period, said eleventh switch and said twelfth switch are turned to the OFF state and said electrical connection with said capacitive load is cut off by said means for cutting off said electrical connection.

84. A driver circuit for an active matrix liquid crystal display as in claim 83, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

85. A driver circuit for an active matrix liquid crystal display as in claim 83, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

86. A driver circuit for an active matrix liquid crystal display as in claim 83, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

87. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a fourth switching signal to control a switching state of each of said ninth switches and outputting said fourth switching signal to said group of ninth switches, wherein said fourth switching signal generator circuit receives said lesser significant bits of said digital video input data and said first switching signal, and outputs during said normal operation period said fourth switching signal corresponding to said lesser significant bits of said digital video data, and outputs during said remaining period a fixed data as said fourth switching signal, said fixed data causing a current value in said resistance element network to be not more than the median current value between a minimum current value and a maximum current value in said resistance element network;

said driver circuit wherein:

during said normal operation period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said remaining period, said tenth switch is switched to said second high voltage power supply terminal, said ninth switches are switched corresponding to said fixed input data, and said electrical connection with said capacitive load is cut off by said means for cutting off said electrical connection.

88. A driver circuit for an active matrix liquid crystal display as in claim 87, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

89. A driver circuit for an active matrix liquid crystal display as in claim 87, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

90. A driver circuit for an active matrix liquid crystal display as in claim 87, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

91. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a first switching signal generator circuit which receives a predetermined reference signal and generates a first switching signal for alternatively selecting between a normal operation period and a remaining period; and means for cutting off an electrical connection between said driver circuit and a capacitive load connected to a source line only during said remaining period in response to said first switching signal;

wherein said digital-to-analog converter circuit comprises:

a first digital-to-analog converter circuit section which operates in response to more significant bits of digital video input data; and a second digital-to-analog converter circuit section comprising a first connecting terminal receiving a higher voltage output from said first digital-to-analog converter circuit section, an eleventh switch connected between said first connecting terminal and a power supply input line connected to said first connecting terminal, a second connecting terminal receiving a lower voltage output from said first digital-to-analog converter circuit section, and a twelfth switch connected between said second connecting terminal and a power supply input line connected to said second connecting terminal, said second digital-to-analog converter circuit section employing as a reference voltage a voltage between said first connecting terminal and said second connecting terminal, and said second digital-to-analog converter operating in response to lesser significant bit of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value; and a group of ninth switches provided for each of said lesser significant bits of said digital input data for alternatively selecting between a connecting state with said first connecting terminal and a connecting state with said second connecting terminal;

said driver circuit wherein:

during said normal operation period, said tenth switch is switched to said first high voltage power supply terminal, a switching state of said seventh switches and a switching state of said eighth switches are controlled corresponding to said more significant bits of said digital video input data and a switching state of said ninth switches is controlled corresponding to said lesser significant bits of said digital video input data; and during said remaining period, said tenth switch is switched to said second high voltage power supply terminal, said eleventh switch and said twelfth switch are turned to the OFF state and said electrical connection with said capacitive load is cut off by said means for cutting off said electrical connection.

92. A driver circuit for an active matrix liquid crystal display as in claim 91, wherein said means for cutting off said electrical connection between said driver circuit and said capacitive load connected to said source line is such an output switch provided on an output side of said driver circuit that, in response to said first switching signal, said output switch is turned to an ON state during said normal operation period, and is turned to an OFF state during said remaining period so as to cut off said electrical connection.

93. A driver circuit for an active matrix liquid crystal display as in claim 91, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitor element, said delay circuit for delaying said horizontal synchronizing signal for a predetermined delay time determined by a resistance value of said resistance element in said integrator circuit; and a logic circuit wherein an output from said delay circuit and said horizontal synchronizing signal are ANDed together to output a resultant signal as said first switching signal.

94. A driver circuit for an active matrix liquid crystal display as in claim 91, wherein said first switching signal generator circuit receives a horizontal synchronizing signal, generates a first switching signal from said horizontal synchronizing signal, and outputs said first switching signal to said digital-to-analog converter circuit:

said first switching signal generator circuit comprising:

a delay circuit comprising an integrator circuit composed of a resistance element and a capacitance element composed of a capacitive load connected to a source line, said delay circuit for delaying said horizontal synchronizing signal for a predetermined delay time determined by a resistance value of said resistance element in said integrator circuit and a capacitance value of said capacitance element in said integrator circuit; and a logic circuit wherein an output from said delay circuit and said horizontal synchronizing signal are ANDed together to output a resultant signal as said first switching signal.

95. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding said precharge period mode;

wherein said digital-to-analog converter circuit is composed of an R-2R ladder type digital-to-analog converter circuit comprising:

an R-2R ladder resistance element network composed of two types of said resistance elements, each type having a different resistance value;

a group of fourth switches, each provided for each bit of digital video data, for determining an output voltage by alternatively selecting between a connecting state with a high voltage power supply terminal and a connecting state with a low voltage power supply terminal; and a sixth switching signal generator circuit for generating a sixth switching signal to control a switching state of each of said fourth switches and outputting said sixth switching signal to said group of fourth switches, wherein said sixth switching signal generator circuit receives said fifth switching signal and digital video data, and outputs a data corresponding to said digital video data as said sixth switching signal during said remaining period, and outputs a fixed data as said sixth switching signal during said precharge period, said fixed data causing a current value in said resistance element network to be not more than an median current value between a minimum current value and a maximum current value in said resistance element network.

96. A driver circuit for an active matrix liquid crystal display formed on an array substrate of said liquid crystal display, comprising:

a resistive dividing type digital-to-analog converter circuit, comprising a plurality of resistance elements and a plurality of switches related to said resistance elements;

said driver circuit constructed so that an output signal from each of said digital-to-analog converter circuits is directly outputted as a driving voltage for a liquid crystal display portion of said liquid crystal display;

said driver circuit characterized in that said resistance elements are composed of an impurity-containing semiconductor layer formed on said array substrate, and further comprising:

a fifth switching signal generator circuit which receives a predetermined reference signal and generates a fifth switching signal for selecting one of the modes between a precharge period mode for a precharge which is carried out prior to writing video data into a source line and a remaining period mode excluding said precharge period mode;

wherein said digital-to-analog converter circuit comprises:

a first digital-to-analog converter circuit section which operates in response to more significant bits of digital video input data; and a second digital-to-analog converter circuit section, which comprises a first connecting terminal receiving a higher voltage output from said first digital-to-analog converter circuit section and a second connecting terminal receiving a lower voltage output from said first digital-to-analog converter circuit section, which employs as a reference voltage a voltage between said first connecting terminal and said second connecting terminal, and which operates in response to lesser significant bits of said digital video input data;

said first digital-to-analog converter circuit section being composed of a voltage potentiometer type digital-to-analog converter circuit and said second digital-to-analog converter circuit section being composed of an R-2R ladder type digital-to-analog converter circuit;

said first digital-to-analog converter circuit section comprising:

a series circuit wherein a plurality of said resistance elements are connected in series, one end of said series circuit is commonly connected to a first high voltage power supply terminal and a second high voltage power supply terminal having a lower voltage level than said first high voltage power supply terminal via a tenth switch for selecting a power supply, and the other end of said series circuit is connected to a low voltage power supply terminal;

a group of seventh switches each connected between a connecting point of each of said resistance elements in said series circuit and said first connecting terminal, said seventh switches controlled by said more significant bits of said digital video input data; and a group of eighth switches each connected between a connecting point of each of said resistance elements in said series circuit and said second connecting terminal, said eighth switches controlled by said more significant bits of said digital video input data;

said second digital-to-analog converter circuit section comprising:

an R-2R ladder resistance element network composed of two types of said resistance elements, each type having a different resistance value;

a group of ninth switches provided for each of said lesser significant bits of said digital input data for alternatively selecting between a connecting state with said first connecting terminal and a connecting state with said second connecting terminal; and a fourth switching signal generator circuit for generating a seventh switching signal to control a switching state of each of said ninth switches and outputting said seventh switching signal to said group of ninth switches, wherein said seventh switching signal generator circuit receives said fifth switching signal and said lesser significant bits of said digital video data, and outputs a data corresponding to said lesser significant bits of said digital video input data as said seventh switching signal during said remaining period, and outputs a fixed data as said seventh switching signal during said precharge period, said fixed data causing a current value in said resistance element network to be not more than an-median current value between a minimum current value and a maximum current value in said resistance element network;

said driver circuit wherein:

during said remaining period, said tenth switch is switched to said first high voltage power supply terminal, a switching state of said seventh switches and a switching state of said eighth switches are controlled corresponding to said more significant bits of said digital video input data, and a switching state of said ninth switches is controlled corresponding to said lesser significant bits of said digital video input data; and during said precharge period, said tenth switch is switched to said second high voltage power supply terminal, said ninth switches are switched corresponding to said fixed input data, and said electrical connection with said capacitive load is cut off by said means for cutting off said electrical connection.

* * * * *